US008025367B2

(12) United States Patent
North et al.

(10) Patent No.: US 8,025,367 B2
(45) Date of Patent: Sep. 27, 2011

(54) INKJET PRINTHEAD WITH TITANIUM ALUMINIUM ALLOY HEATER

(75) Inventors: Angus John North, Balmain (AU); Jennifer Mia Fishburn, Balmain (AU); Lakshmi Channarayapatna, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 358 days.

(21) Appl. No.: 12/253,239

(22) Filed: Oct. 17, 2008

(65) Prior Publication Data

US 2010/0097429 A1 Apr. 22, 2010

(51) Int. Cl.
*B41J 2/05* (2006.01)
*B41J 2/04* (2006.01)

(52) U.S. Cl. ..... 347/62; 347/54

(58) Field of Classification Search ..... 347/62, 347/54
See application file for complete search history.

(56) References Cited

U.S. PATENT DOCUMENTS 6,425,964 B1 * 7/2002 Deevi et al. ..... 148/421
2005/0280672 A1 * 12/2005 Silverbrook et al. ..... 347/62

FOREIGN PATENT DOCUMENTS

EP 1657061 A2 5/2006
JP 07-314687 A 12/1995
WO WO 00/64805 A1 11/2000

* cited by examiner

*Primary Examiner* — Geoffrey Mruk

(57) ABSTRACT

An inkjet printhead with a resistive heaters for vaporizing ink to eject drops through respective nozzles. The heater is formed from a TiAlX alloy where Ti contributes more than 40% by weight, Al contributes more than 40% by weight and X contributes less than 5% by weight and comprises zero or more of Ag, Cr, Mo, Nb, Si, Ta and W.

10 Claims, 56 Drawing Sheets

INKJET PRINTHEAD WITH TITANIUM ALUMINIUM ALLOY HEATER

FIELD OF THE INVENTION

The invention relates to MEMS devices and in particular MEMS devices that vaporize liquid to generate a vapor bubble during operation.

CROSS REFERENCES TO RELATED APPLICATIONS

Various methods, systems and apparatus relating to the present invention are disclosed in the following US patents/patent applications filed by the applicant or assignee of the present invention:

| | | | | | | |
|---|---|---|---|---|---|---|
| 6,750,901 | 6,476,863 | 6,788,336 | 7,364,256 | 7,258,417 | 7,293,853 | 7,328,968 |
| 7,270,395 | 11/003,404 | 11/003,419 | 7,334,864 | 7,255,419 | 7,284,819 | 7,229,148 |
| 7,258,416 | 7,273,263 | 7,270,393 | 6,984,017 | 7,347,526 | 7,357,477 | 11/748,482 |
| 11/778,563 | 11/779,851 | 11/778,574 | 11/853,816 | 11/853,814 | 11/853,786 | 11/872,037 |
| 11/856,694 | 11/965,703 | 11/971,170 | 12/023,011 | 12/036,896 | 12/050,154 | 11/003,463 |
| 12/146,447 | 12/146,448 | 7,364,255 | 12/056,247 | 7,357,476 | 12/050,001 | 11/003,614 |
| 7,284,820 | 7,341,328 | 7,246,875 | 7,322,669 | 11/764,760 | 11/853,777 | 11/955,354 |
| 12/022,994 | 11/293,800 | 11/293,802 | 11/293,801 | 11/293,808 | 11/293,809 | 11/482,975 |
| 11/482,970 | 11/482,968 | 11/482,972 | 11/482,971 | 11/482,969 | 12/234,688 | 12/233,590 |
| 12/249,951 | 12/247,187 | 6,623,101 | 6,406,129 | 6,505,916 | 6,457,809 | 6,550,895 |
| 6,457,812 | 7,152,962 | 7,204,941 | 7,282,164 | 10/815,628 | 11/845,672 | 7,278,727 |
| 7,417,141 | 10/913,374 | 7,367,665 | 7,138,391 | 7,153,956 | 7,423,145 | 10/913,379 |
| 10/913,376 | 7,122,076 | 7,148,345 | 11/172,816 | 11/172,815 | 11/172,814 | 11/482,990 |
| 11/482,986 | 11/482,985 | 11/454,899 | 11/583,942 | 11/592,990 | 11/849,360 | 11/831,961 |
| 11/831,962 | 11/831,963 | 12/119,497 | 11/832,629 | 11/832,637 | 61,027,756 | 12/055,316 |
| 12/171,295 | 12/188,209 | 61,078,319 | 12/249,950 | 7,416,280 | 6,746,105 | 7,156,508 |
| 7,159,972 | 7,083,271 | 7,165,834 | 7,080,894 | 7,201,469 | 7,090,336 | 7,156,489 |
| 7,413,283 | 10/760,246 | 7,083,257 | 7,258,422 | 7,255,423 | 7,219,980 | 10/760,253 |
| 7,416,274 | 7,367,649 | 7,118,192 | 10/760,194 | 7,322,672 | 7,077,505 | 7,198,354 |
| 7,077,504 | 10/760,189 | 7,198,355 | 7,401,894 | 7,322,676 | 7,152,959 | 7,213,906 |
| 7,178,901 | 7,222,938 | 7,108,353 | 7,104,629 | 11/446,227 | 7,370,939 | 7,429,095 |
| 7,404,621 | 7,261,401 | 11/474,279 | 11/482,939 | 7,328,972 | 7,322,673 | 7,306,324 |
| 7,306,325 | 11/603,824 | 7,399,071 | 11/601,672 | 7,303,261 | 11/653,253 | 11/706,328 |
| 11/706,299 | 7,399,053 | 11/737,080 | 11/737,041 | 11/778,062 | 11/778,566 | 11/782,593 |
| 7,404,623 | 11/945,157 | 11/951,095 | 11/951,828 | 11/954,906 | 11/954,949 | 11/967,226 |
| 12/101,152 | 12/114,799 | 12/138,426 | 12/139,491 | 12/138,429 | 12/140,963 | 12/141,893 |
| 12/140,918 | 12/169,562 | 12/190,586 | 12/205,895 | 12/205,892 | 7,246,886 | 7,128,400 |
| 7,108,355 | 6,991,322 | 7,287,836 | 7,118,197 | 12/196,286 | 10/728,784 | 7,364,269 |
| 7,077,493 | 6,962,402 | 10/728,803 | 7,147,308 | 10/728,779 | 7,118,198 | 7,168,790 |
| 7,172,270 | 7,229,155 | 6,830,318 | 7,195,342 | 7,175,261 | 10/773,183 | 7,108,356 |
| 7,118,202 | 10/773,186 | 7,134,744 | 10/773,185 | 7,134,743 | 7,182,439 | 7,210,768 |
| 10/773,187 | 7,134,745 | 7,156,484 | 7,118,201 | 7,111,926 | 7,431,433 | 7,018,021 |
| 7,401,901 | 11/060,805 | 11/188,017 | 7,128,402 | 7,387,369 | 11/329,157 | 11/490,041 |
| 11/501,767 | 7,284,839 | 7,246,885 | 7,229,156 | 11/505,846 | 11/505,857 | 7,293,858 |
| 11/524,908 | 11/524,938 | 7,258,427 | 11/524,912 | 7,278,716 | 11/592,995 | 11/603,825 |
| 11/649,773 | 11/650,549 | 11/653,237 | 11/706,378 | 11/706,962 | 11/749,118 | 11/754,937 |
| 11/749,120 | 11/744,885 | 11/779,850 | 11/765,439 | 11/842,950 | 11/839,539 | 11/926,121 |
| 12/025,621 | 12/138,416 | 12/144,597 | 12/169,632 | 12/169,633 | 09/575,197 | 7,079,712 |
| 6,825,945 | 7,330,974 | 6,813,039 | 6,987,506 | 7,038,797 | 6,980,318 | 6,816,274 |
| 7,102,772 | 7,350,236 | 6,681,045 | 6,728,000 | 7,173,722 | 7,088,459 | 09/575,181 |
| 7,068,382 | 7,062,651 | 6,789,194 | 6,789,191 | 6,644,642 | 6,502,614 | 6,622,999 |
| 6,669,385 | 6,549,935 | 6,987,573 | 6,727,996 | 6,591,884 | 6,439,706 | 6,760,119 |
| 7,295,332 | 6,290,349 | 6,428,155 | 6,785,016 | 6,870,966 | 6,822,639 | 6,737,591 |
| 7,055,739 | 7,233,320 | 6,830,196 | 6,832,717 | 6,957,768 | 09/575,172 | 7,170,499 |
| 7,106,888 | 7,123,239 | 10/727,181 | 10/727,162 | 7,377,608 | 7,399,043 | 7,121,639 |
| 7,165,824 | 7,152,942 | 10/727,157 | 7,181,572 | 7,096,137 | 7,302,592 | 7,278,034 |
| 7,188,282 | 10/727,159 | 10/727,180 | 10/727,179 | 10/727,192 | 10/727,274 | 10/727,164 |
| 10/727,161 | 10/727,198 | 10/727,158 | 10/754,536 | 10/754,938 | 10/727,160 | 10/934,720 |
| 7,171,323 | 7,278,697 | 11/442,131 | 7,360,131 | 11/488,853 | 7,328,115 | 11/749,750 |
| 11/749,749 | 11/955,127 | 11/951,213 | 12/050,941 | 12/043,844 | 12/047,315 | 7,369,270 |
| 6,795,215 | 7,070,098 | 7,154,638 | 6,805,419 | 6,859,289 | 6,977,751 | 6,398,332 |
| 6,394,573 | 6,622,923 | 6,747,760 | 6,921,144 | 10/884,881 | 7,092,112 | 7,192,106 |
| 11/039,866 | 7,173,739 | 6,986,560 | 7,008,033 | 11/148,237 | 7,222,780 | 7,270,391 |
| 7,150,510 | 11/478,599 | 7,388,689 | 7,407,247 | 7,398,916 | 12/062,455 | 12/062,481 |
| 12/138,359 | 12/145,473 | 7,374,266 | 7,427,117 | 10/854,488 | 7,281,330 | 10/854,503 |
| 7,328,956 | 10/854,509 | 7,188,928 | 7,093,989 | 7,377,609 | 10/854,495 | 10/854,498 |
| 10/854,511 | 7,390,071 | 10/854,525 | 10/854,526 | 10/854,516 | 7,252,353 | 10/854,515 |
| 7,267,417 | 10/854,505 | 10/854,493 | 7,275,805 | 7,314,261 | 10/854,490 | 7,281,777 |
| 7,290,852 | 10/854,528 | 10/854,523 | 10/854,527 | 10/854,524 | 10/854,520 | 10/854,514 |
| 10/854,519 | 10/854,513 | 10/854,499 | 10/854,501 | 7,266,661 | 7,243,193 | 10/854,518 |
| 10/854,517 | 10/934,628 | 7,163,345 | 7,322,666 | 11/601,757 | 7,434,910 | 11/735,881 |
| 11/748,483 | 11/749,123 | 11/766,061 | 11/775,135 | 11/772,235 | 11/778,569 | 11/829,942 |
| 11/870,342 | 11/935,274 | 11/937,239 | 11/961,907 | 11/961,940 | 11/961,961 | 12/055,314 |
| 12/139,496 | 12/164,108 | 12/202,308 | 12/234,690 | 10/760,254 | 7,425,050 | 7,364,263 |
| 7,201,468 | 7,360,868 | 10/760,249 | 7,234,802 | 7,303,255 | 7,287,846 | 7,156,511 |
| 10/760,264 | 7,258,432 | 7,097,291 | 10/760,222 | 10/760,248 | 7,083,273 | 7,367,647 |
| 7,374,355 | 10/760,204 | 10/760,205 | 10/760,206 | 10/760,267 | 10/760,270 | 7,198,352 |
| 7,364,264 | 7,303,251 | 7,201,470 | 7,121,655 | 7,293,861 | 7,232,208 | 7,328,985 |
| 7,344,232 | 7,083,272 | 7,261,400 | 11/474,272 | 7,431,441 | 7,311,387 | 11/583,874 |

-continued

| | | | | | | |
|---|---|---|---|---|---|---|
| 7,303,258 | 11/706,322 | 11/706,968 | 11/749,119 | 11/749,157 | 11/779,848 | 11/782,590 |
| 11/855,152 | 11/855,151 | 11/870,327 | 11/934,780 | 11/935,992 | 11/951,193 | 12/017,327 |
| 12/015,273 | 12/036,882 | 12/050,164 | 12/050,166 | 12/062,502 | 12/103,710 | 12/186,489 |
| 12/200,931 | 12/205,890 | 12/234,695 | 11/014,764 | 11/014,763 | 7,331,663 | 7,360,861 |
| 7,328,973 | 7,427,121 | 7,407,262 | 7,303,252 | 7,249,822 | 11/014,762 | 7,311,382 |
| 7,360,860 | 7,364,257 | 7,390,075 | 7,350,896 | 7,429,096 | 7,384,135 | 7,331,660 |
| 7,416,287 | 11/014,737 | 7,322,684 | 7,322,685 | 7,311,381 | 7,270,405 | 7,303,268 |
| 11/014,735 | 7,399,072 | 7,393,076 | 11/014,750 | 11/014,749 | 7,249,833 | 11/758,640 |
| 11/775,143 | 11/838,877 | 11/944,453 | 11/944,633 | 11/955,065 | 12/003,875 | 12/003,952 |
| 12/007,818 | 12/007,817 | 12/068,679 | 12/071,187 | 12/076,666 | 12/076,665 | 12/076,664 |
| 12/079,897 | 12/122,712 | 12/138,418 | 12/138,420 | 12/138,424 | 12/123,371 | 12/123,394 |
| 12/123,403 | 12/170,431 | 12/177,864 | 12/177,866 | 12/177,868 | 12/177,871 | 12/190,561 |
| 11/014,769 | 11/014,729 | 7,331,661 | 11/014,733 | 7,300,140 | 7,357,492 | 7,357,493 |
| 11/014,766 | 7,380,902 | 7,284,816 | 7,284,845 | 7,255,430 | 7,390,080 | 7,328,984 |
| 7,350,913 | 7,322,671 | 7,380,910 | 7,431,424 | 11/014,716 | 11/014,732 | 7,347,534 |
| 11/097,268 | 11/097,185 | 7,367,650 | 11/778,567 | 11/852,958 | 11/852,907 | 11/872,038 |
| 11/955,093 | 11/961,578 | 12/022,023 | 12/023,000 | 12/023,018 | 12/031,582 | 12/043,708 |
| 12/101,150 | 12/121,792 | 12/122,711 | 12/138,417 | 12/194,536 | 12/206,740 | 11/293,820 |
| 11/293,813 | 11/293,822 | 11/293,812 | 7,357,496 | 11/293,814 | 7,431,440 | 7,431,443 |
| 11/293,811 | 11/293,807 | 11/293,806 | 11/293,805 | 11/293,810 | 12/050,021 | 12/145,505 |
| 12/199,687 | 12/194,539 | 12/233,589 | 11/688,863 | 11/688,864 | 11/688,865 | 7,364,265 |
| 11/688,867 | 11/688,868 | 11/688,869 | 11/688,871 | 11/688,872 | 11/688,873 | 11/741,766 |
| 12/014,767 | 12/014,768 | 12/014,769 | 12/014,770 | 12/014,771 | 12/014,772 | 12/014,773 |
| 12/014,774 | 12/014,775 | 12/014,776 | 12/014,777 | 12/014,778 | 12/014,779 | 12/014,780 |
| 12/014,781 | 12/014,782 | 12/014,783 | 12/014,784 | 12/014,785 | 12/014,787 | 12/014,788 |
| 12/014,789 | 12/014,790 | 12/014,791 | 12/014,792 | 12/014,793 | 12/014,794 | 12/014,796 |
| 12/014,798 | 12/014,801 | 12/014,803 | 12/014,804 | 12/014,805 | 12/014,806 | 12/014,807 |
| 12/049,371 | 12/049,372 | 12/049,373 | 12/049,374 | 12/049,375 | 12/103,674 | 12/146,399 |

The disclosures of these applications and patents are incorporated herein by reference.

BACKGROUND OF THE INVENTION

Some micro-mechanical systems (MEMS) devices process, or use liquids to operate. In one class of these liquid-containing devices, resistive heaters are used to heat the liquid to the liquid's superheat limit, resulting in the formation of a rapidly expanding vapor bubble. The impulse provided by the bubble expansion can be used as a mechanism for moving liquid through the device. This is the case in thermal inkjet printheads where each nozzle has a heater that generates a bubble to eject a drop of ink onto the print media. In light of the widespread use of inkjet printers, the present invention will be described with particular reference to its use in this application. However, it will be appreciated that the invention is not limited to inkjet printheads and is equally suited to other devices in which vapor bubbles formed by resistive heaters are used to move liquid through the device (e.g. some 'Lab-on-a-chip' devices).

The resistive heaters in inkjet printheads operate in an extremely harsh environment. They must heat and cool in rapid succession to form bubbles in the ejectable liquid—usually a water soluble ink with a superheat limit of approximately 300° C. Under these conditions of cyclic stress, in the presence of hot ink, water vapor, dissolved oxygen and possibly other corrosive species, the heaters will increase in resistance and ultimately go open circuit via a combination of oxidation and fatigue, accelerated by mechanisms that corrode the heater or its protective oxide layers (chemical corrosion and cavitation corrosion).

To protect against the effects of oxidation, corrosion and cavitation on the heater material, inkjet manufacturers use stacked protective layers, typically made from $Si_3N_4$, SiC and Ta. In certain prior art devices, the protective layers are relatively thick. U.S. Pat. No. 6,786,575 to Anderson et al (assigned to Lexmark) for example, has 0.7 μm of protective layers for a ~0.1 μm thick heater. To form a vapor bubble in the bubble forming liquid, the surface of the protective layers in contact with the bubble forming liquid must be heated to the superheat limit of the liquid (~300° C. for water). This requires that the entire thickness of the protective layers be heated to (or in some cases above) the liquid superheat limit. Heating this additional volume decreases the efficiency of the device and significantly increases the level of residual heat present after firing. If this additional heat cannot be removed between successive firings of the nozzle, the ink in the nozzles will boil continuously, causing the nozzles to cease ejecting droplets in the intended manner.

The primary cooling mechanism of printheads on the market is currently thermal conduction, with existing printheads implementing a large heat sink to dissipate heat absorbed from the printhead chip. The ability of this heatsink to cool the liquid in the nozzles is limited by the thermal resistance between the nozzles and the heatsink and by the heat flux generated by the firing nozzles. As the extra energy required to heat the protective layers of a coated heater contributes to an increased heat flux, more severe constraints are imposed on the density of the nozzles on the printhead and the nozzle firing rate. This in turn has an impact on the print resolution, the printhead size, the print speed and the manufacturing costs.

SUMMARY OF THE INVENTION

Accordingly the present invention provides an inkjet printhead for ejecting drops of liquid on to a media substrate, the inkjet printhead comprising:

a chamber for holding liquid;

a nozzle in fluid communication with the chamber;

a heater positioned in the chamber for thermal contact with the liquid such that resistive heating of the heater generates a vapour bubble that ejects a drop of the liquid through the nozzle; wherein, the heater is formed from a TiAlX alloy where Ti contributes more than 40% by weight, Al contributes more than 40% by weight and X contributes less than 5% by weight and comprises zero or more of Ag, Cr, Mo, Nb, Si, Ta and W.

Titanium aluminium (TiAl) alloys exhibit superior strength, low creep and light weight; properties which have seen these alloys widely used in the aeronautical and automotive industries. However, the Applicant's work has revealed that TiAl is also well suited to use as a heater material in inkjet printheads. The alloy can provide surface oxide that is a uniform, thin and dense coating of predominantly $Al_2O_3$, which has very low oxygen diffusivity. Accordingly, the native (i.e. naturally forming) oxide layer passivates the heater to guard against oxidative failure while remaining thin enough not thermally insulate the heater from the ink. This preserves the low energy ejection of drops that is necessary for large (pagewidth), high density nozzle arrays, without compromising the operational life of the heater.

Further improvement in oxidation resistance can be obtained with additive element X, which has been found to enhance the diffusivity of aluminium, thereby encouraging the formation of $Al_2O_3$ whilst suppressing the formation of $TiO_2$. $TiO_2$ has much higher oxygen diffusivity than $Al_2O_3$, so suppressing its formation relative to $Al_2O_3$ provides improved oxidation resistance.

Optionally X is W, or X includes W which contributes between 1.7% and 4.5% by weight.

Optionally Ti contributes more than 48% by weight, Al contributes more than 48% by weight and X is 0% by weight.

Optionally the TiAl component of the heater has a gamma phase structure.

Optionally the heater has a microstructure with a grain size less than 100 nanometers.

Optionally the TiAlX alloy forms an $Al_2O_3$ surface oxide which directly contacts the liquid during use.

Optionally the TiAlX alloy is deposited as a layer less than 2 microns thick. Preferably the layer is less than 0.5 microns thick.

Optionally the heater further comprises a protective coating, the protective coating having a total thickness less than 0.5 microns. Optionally the protective coating is a single layer of material. Optionally the protective coating is at least partially formed from a silicon oxide, nitride or carbide.

In a second aspect the present invention provides a MEMS device for generating a bubble, the MEMS device comprising:

a chamber for holding liquid;

a heater positioned in the chamber for thermal contact with the liquid; wherein, the heater has a microstructure with a grain size less than 100 nanometers and configured to received an actuation signal from associated drive circuitry such that upon actuation the heater heats some of the liquid to a temperature above its boiling point in order to generate a vapor bubble that causes a pressure pulse through the liquid.

A grain size less than 100 nm (a "nanocrystalline" microstructure) is beneficial in that it provides good material strength yet has a high density of grain boundaries. Compared to a material with much larger crystals and a lower density of grain boundaries, the nanocrystalline structure provides higher diffusivity for the protective scale forming elements Cr and Al (more rapid formation of the scale) and a more even growth of the scale over the heater surface, so the protection is provided more rapidly and more effectively. The protective scales adhere better to the nanocrystalline structure, which results in reduced spalling. Further improvement in the mechanical stability and adherence of the scale is possible using additives of reactive metal from the group consisting of yttrium, lanthanum and other rare earth elements.

The primary advantage of an oxide scale that passivates the heater is it removes the need for additional protective coatings. This improves efficiency as there is no energy wasted in heating the coatings. As a result, the input energy required to form a bubble with a particular impulse is reduced, lowering the level of residual heat in the printhead. The majority of the remaining heat can be removed via the ejected drops, a mode of operation known as "self cooling". The primary advantage of this mode of operation is that the design is not reliant on conductive cooling, so a heatsink is not required and the nozzle density and firing rate constraints imposed by conductive cooling are removed, allowing increased print resolution and speed and reduced printhead size and cost.

Optionally, the chamber has a nozzle opening such that the pressure pulse ejects a drop of the liquid through the nozzle opening.

Optionally the chamber has an inlet for fluid communication with a supply of the liquid such that liquid from the supply flows into the chamber to replace the drop of liquid ejected through the nozzle opening.

Optionally the heater is deposited by a super alloy deposited by a sputtering process.

Optionally the heater element is deposited as a layer of the superalloy less than 2 microns thick.

Optionally the superalloy has a Cr content between 2% by weight and 35% by weight.

Optionally the superalloy has a Al content of between 0.1% by weight and 8.0% by weight.

Optionally the superalloy has a Mo content of between 1% by weight and 17.0% by weight Optionally the superalloy has a Nb and/or Ta content totalling between 0.25% by weight and 8.0% by weight.

Optionally the superalloy has a Ti content of between 0.1% by weight and 5.0% by weight.

Optionally the superalloy has up to 5% by weight of reactive metal from the group consisting of yttrium, lanthanum and other rare earth elements Optionally the superalloy has a Fe content of up to 60% by weight.

Optionally the superalloy has a Ni content of between 25% by weight and 70% by weight.

Optionally the superalloy has a Co content of between 35% by weight and 65% by weight.

Optionally the superalloy is MCrAlX, where M is one or more of Ni, Co, Fe with M contributing at least 50% by weight, Cr contributing between 8% and 35% by weight, Al contributing more than zero but less than 8% by weight, and X contributing less than 25% by weight, with X consisting of zero or more other elements, preferably including but not limited to Mo, Re, Ru, Ti, Ta, V, W, Nb, Zr, B, C, Si, Y, Hf.

Optionally the superalloy comprises Ni, Fe, Cr and Al together with additives consisting of zero or more other elements, preferably including but not limited to Mo, Re, Ru, Ti, Ta, V, W, Nb, Zr, B, C, Si, Y, or Hf.

Optionally the superalloy is selected from:

INCONEL™ Alloy 600, Alloy 601, Alloy 617, Alloy 625, Alloy 625LCF, Alloy 690, Alloy 693, Alloy 718, Alloy 783, Alloy X-750, Alloy 725, Alloy 751, Alloy MA754, Alloy MA758, Alloy 925, or Alloy HX;

INCOLOY™ Alloy 330, Alloy 800, Alloy 800H, Alloy 800HT, Alloy MA956, Alloy A-286, or Alloy DS;

NIMONIC™ Alloy 75, Alloy 80A, or Alloy 90;

BRIGHTRAY® Alloy B, Alloy C, Alloy F, Alloy S, or Alloy 35; or,

FERRY® Alloy or Thermo-Span® Alloy

BRIEF DESCRIPTION OF THE DRAWINGS

Preferred embodiments of the present invention will now be described, by way of example only with reference to the accompanying drawings in which.

DETAILED DESCRIPTION

Figure 1:
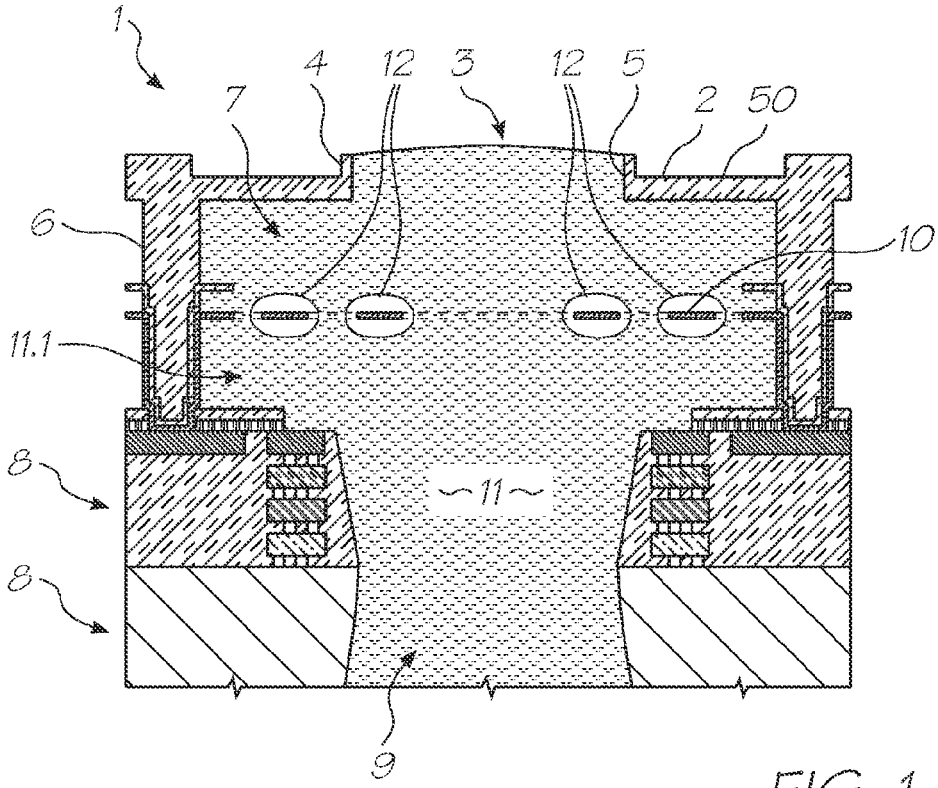
FIG. 1 is a schematic cross-sectional view through an ink chamber of a unit cell of a printhead with a suspended heater element at a particular stage during its operative cycle.

In the description that follows, corresponding reference numerals, or corresponding prefixes of reference numerals (i.e. the parts of the reference numerals appearing before a point mark) which are used in different figures relate to corresponding parts. Where there are corresponding prefixes and differing suffixes to the reference numerals, these indicate different specific embodiments of corresponding parts.

Overview of the Invention and General Discussion of Operation

With reference to FIGS. 1 to 4, the unit cell 1 of a printhead according to an embodiment of the invention comprises a nozzle plate 2 with nozzles 3 therein, the nozzles having nozzle rims 4, and apertures 5 extending through the nozzle plate. The nozzle plate 2 is plasma etched from a silicon nitride structure which is deposited, by way of chemical vapor deposition (CVD), over a sacrificial material which is subsequently etched.

The printhead also includes, with respect to each nozzle 3, side walls 6 on which the nozzle plate is supported, a chamber 7 defined by the walls and the nozzle plate 2, a multi-layer substrate 8 and an inlet passage 9 extending through the multi-layer substrate to the far side (not shown) of the substrate. A looped, elongate heater element 10 is suspended within the chamber 7, so that the element is in the form of a suspended beam. The printhead as shown is a microelectromechanical system (MEMS) structure, which is formed by a lithographic process which is described in more detail below.

When the printhead is in use, ink 11 from a reservoir (not shown) enters the chamber 7 via the inlet passage 9, so that the chamber fills to the level as shown in FIG. 1. Thereafter, the heater element 10 is heated for somewhat less than 1 microsecond (μs), so that the heating is in the form of a thermal pulse. It will be appreciated that the heater element 10 is in thermal contact with the ink 11 in the chamber 7 so that when the element is heated, this causes the generation of vapor bubbles 12 in the ink. Accordingly, the ink 11 constitutes a bubble forming liquid. FIG. 1 shows the formation of a bubble 12 approximately 1 μs after generation of the thermal pulse, that is, when the bubble has just nucleated on the heater elements 10. It will be appreciated that, as the heat is applied in the form of a pulse, all the energy necessary to generate the bubble 12 is to be supplied within that short time.

Figure 34:
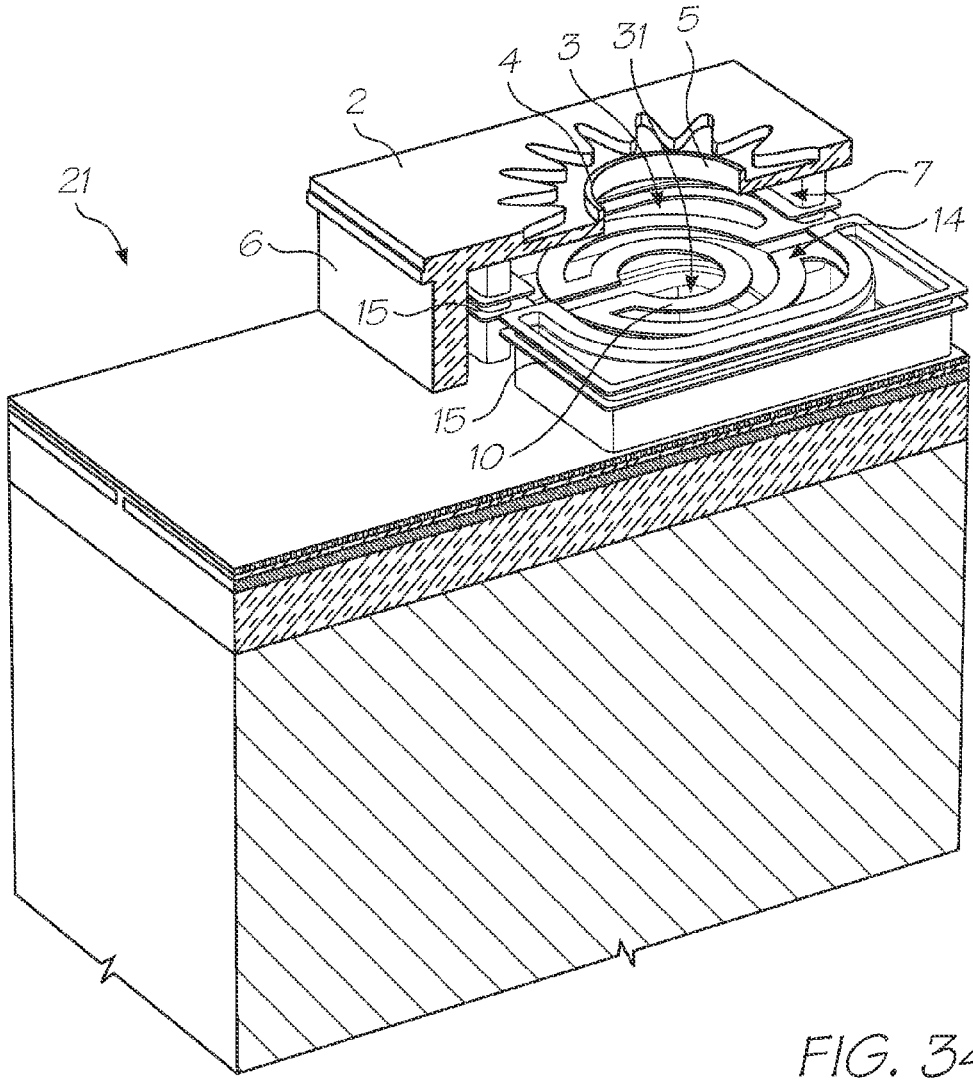
Figure 35:
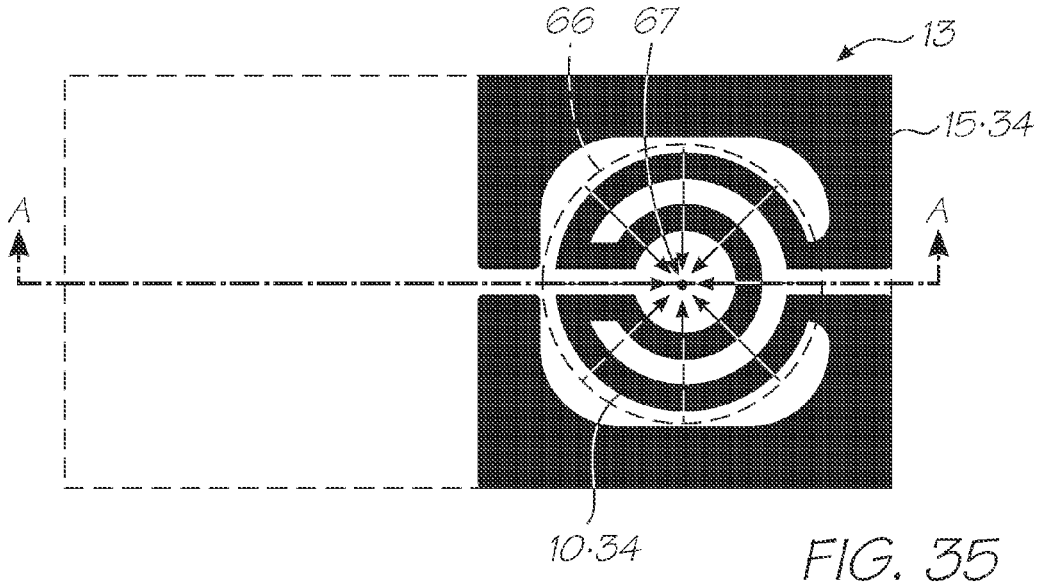

Turning briefly to FIG. 35, there is shown a mask 13 for forming a heater 14 (as shown in FIG. 34) of the printhead (which heater includes the element 10 referred to above), during a lithographic process, as described in more detail below. As the mask 13 is used to form the heater 14, the shapes of several of its parts correspond to the shape of the element 10. The mask 13 therefore provides a useful reference by which to identify various parts of the heater 14. The heater 14 has electrodes 15 corresponding to the parts designated 15.34 of the mask 13 and a heater element 10 corresponding to the parts designated 10.34 of the mask. In operation, voltage is applied across the electrodes 15 to cause current to flow through the element 10. The electrodes 15 are much thicker than the element 10 so that most of the electrical resistance is provided by the element. Thus, nearly all of the power consumed in operating the heater 14 is dissipated via the element 10, in creating the thermal pulse referred to above.

When the element 10 is heated as described above, the bubble 12 forms along the length of the element, this bubble appearing, in the cross-sectional view of FIG. 1, as four bubble portions, one for each of the element portions shown in cross section.

The bubble 12, once generated, causes an increase in pressure within the chamber 7, which in turn causes the ejection of a drop 16 of the ink 11 through the nozzle 3. The rim 4 assists in directing the drop 16 as it is ejected, so as to minimize the chance of drop misdirection.

The reason that there is only one nozzle 3 and chamber 7 per inlet passage 9 is so that the pressure wave generated within the chamber, on heating of the element 10 and forming of a bubble 12, does not affect adjacent chambers and their corresponding nozzles. However, it is possible to feed ink to several chambers via a single inlet passage as long as pressure pulse diffusing structures are positioned between chambers. The embodiment shown in FIGS. 37 to 70 incorporates these structures for the purpose of reducing cross talk to an acceptable level.

The advantages of the heater element 10 being suspended rather than embedded in any solid material, are discussed below. However, there are also advantages to bonding the heater element to the internal surfaces of the chamber. These are discussed below with reference to FIGS. 6 to 9.

Figure 2:
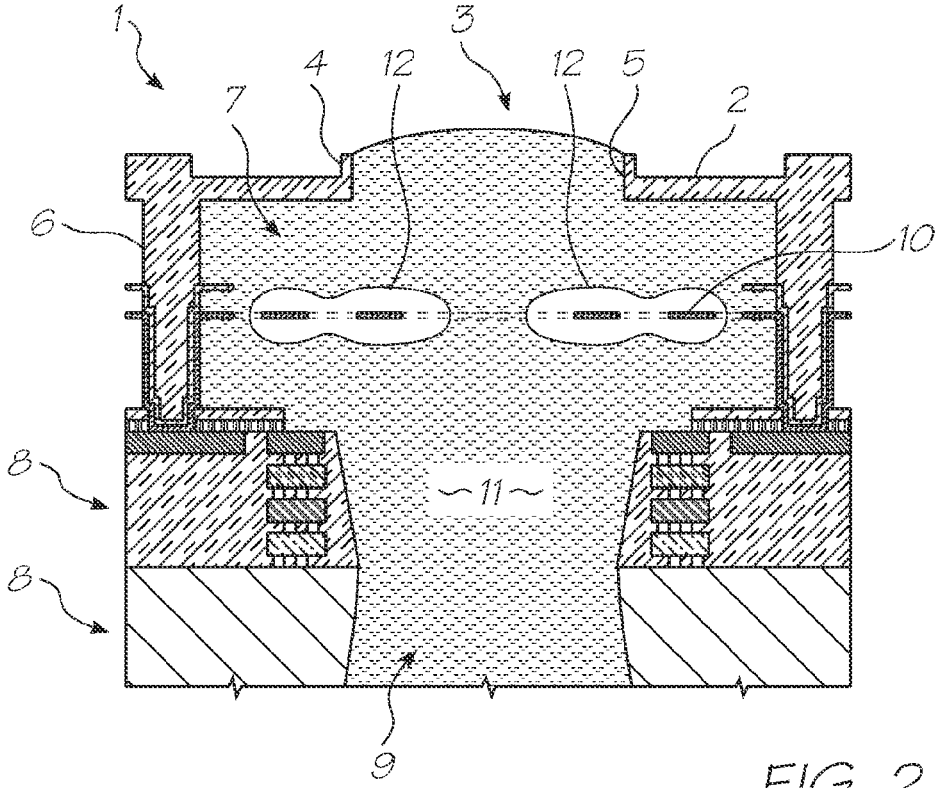
FIG. 2 is a schematic cross-sectional view through the ink chamber FIG. 1, at another stage of operation.
Figure 3:
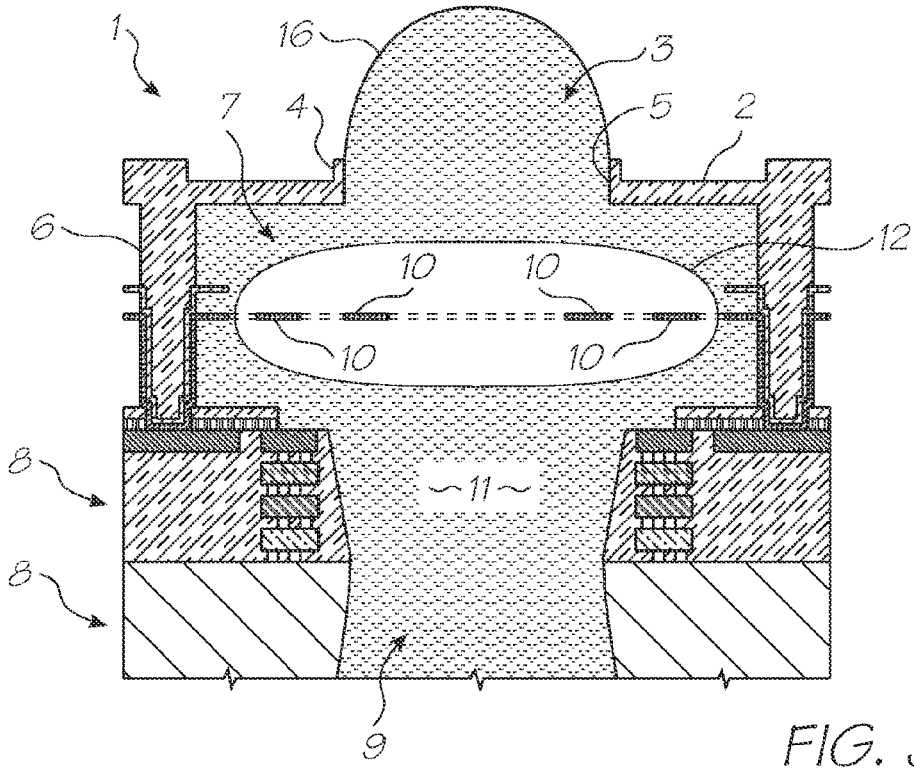
FIG. 3 is a schematic cross-sectional view through the ink chamber FIG. 1, at yet another stage of operation.

FIGS. 2 and 3 show the unit cell 1 at two successive later stages of operation of the printhead. It can be seen that the bubble 12 generates further, and hence grows, with the resultant advancement of ink 11 through the nozzle 3. The shape of the bubble 12 as it grows, as shown in FIG. 3, is determined by a combination of the inertial dynamics and the surface tension of the ink 11. The surface tension tends to minimize the surface area of the bubble 12 so that, by the time a certain amount of liquid has evaporated, the bubble is essentially disk-shaped.

The increase in pressure within the chamber 7 not only pushes ink 11 out through the nozzle 3, but also pushes some ink back through the inlet passage 9. However, the inlet passage 9 is approximately 200 to 300 microns in length, and is only about 16 microns in diameter. Hence there is a substantial inertia and viscous drag limiting back flow. As a result, the predominant effect of the pressure rise in the chamber 7 is to force ink out through the nozzle 3 as an ejected drop 16, rather than back through the inlet passage 9.

Figure 4:
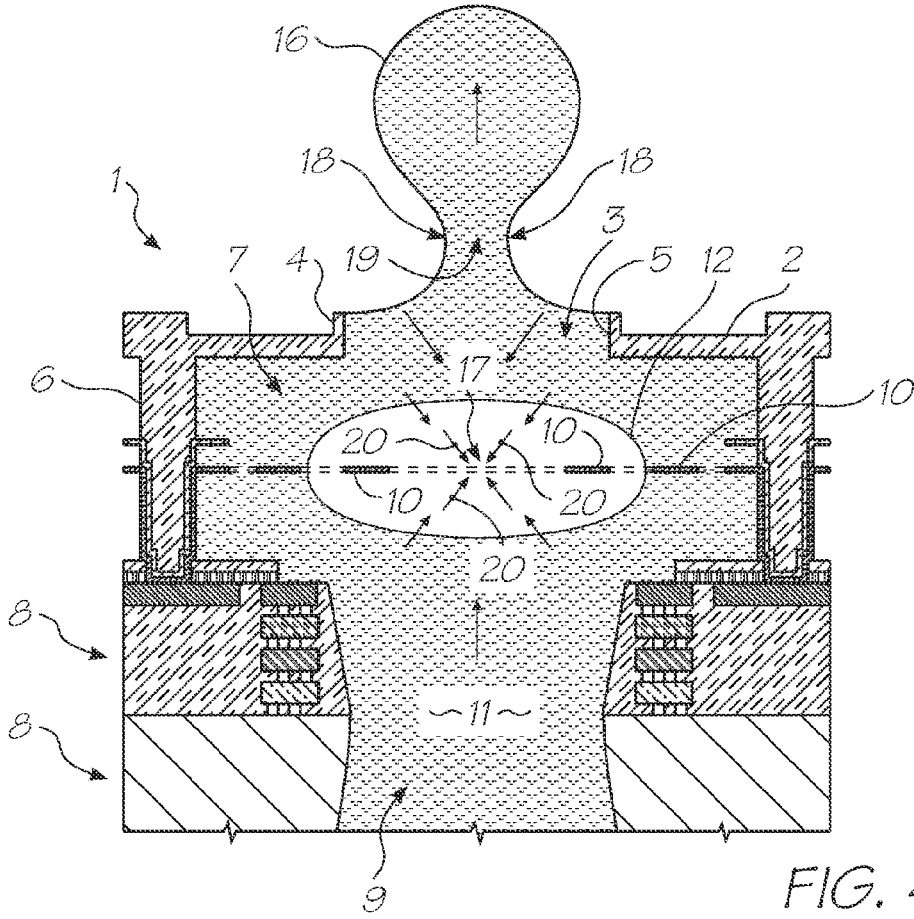
FIG. 4 is a schematic cross-sectional view through the ink chamber FIG. 1, at yet a further stage of operation.

Turning now to FIG. 4, the printhead is shown at a still further successive stage of operation, in which the ink drop 16 that is being ejected is shown during its "necking phase" before the drop breaks off. At this stage, the bubble 12 has already reached its maximum size and has then begun to collapse towards the point of collapse 17, as reflected in more detail in FIG. 5.

The collapsing of the bubble 12 towards the point of collapse 17 causes some ink 11 to be drawn from within the nozzle 3 (from the sides 18 of the drop), and some to be drawn from the inlet passage 9, towards the point of collapse. Most of the ink 11 drawn in this manner is drawn from the nozzle 3, forming an annular neck 19 at the base of the drop 16 prior to its breaking off.

The drop 16 requires a certain amount of momentum to overcome surface tension forces, in order to break off. As ink 11 is drawn from the nozzle 3 by the collapse of the bubble 12, the diameter of the neck 19 reduces thereby reducing the amount of total surface tension holding the drop, so that the momentum of the drop as it is ejected out of the nozzle is sufficient to allow the drop to break off.

When the drop 16 breaks off, cavitation forces are caused as reflected by the arrows 20, as the bubble 12 collapses to the point of collapse 17. It will be noted that there are no solid surfaces in the vicinity of the point of collapse 17 on which the cavitation can have an effect.

Manufacturing Process for Suspended Heater Element Embodiments.

Relevant parts of the manufacturing process of a printhead according to embodiments of the invention are now described with reference to FIGS. 10 to 33.

Figure 10:
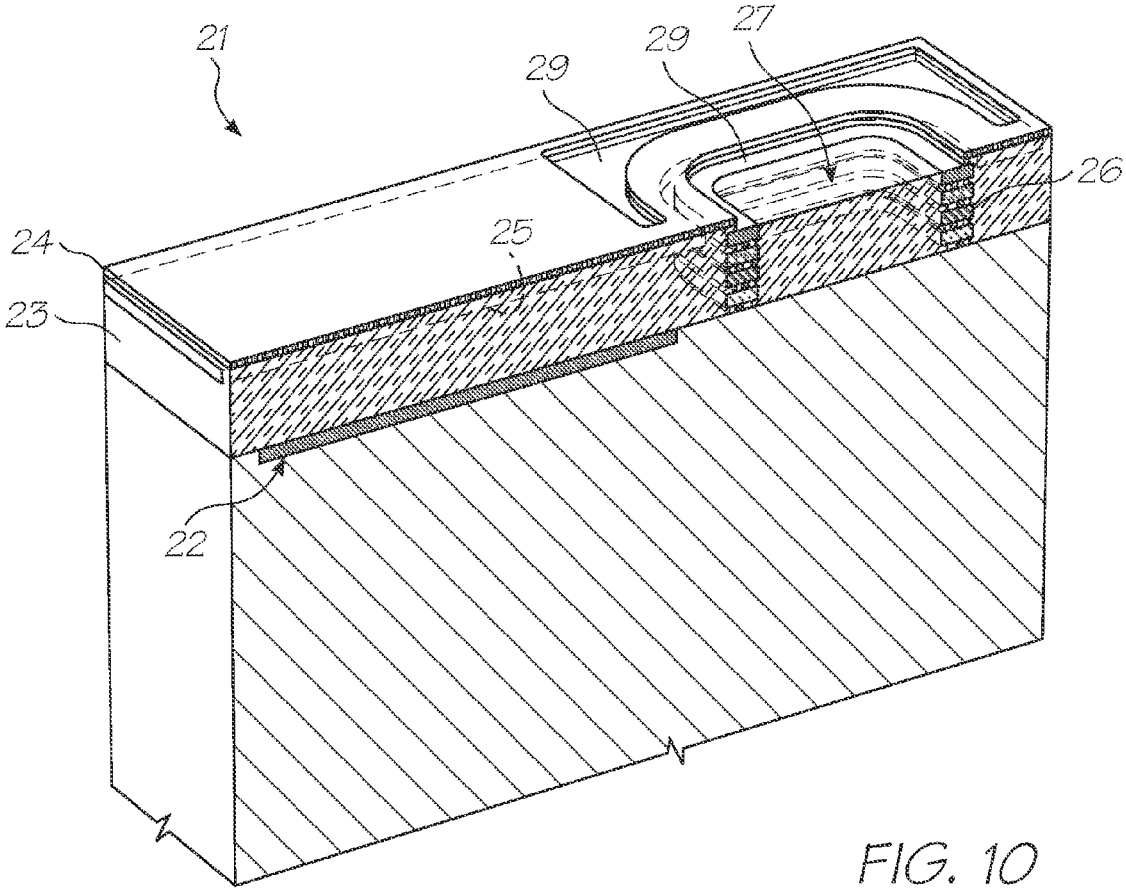
FIGS. 10, 12, 14, 15, 17, 18, 20, 22, 23, 25, 27, 28, 30, 32, 34 and 36 are schematic perspective views of a unit cell of a printhead in accordance with a suspended heater embodiment of the invention, at various successive stages in the production process of the printhead.
Figure 11:
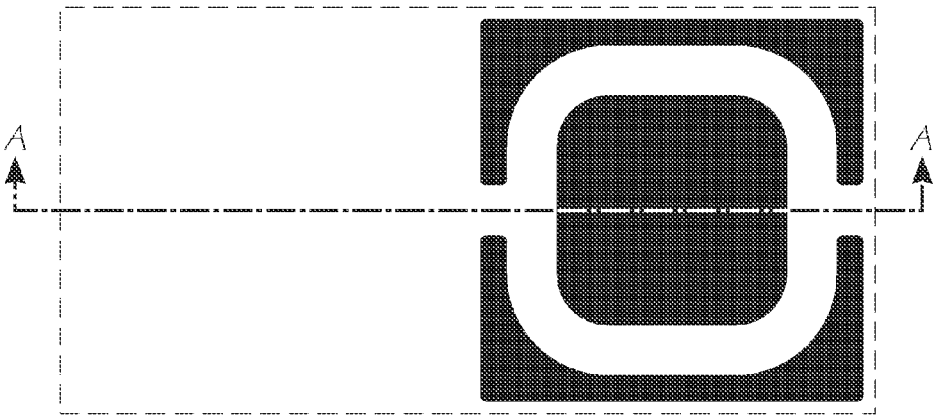
FIGS. 11, 13, 16, 19, 21, 24, 26, 29, 31, 33 and 35 are each schematic plan views of a mask suitable for use in performing the production stage for the printhead, as represented in the respective immediately preceding figures.

Referring to FIG. 10, there is shown a cross-section through a silicon substrate portion 21, being a portion of a Memjet™ printhead, at an intermediate stage in the production process thereof. This figure relates to that portion of the printhead corresponding to a unit cell 1. The description of the manufacturing process that follows will be in relation to a unit cell 1, although it will be appreciated that the process will be applied to a multitude of adjacent unit cells of which the whole printhead is composed.

FIG. 10 represents the next successive step, during the manufacturing process, after the completion of a standard CMOS fabrication process, including the fabrication of CMOS drive transistors (not shown) in the region 22 in the substrate portion 21, and the completion of standard CMOS interconnect layers 23 and passivation layer 24. Wiring indicated by the dashed lines 25 electrically interconnects the transistors and other drive circuitry (also not shown) and the heater element corresponding to the nozzle.

Guard rings 26 are formed in the metallization of the interconnect layers 23 to prevent ink 11 from diffusing from the region, designated 27, where the nozzle of the unit cell 1 will be formed, through the substrate portion 21 to the region containing the wiring 25, and corroding the CMOS circuitry disposed in the region designated 22.

The first stage after the completion of the CMOS fabrication process consists of etching a portion of the passivation layer 24 to form the passivation recesses 29.

Figure 12:
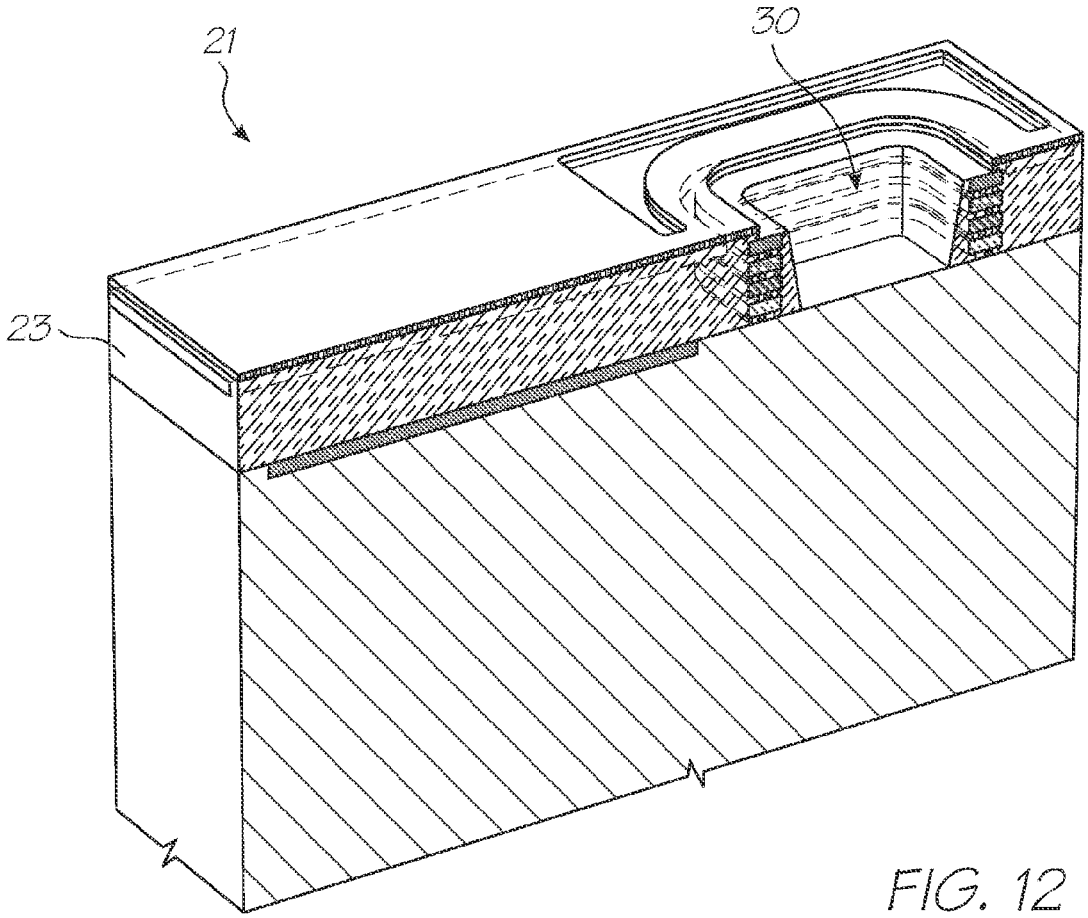
Figure 13:
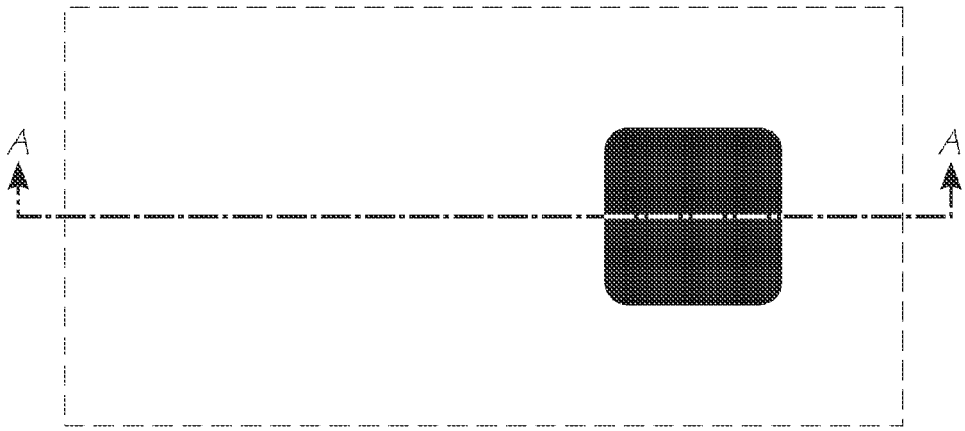

FIG. 12 shows the stage of production after the etching of the interconnect layers 23, to form an opening 30. The opening 30 is to constitute the ink inlet passage to the chamber that will be formed later in the process.

Figure 14:
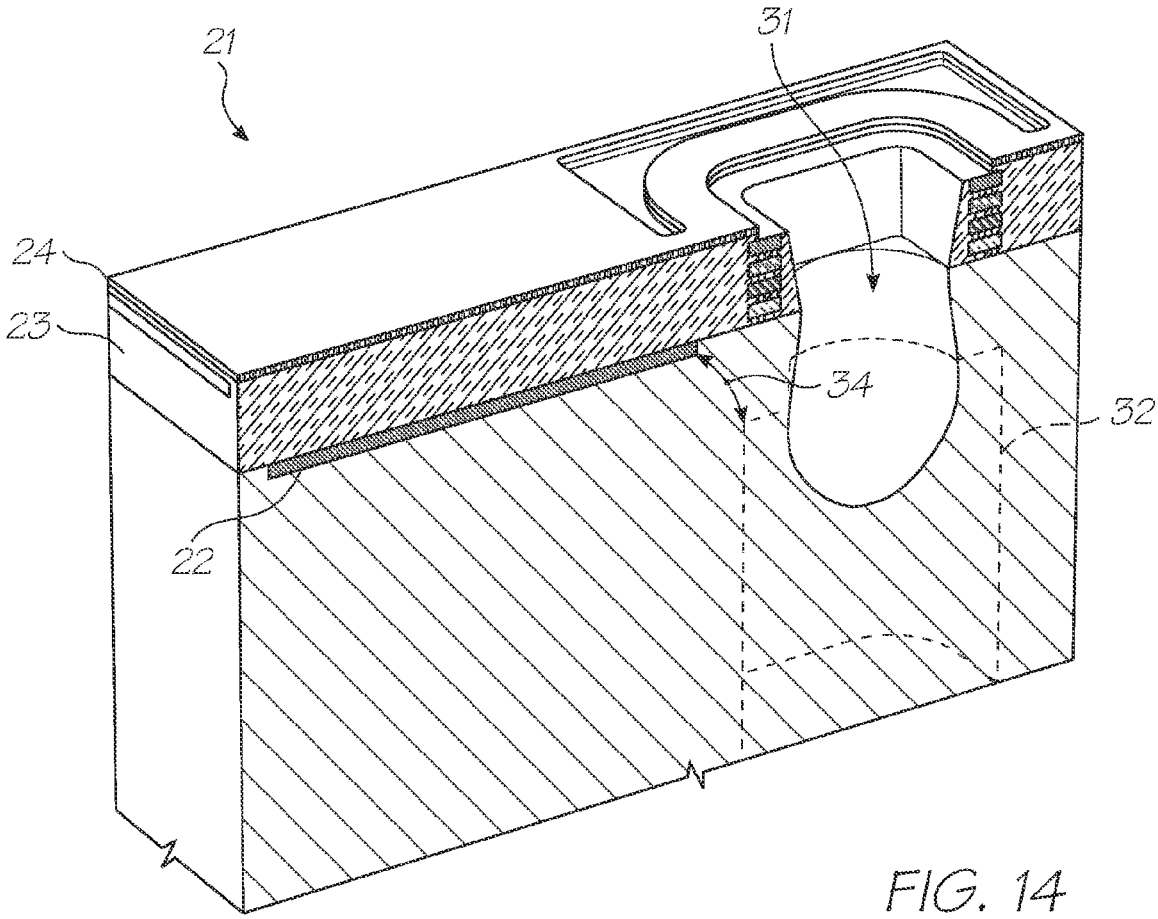

FIG. 14 shows the stage of production after the etching of a hole 31 in the substrate portion 21 at a position where the nozzle 3 is to be formed. Later in the production process, a further hole (indicated by the dashed line 32) will be etched from the other side (not shown) of the substrate portion 21 to join up with the hole 31, to complete the inlet passage to the chamber. Thus, the hole 32 will not have to be etched all the way from the other side of the substrate portion 21 to the level of the interconnect layers 23.

If, instead, the hole 32 were to be etched all the way to the interconnect layers 23, then to avoid the hole 32 being etched so as to destroy the transistors in the region 22, the hole 32 would have to be etched a greater distance away from that region so as to leave a suitable margin (indicated by the arrow 34) for etching inaccuracies. But the etching of the hole 31 from the top of the substrate portion 21, and the resultant shortened depth of the hole 32, means that a lesser margin 34 need be left, and that a substantially higher packing density of nozzles can thus be achieved.

Figure 15:
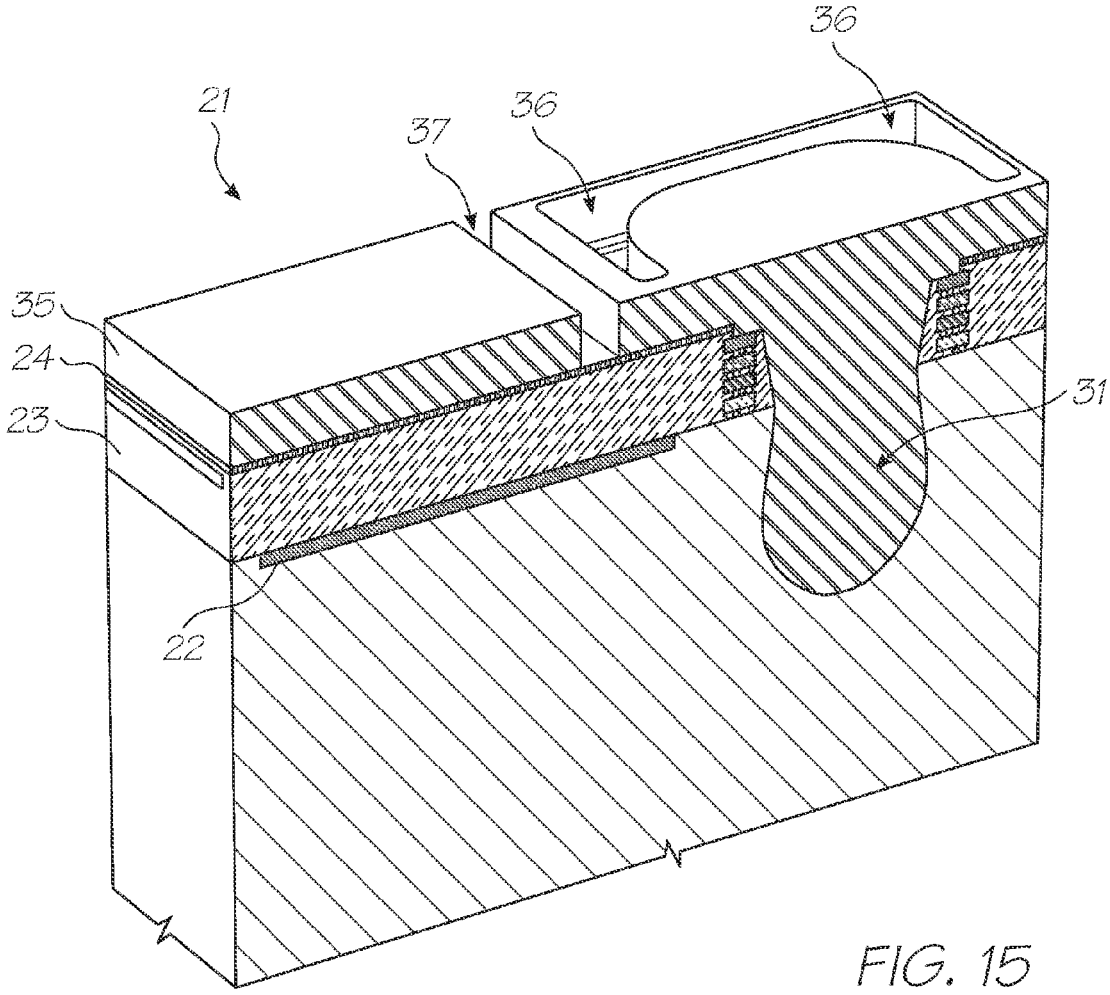
Figure 16:
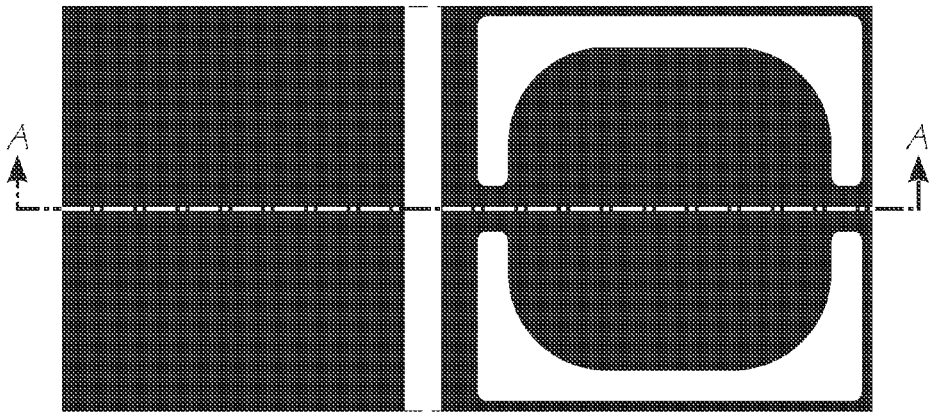
Figure 17:
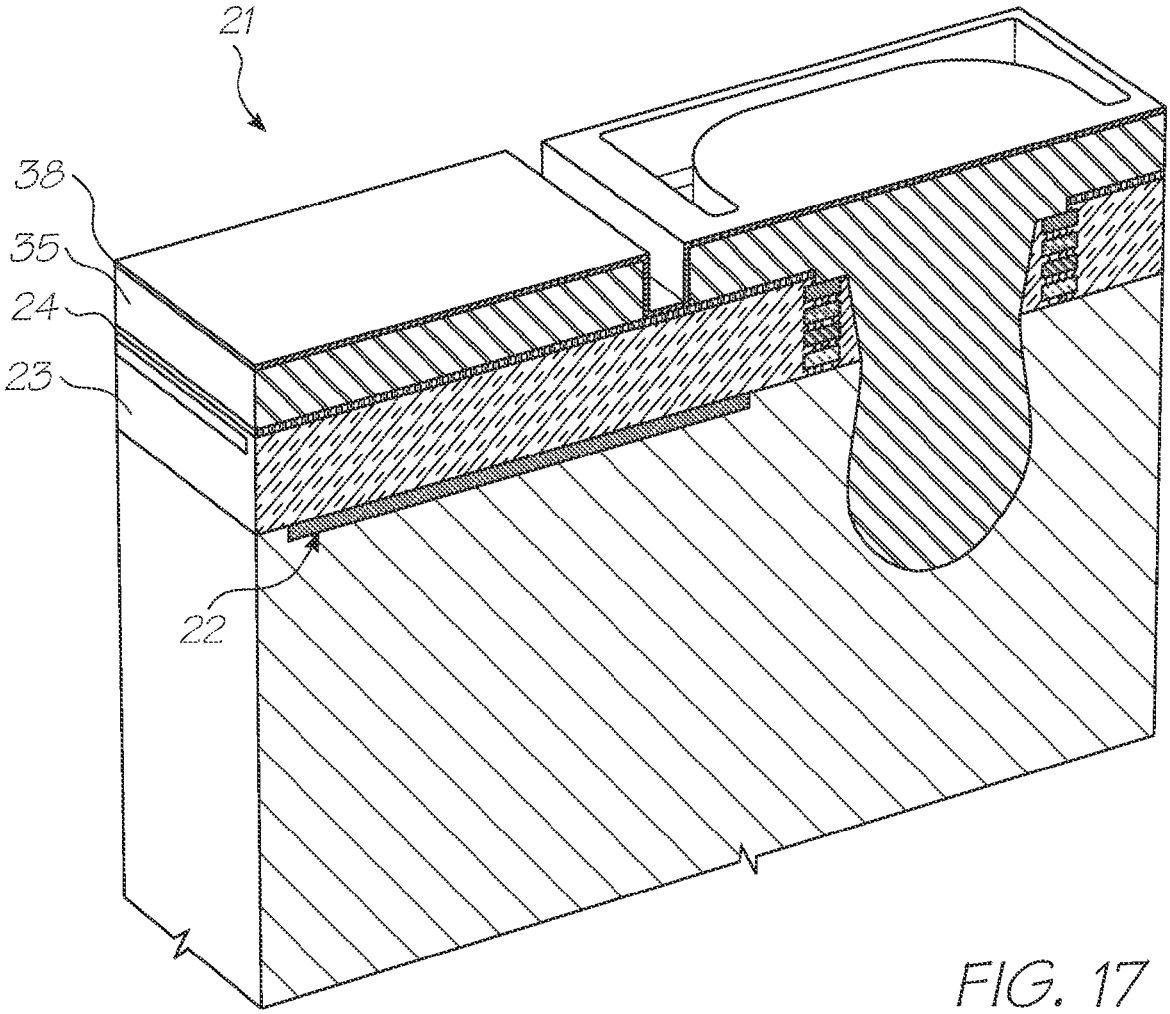

FIG. 15 shows the stage of production after a four micron thick layer 35 of a sacrificial resist has been deposited on the layer 24. This layer 35 fills the hole 31 and now forms part of the structure of the printhead. The resist layer 35 is then exposed with certain patterns (as represented by the mask shown in FIG. 16) to form recesses 36 and a slot 37. This provides for the formation of contacts for the electrodes 15 of the heater element to be formed later in the production process. The slot 37 will provide, later in the process, for the formation of the nozzle walls 6 that will define part of the chamber 7.

Figure 21:
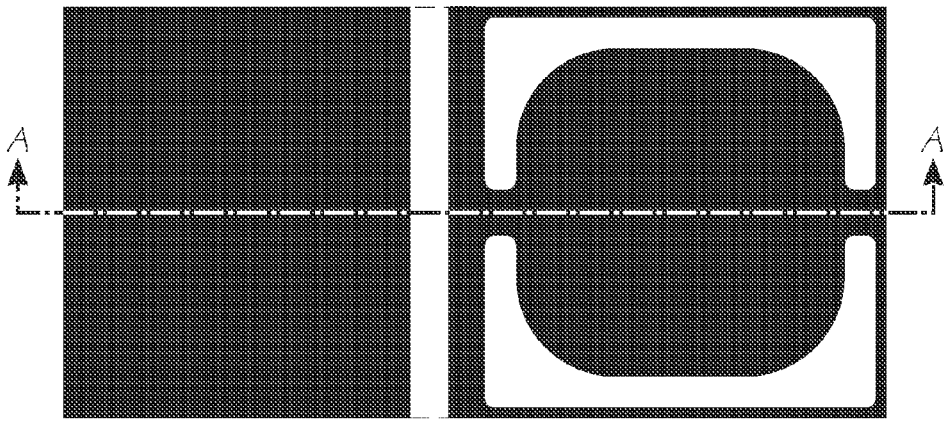

FIG. 21 shows the stage of production after the deposition, on the layer 35, of a 0.5 micron thick layer 38 of heater material, which, in the present embodiment, is of titanium aluminium nitride.

Figure 18:
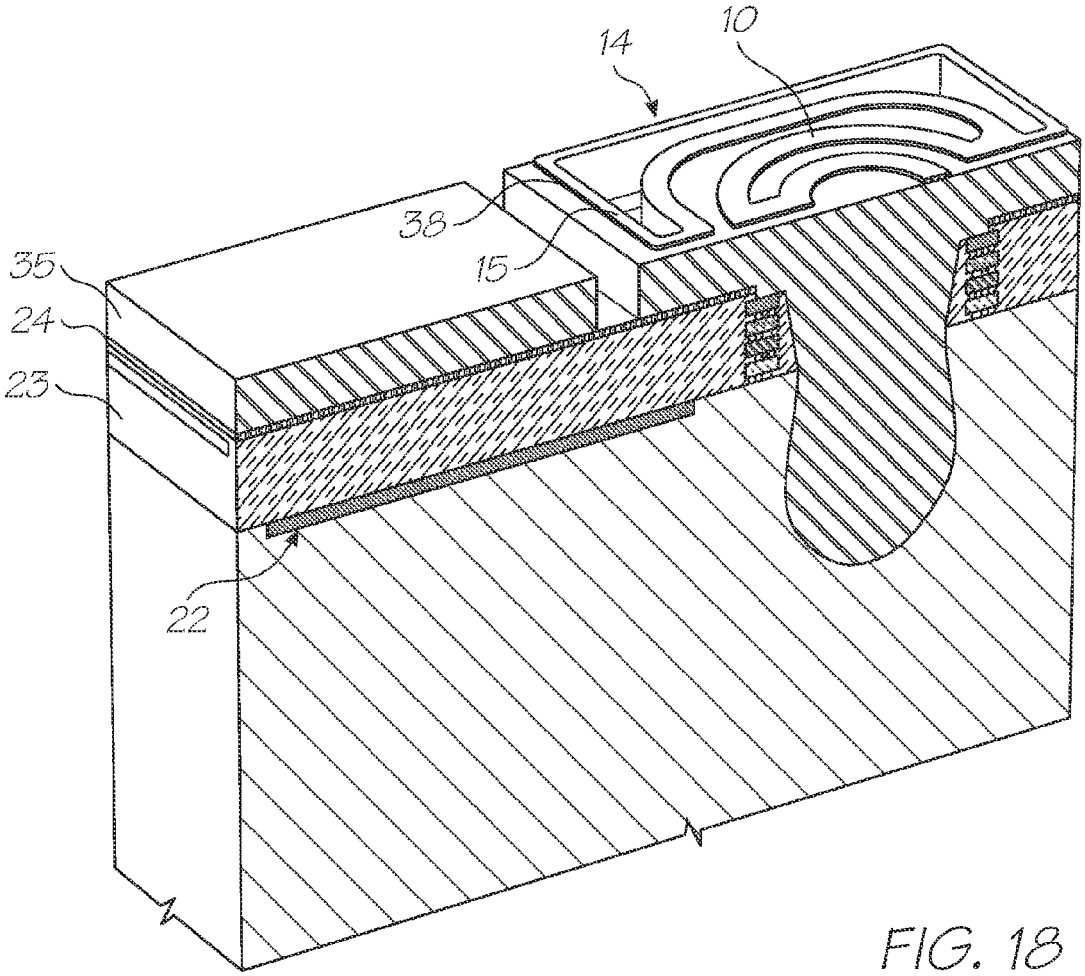
Figure 19:
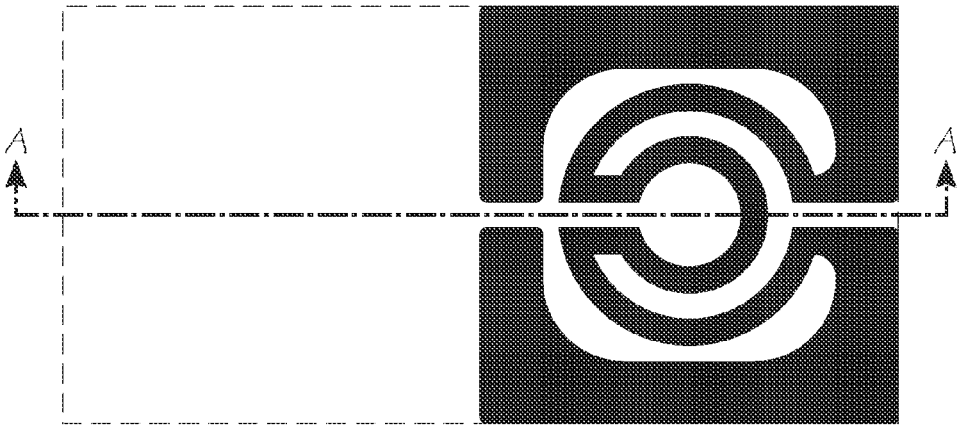

FIG. 18 shows the stage of production after patterning and etching of the heater layer 38 to form the heater 14, including the heater element 10 and electrodes 15.

Figure 20:
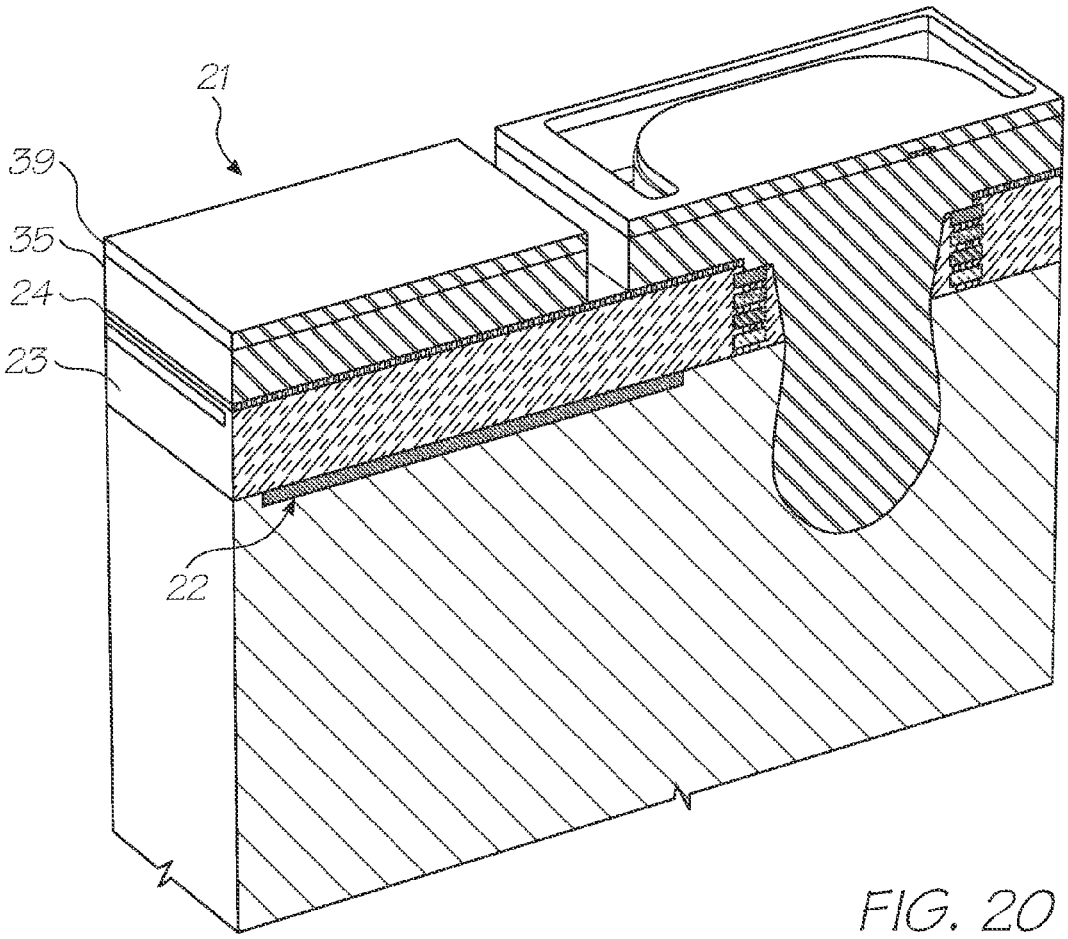

FIG. 20 shows the stage of production after another sacrificial resist layer 39, about 1 micron thick, has been added.

Figure 22:
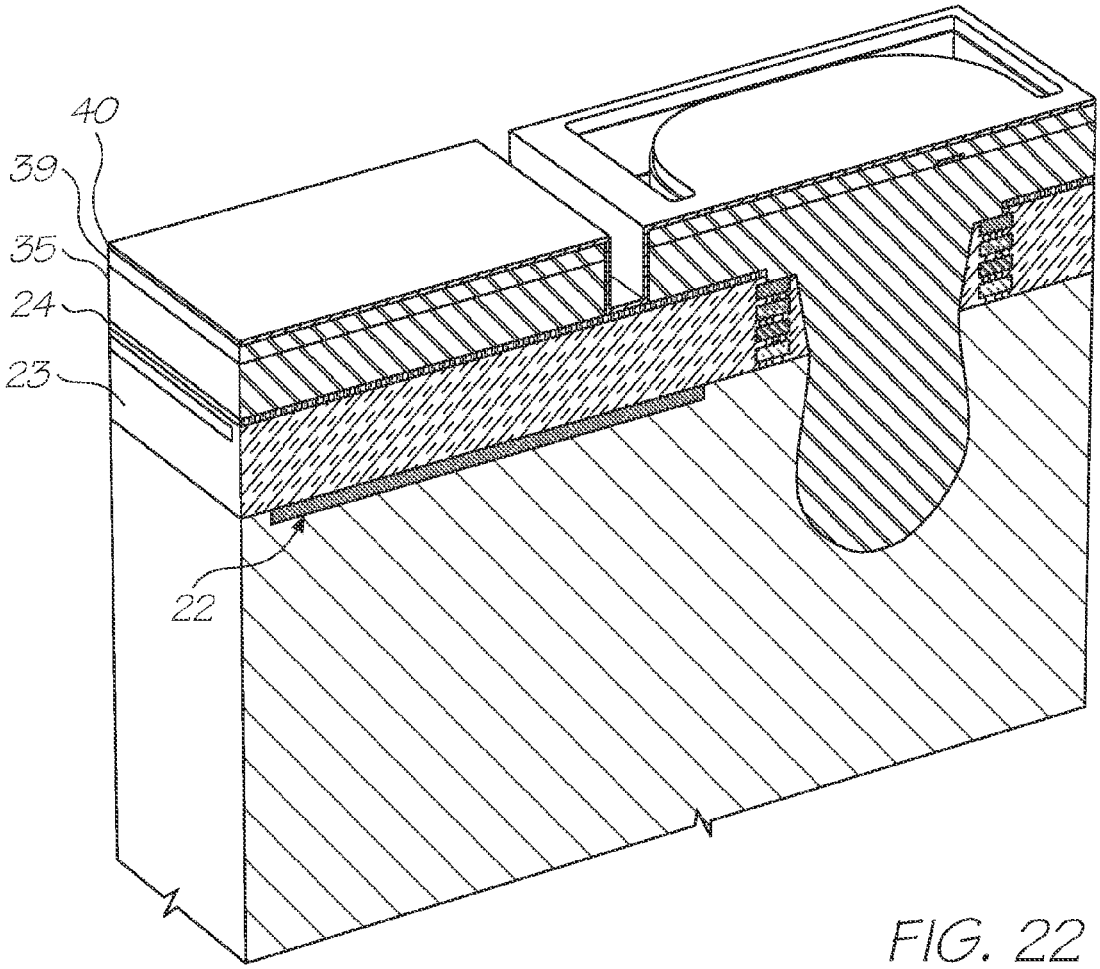

FIG. 22 shows the stage of production after a second layer 40 of heater material has been deposited. In a preferred embodiment, this layer 40, like the first heater layer 38, is of 0.5 micron thick titanium aluminium nitride.

Figure 23:
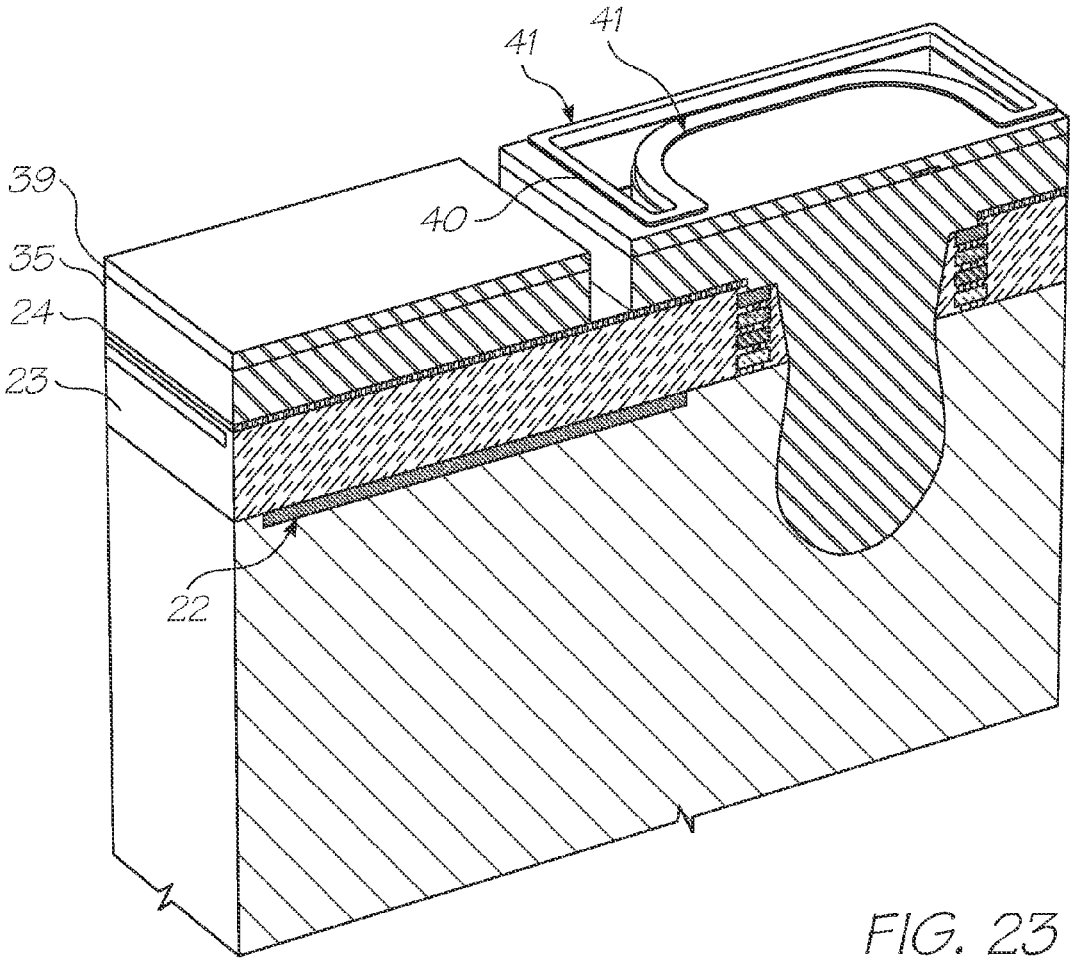
Figure 24:
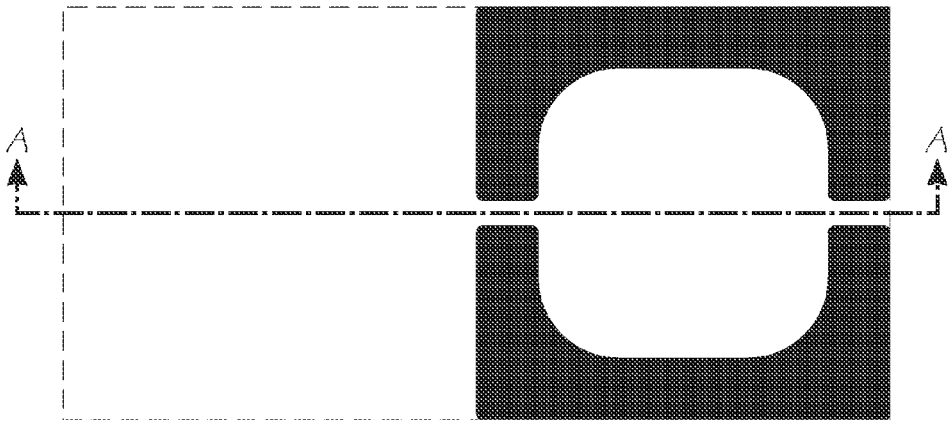

FIG. 23 then shows this second layer 40 of heater material after it has been etched to form the pattern as shown, indicated by reference numeral 41. In this illustration, this patterned layer does not include a heater layer element 10, and in this sense has no heater functionality. However, this layer of heater material does assist in reducing the resistance of the electrodes 15 of the heater 14 so that, in operation, less energy is consumed by the electrodes which allows greater energy consumption by, and therefore greater effectiveness of, the heater elements 10. In the dual heater embodiment illustrated in FIG. 42, the corresponding layer 40 does contain a heater 14.

Figure 25:
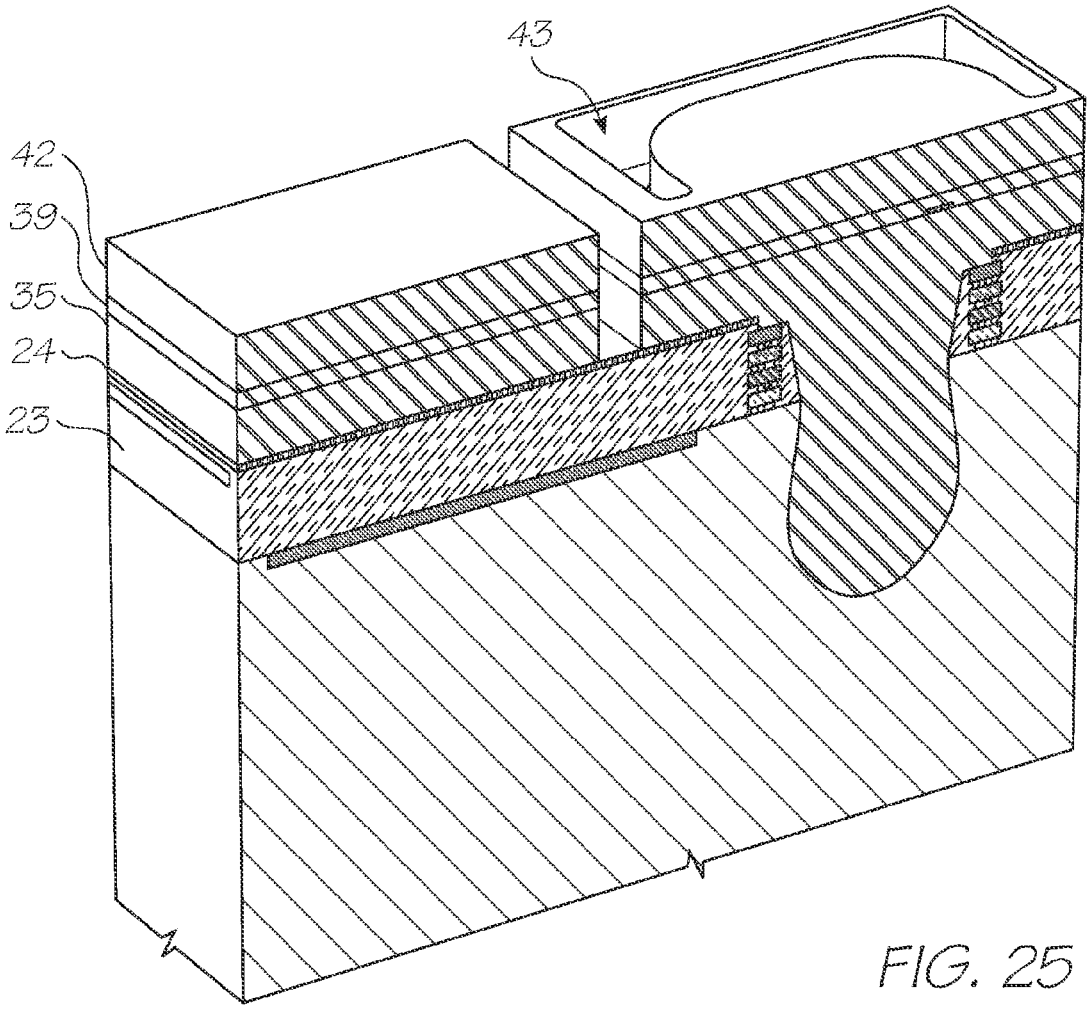
Figure 26:
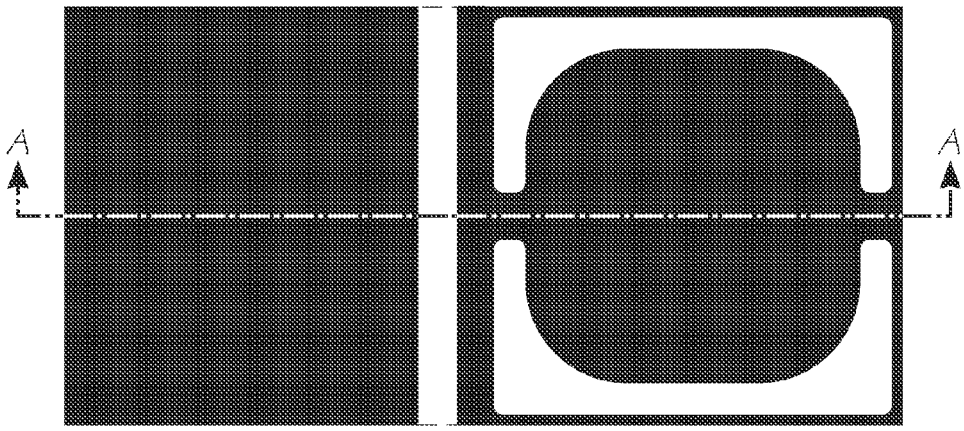

FIG. 25 shows the stage of production after a third layer 42, of sacrificial resist, has been deposited. The uppermost level of this layer will constitute the inner surface of the nozzle plate 2 to be formed later. This is also the inner extent of the ejection aperture 5 of the nozzle. The height of this layer 42 must be sufficient to allow for the formation of a bubble 12 in the region designated 43 during operation of the printhead. However, the height of layer 42 determines the mass of ink that the bubble must move in order to eject a droplet. In light of this, the printhead structure of the present invention is designed such that the heater element is much closer to the ejection aperture than in prior art printheads. The mass of ink moved by the bubble is reduced. The generation of a bubble sufficient for the ejection of the desired droplet will require less energy, thereby improving efficiency.

Figure 27:
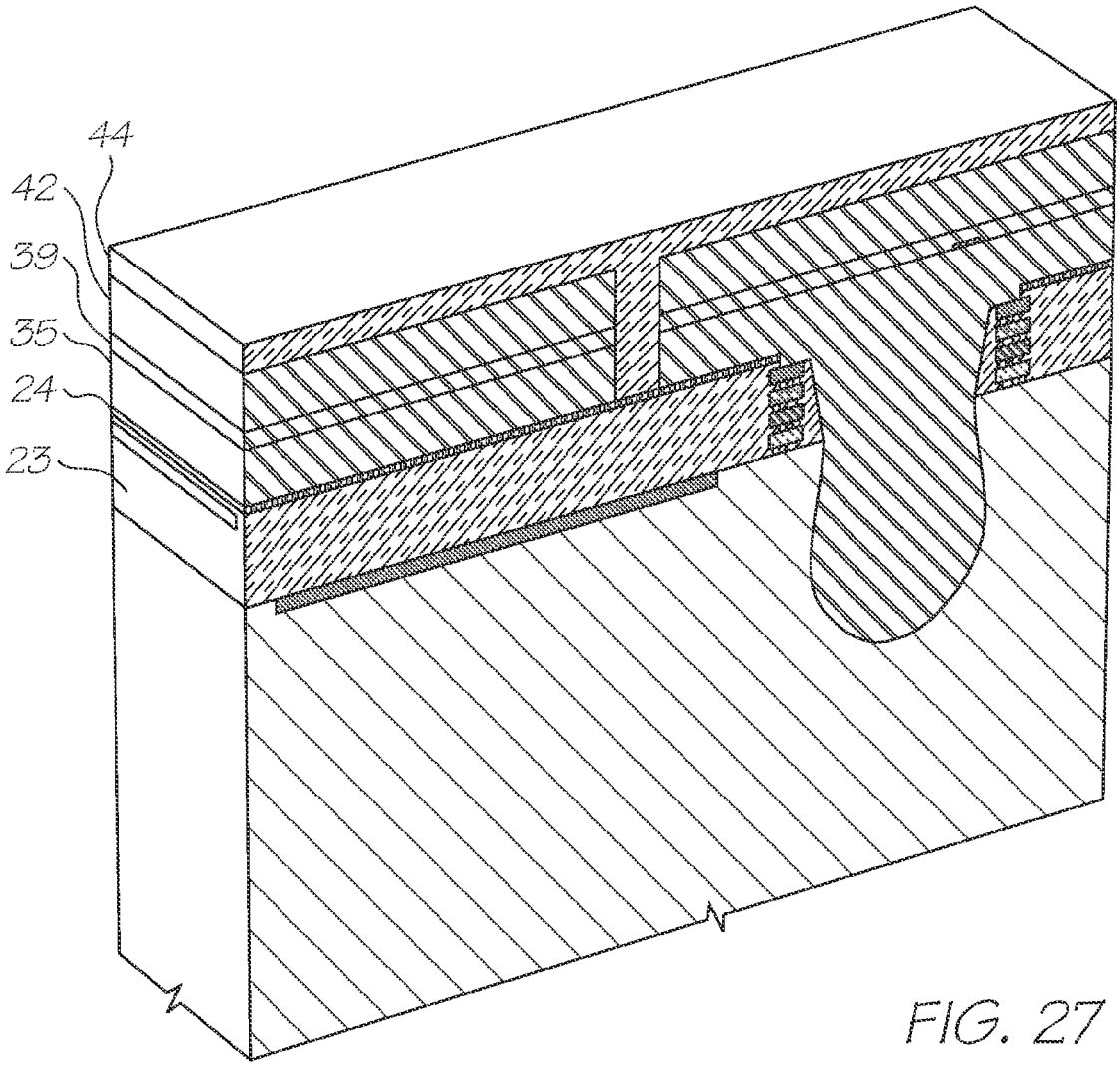

FIG. 27 shows the stage of production after the roof layer 44 has been deposited, that is, the layer which will constitute the nozzle plate 2. Instead of being formed from 100 micron thick polyimide film, the nozzle plate 2 is formed of silicon nitride, just 2 microns thick.

Figure 28:
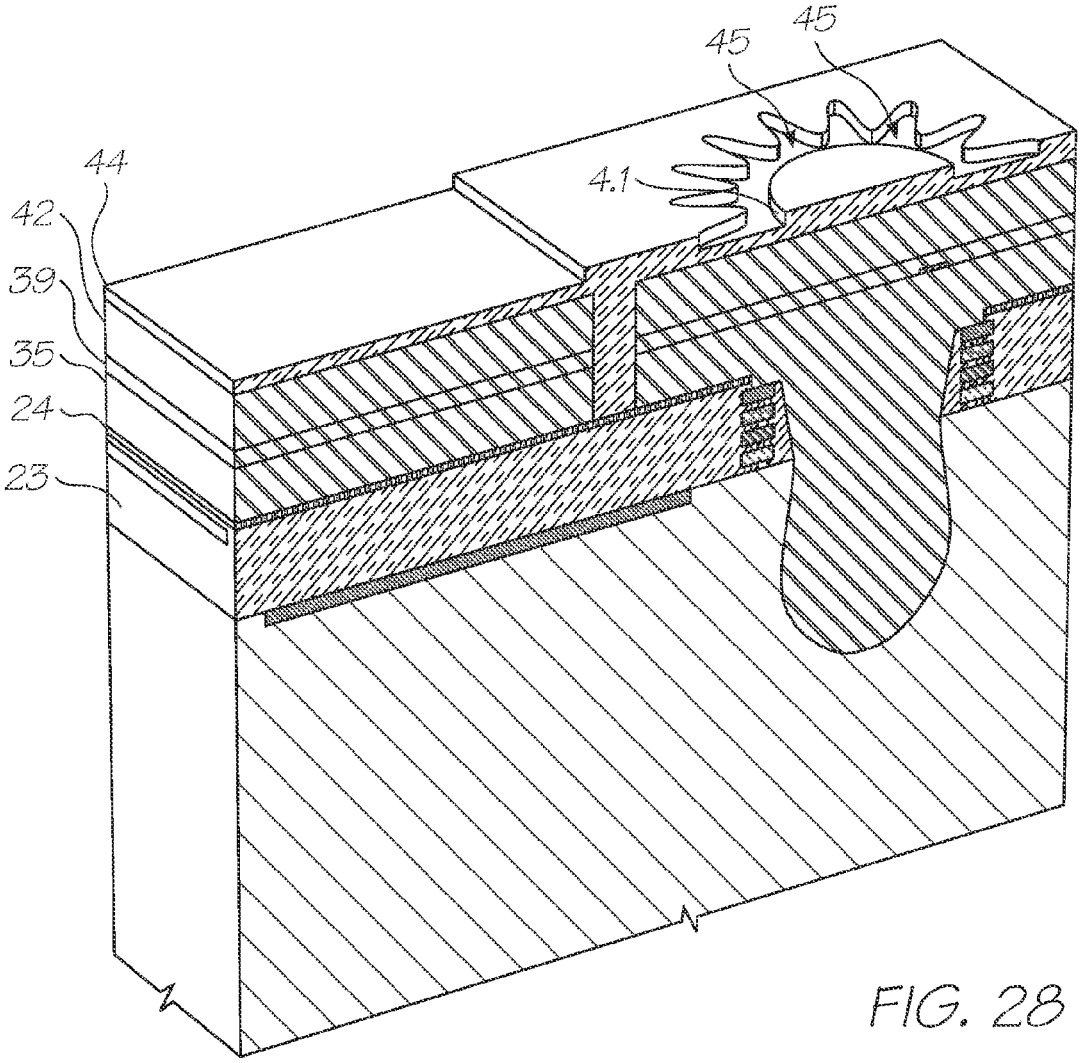
Figure 29:
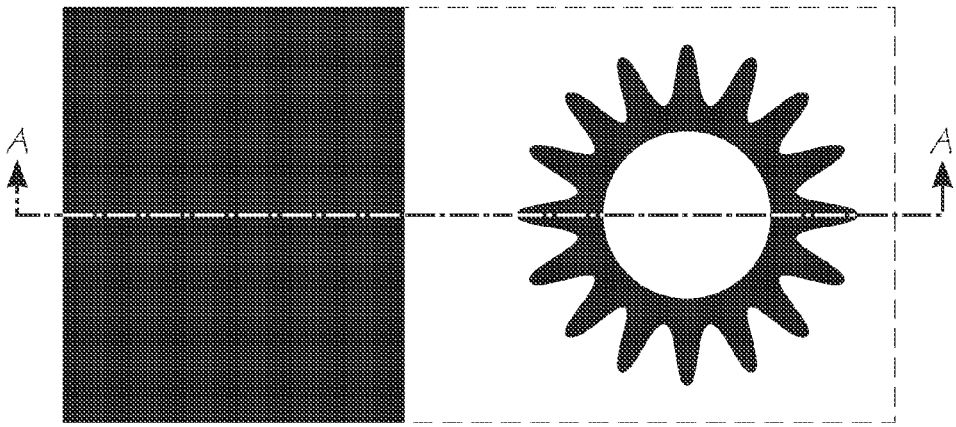

FIG. 28 shows the stage of production after the chemical vapor deposition (CVD) of silicon nitride forming the layer 44, has been partly etched at the position designated 45, so as to form the outside part of the nozzle rim 4, this outside part being designated 4.1

Figure 30:
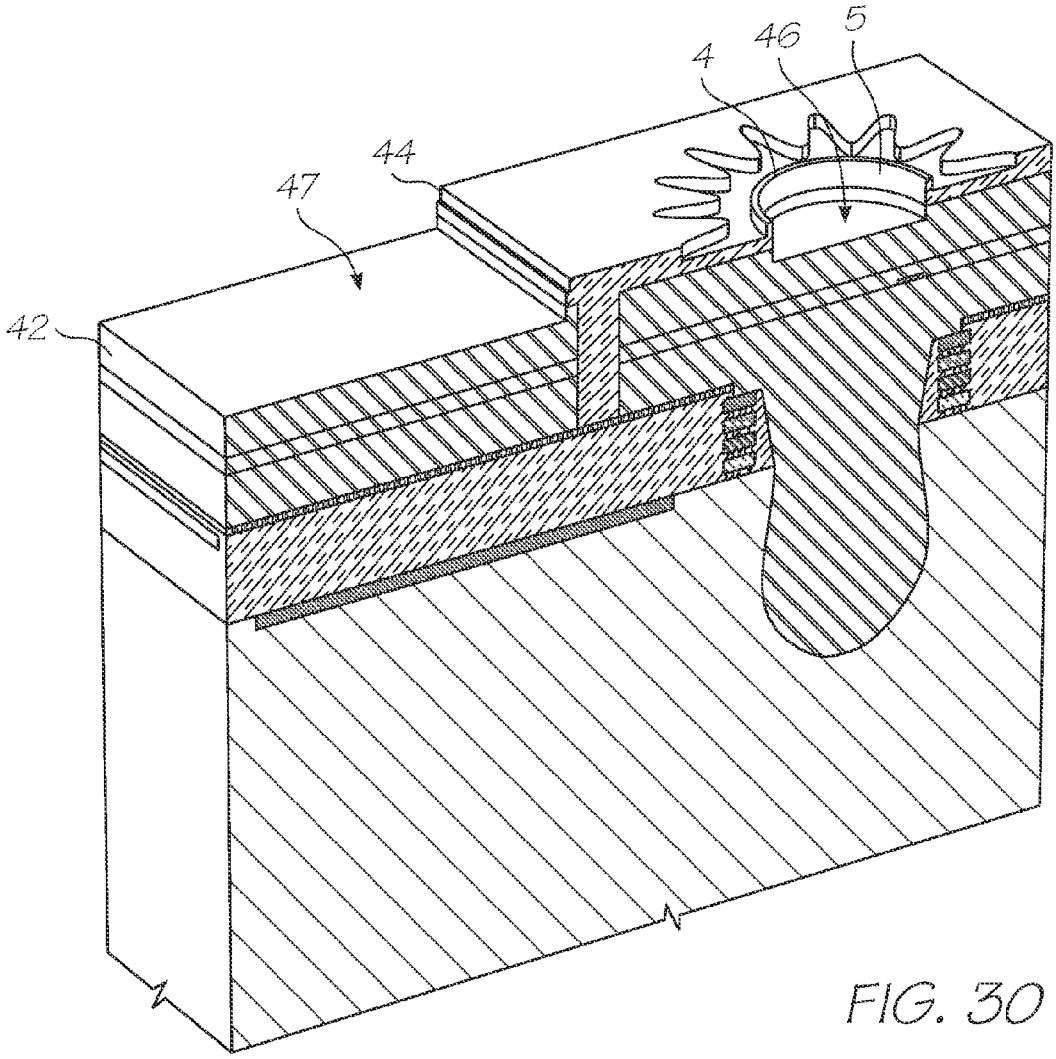
Figure 31:
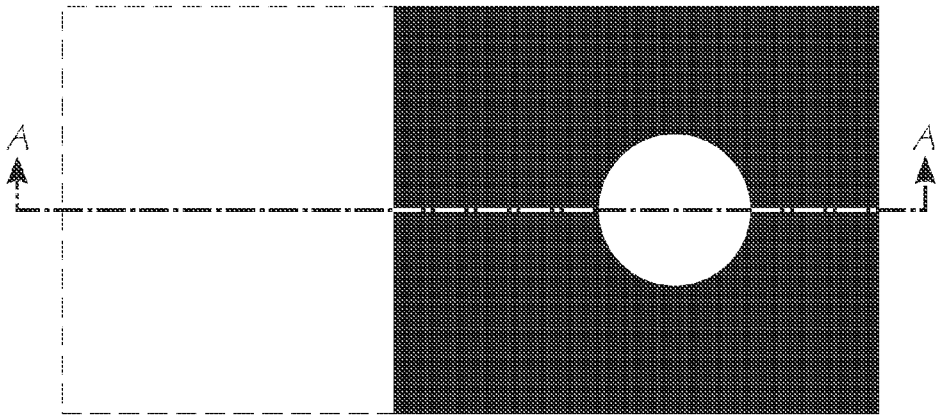

FIG. 30 shows the stage of production after the CVD of silicon nitride has been etched all the way through at 46, to complete the formation of the nozzle rim 4 and to form the ejection aperture 5, and after the CVD silicon nitride has been removed at the position designated 47 where it is not required.

Figure 32:
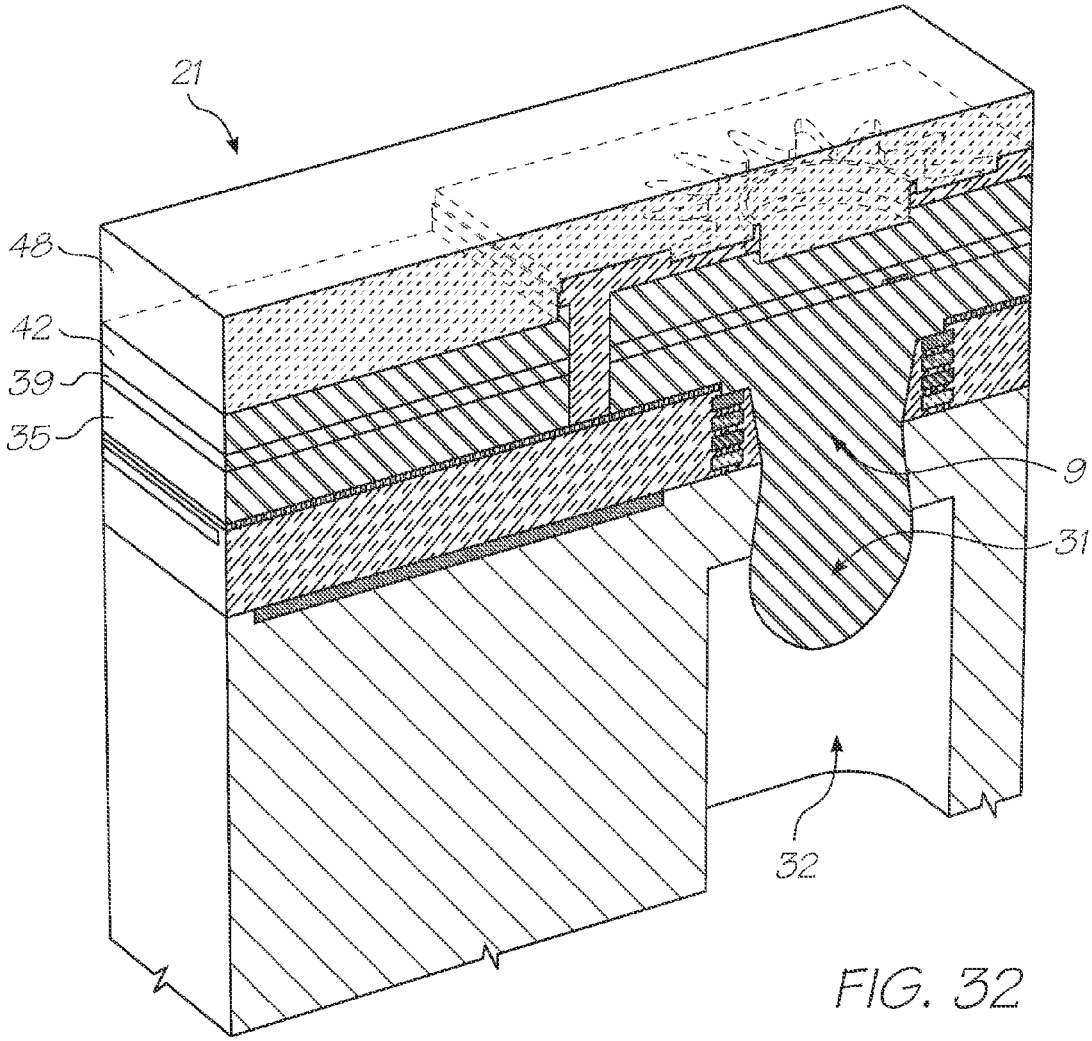
Figure 33:
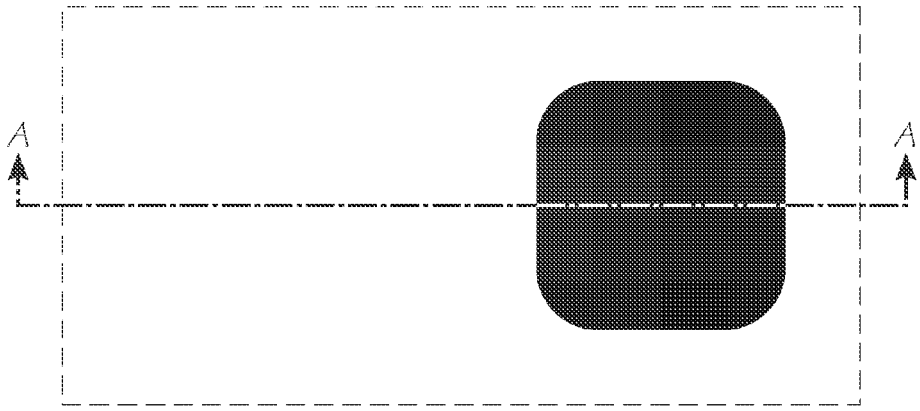

FIG. 32 shows the stage of production after a protective layer 48 of resist has been applied. After this stage, the substrate portion 21 is then ground from its other side (not shown) to reduce the substrate portion from its nominal thickness of about 800 microns to about 200 microns, and then, as foreshadowed above, to etch the hole 32. The hole 32 is etched to a depth such that it meets the hole 31.

Then, the sacrificial resist of each of the resist layers 35, 39, 42 and 48, is removed using oxygen plasma, to form the structure shown in FIG. 34, with walls 6 and nozzle plate 2 which together define the chamber 7 (part of the walls and nozzle plate being shown cut-away). It will be noted that this also serves to remove the resist filling the hole 31 so that this hole, together with the hole 32 (not shown in FIG. 34), define a passage extending from the lower side of the substrate portion 21 to the nozzle 3, this passage serving as the ink inlet passage, generally designated 9, to the chamber 7.

Figure 36:
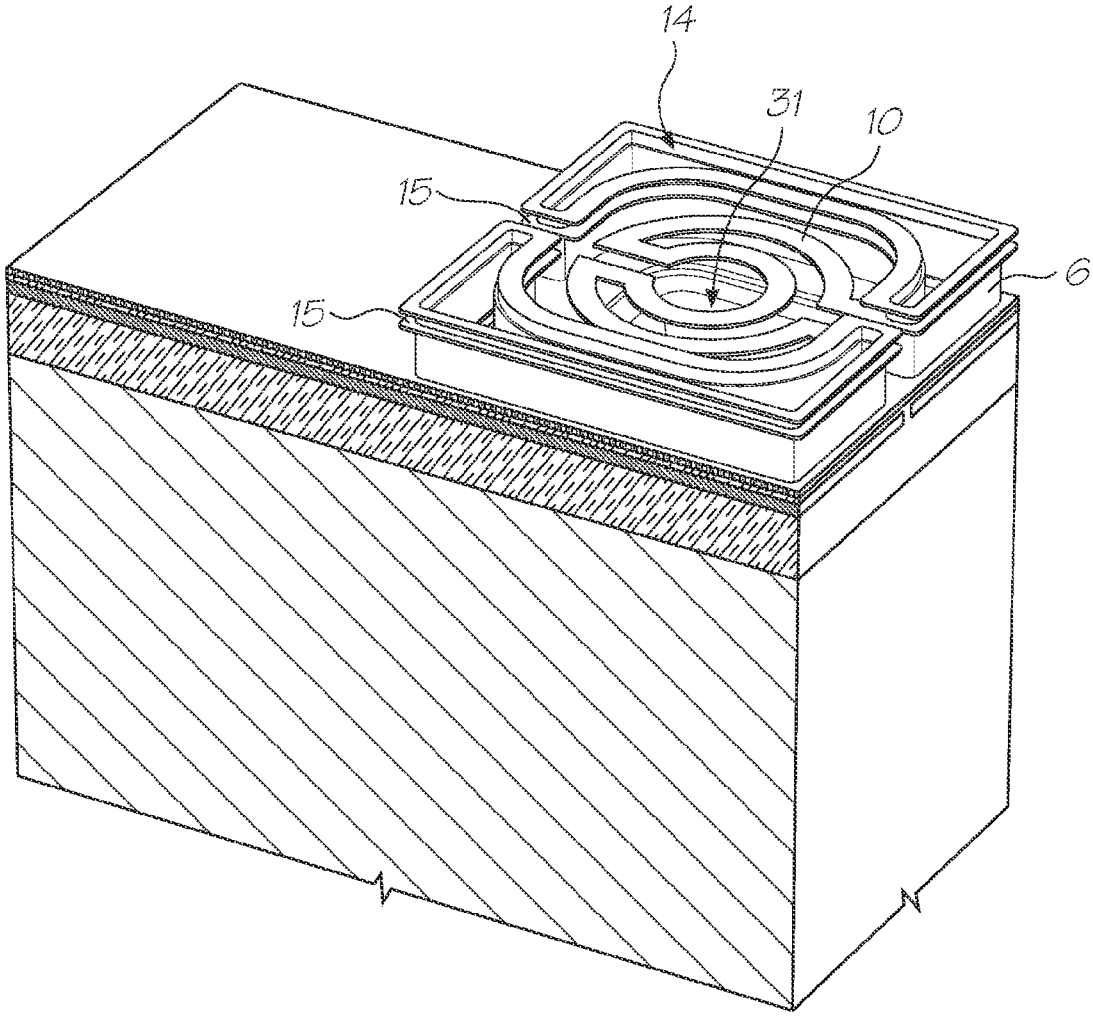

FIG. 36 shows the printhead with the nozzle guard and chamber walls removed to clearly illustrate the vertically stacked arrangement of the heater elements 10 and the electrodes 15.

Bonded Heater Element Embodiments

In other embodiments, the heater elements are bonded to the internal walls of the chamber. Bonding the heater to solid surfaces within the chamber allows the etching and deposition fabrication process to be simplified. However, heat conduction to the silicon substrate can reduce the efficiency of the nozzle so that it is no longer 'self cooling'. Therefore, in embodiments where the heater is bonded to solid surfaces within the chamber, it is necessary to take steps to thermally isolate the heater from the substrate.

One way of improving the thermal isolation between the heater and the substrate is to find a material with better thermal barrier properties than silicon dioxide, which is the traditionally used thermal barrier layer, described in U.S. Pat. No. 4,513,298. The Applicant has shown that the relevant parameter to consider when selecting the barrier layer, is the thermal product; $(pCk)^{1/2}$. The energy lost into a solid underlayer in contact with the heater is proportional to the thermal product of the underlayer, a relationship which may be derived by considering the length scale for thermal diffusion and the thermal energy absorbed over that length scale. Given that proportionality, it can be seen that a thermal barrier layer with reduced density and thermal conductivity will absorb less energy from the heater. This aspect of the invention focuses on the use of materials with reduced density and thermal conductivity as thermal barrier layers inserted underneath the heater layer, replacing the traditional silicon dioxide layer. In particular, this aspect of the invention focuses on the use of low-k dielectrics as thermal barriers Low-k dielectrics have recently been used as the inter-metal dielectric of copper damascene integrated circuit technology. When used as an inter-metal dielectric, the reduced density and in some cases porosity of the low-k dielectrics help reduce the dielectric constant of the inter-metal dielectric, the capacitance between metal lines and the RC delay of the integrated circuit. In the copper damascene application, an undesirable consequence of the reduced dielectric density is poor thermal conductivity, which limits heat flow from the chip. In the thermal barrier application, low thermal conductivity is ideal, as it limits the energy absorbed from the heater.

Two examples of low-k dielectrics suitable for application as thermal barriers are Applied Material's Black Diamond™ and Novellus' Coral™, both of which are CVD deposited SiOCH films. These films have lower density than $SiO_2$ (~1340 $kgm^{-3}$ vs ~2200 $kgm^{-3}$) and lower thermal conductivity (~0.4 $Wm^{-1}$ $K^{-1}$ vs ~1.46 $Wm^{-1}$ $K^{-1}$). The thermal products for these materials are thus around 600 $Jm^{-2}K^{-1}s^{-1/2}$, compared to 1495 $Jm^{-2}K^{-1}s^{-1/2}$ for $SiO_2$ i.e. a 60% reduction in thermal product. To calculate the benefit that may be derived by replacing $SiO_2$ underlayers with these materials, models using equation 3 in the Detailed Description can be used to show that ~35% of the energy required to nucleate a bubble is lost by thermal diffusion into the underlayer when $SiO_2$ underlayers are used. The benefit of the replacement is therefore 60% of 35% i.e. a 21% reduction in nucleation energy. This benefit has been confirmed by the Applicant by comparing the energy required to nucleate a bubble on 1. heaters deposited directly onto $SiO_2$ and
2. heaters deposited directly onto Black Diamond™.

The latter required 20% less energy for the onset of bubble nucleation, as determined by viewing the bubble formation stroboscopically in an open pool boiling configuration, using water as a test fluid. The open pool boiling was run for over 1 billion actuations, without any shift in nucleation energy or degradation of the bubble, indicating the underlayer is thermally stable up to the superheat limit of the water i.e. ~300° C. Indeed, such layers can be thermally stable up to 550° C., as described in work related to the use of these films as Cu diffusion barriers (see "Physical and Barrier Properties of Amorphous Silicon-Oxycarbide Deposited by PECVD from Octamethylcycltetrasiloxane", Journal of The Electrochemical Society, 151 (2004) by Chiu-Chih Chiang et. al.).

Further reduction in thermal conductivity, thermal product and the energy required to nucleate a bubble may be provided by introducing porosity into the dielectric, as has been done by Trikon Technologies, Inc. with their ORION™ 2.2 porous SiOCH film, which has a density of ~1040 $kgm^{-3}$ and thermal conductivity of ~0.16 $Wm^{-1}K^{-1}$ (see IST 2000 30043, "Final report on thermal modeling", from the IST project "Ultra Low K Dielectrics For Damascene Copper Interconnect Schemes"). With a thermal product of ~334 $Jm^{-2}K^{-1}s^{-1/2}$, this material would absorb 78% less energy than a $SiO_2$ underlayer, resulting in a 78*35%=27% reduction in the energy required to nucleate a bubble. It is possible however that the introduction of porosity may compromise the moisture resistance of the material, which would compromise the thermal properties, since water has a thermal product of 1579 $Jm^{-2}K^{-1}s^{-1/2}$, close to that of $SiO_2$. A moisture barrier could be introduced between the heater and the thermal barrier, but the heat absorption in this layer would likely degrade overall efficiency: in the preferred embodiment the thermal barrier is directly in contact with the underside of the heater. If it is not in direct contact, the thermal barrier layer is preferably no more than 1 μm away from the heater layer, as it will have little effect otherwise (the length scale for heat diffusion in the ~1 μs time scale of the heating pulse in e.g. $SiO_2$ is ~1 μm).

An alternative for further lowering thermal conductivity without using porosity is to use the spin-on dielectrics, such as Dow Corning's SiLK™, which has a thermal conductivity of 0.18 $Wm^{-1}K^{-1}$. The spin-on films can also be made porous, but as with the CVD films, that may compromise moisture resistance. SiLK has thermal stability up to 450° C. One point of concern regarding the spin-on dielectrics is that they generally have large coefficients of thermal expansion (CTEs). Indeed, it seems that reducing k generally increases the CTE. This is implied in "A Study of Current Multilevel Interconnect Technologies for 90 nm Nodes and Beyond", by Takayuki Ohba, Fujitsu magazine, Volume 38-1, paper 3. SiLK, for example, has a CTE of ~70 $ppm \cdot K^{-1}$. This is likely to be much larger than the CTE of the overlying heater material, so large stresses and delamination are likely to result from heating to the ~300° C. superheat limit of water based ink. SiOCH films, on the other hand, have a reasonably low CTE of ~10 $ppm \cdot K^{-1}$, which in the Applicant's devices, matches the CTE of the TiAlN heater material: no delamination of the heater was observed in the Applicant's open pool testing after 1 billion bubble nucleations. Since the heater materials used in the inkjet application are likely to have CTEs around ~10 $ppm \cdot K^{-1}$, the CVD deposited films are preferred over the spin-on films.

One final point of interest relating to this application relates to the lateral definition of the thermal barrier. In U.S. Pat. No. 5,861,902 the thermal barrier layer is modified after deposition so that a region of low thermal diffusivity exists immediately underneath the heater, while further out a region of high thermal diffusivity exists. The arrangement is designed to resolve two conflicting requirements:

1. that the heater be thermally isolated from the substrate to reduce the energy of ejection and
2. that the printhead chip be cooled by thermal conduction out the rear face of the chip.

Such an arrangement is unnecessary in the Applicant's nozzles, which are designed to be self cooling, in the sense that the only heat removal required by the chip is the heat removed by ejected droplets. Formally, 'self cooled' or 'self cooling' nozzles can be defined to be nozzles in which the energy required to eject a drop of the ejectable liquid is less than the maximum amount of thermal energy that can be removed by the drop, being the energy required to heat a volume of the ejectable fluid equivalent to the drop volume from the temperature at which the fluid enters the printhead to the heterogeneous boiling point of the ejectable fluid. In this case, the steady state temperature of the printhead chip will be less than the heterogenous boiling point of the ejectable fluid, regardless of nozzle density, firing rates or the presence or otherwise of a conductive heatsink. If a nozzle is self cooling, the heat is removed from the front face of the printhead via the ejected droplets, and does not need to be transported to the rear face of the chip. Thus the thermal barrier layer does not need to be patterned to confine it to the region underneath the heaters. This simplifies the processing of the device. In fact, a CVD SiOCH may simply be inserted between the CMOS top layer passivation and the heater layer. This is now discussed below with reference to FIGS. 6 to 9.

Roof Bonded and Floor Bonded Heater Elements

Figure 5:
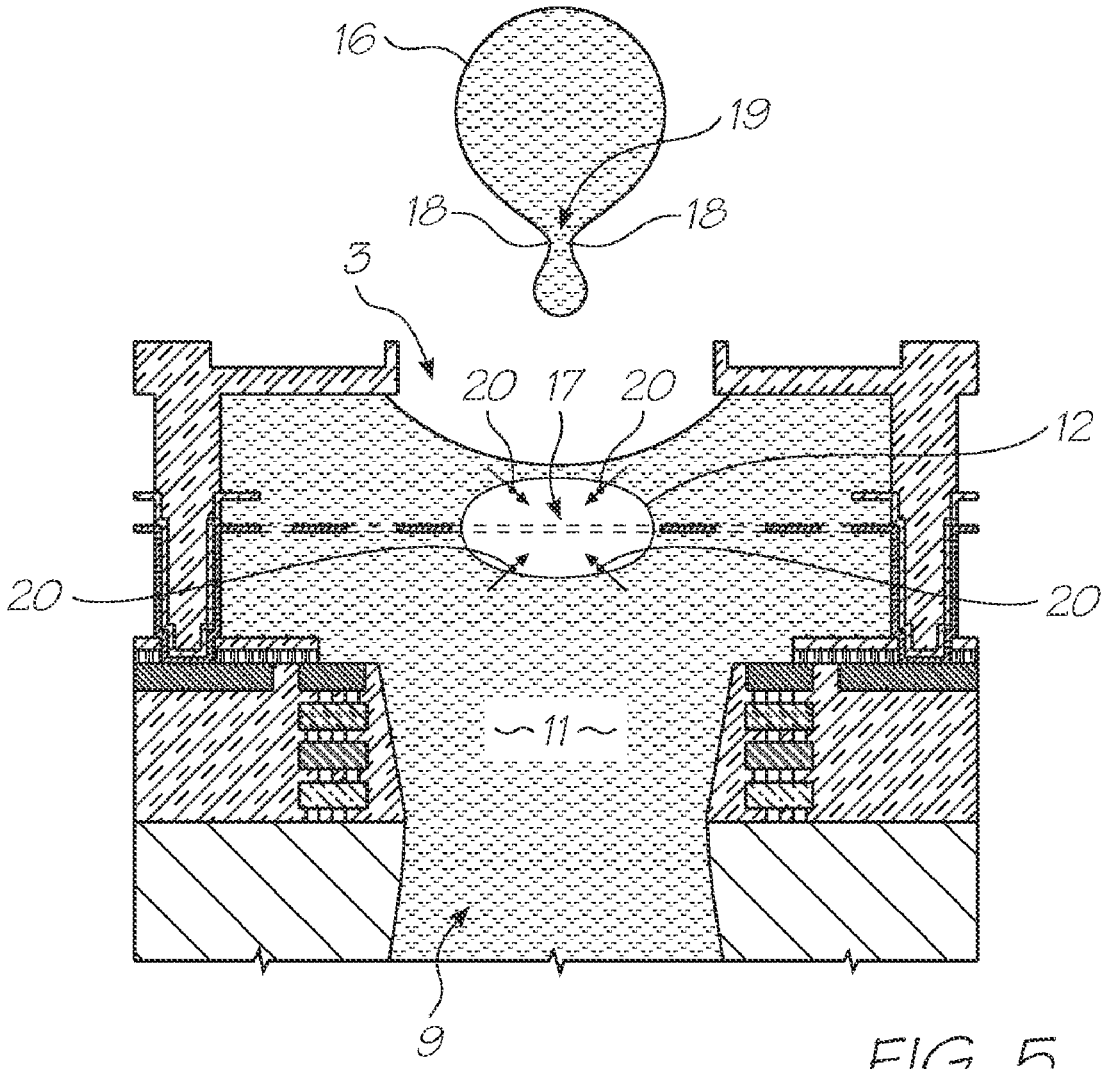
FIG. 5 is a diagrammatic cross-sectional view through a unit cell of a printhead in accordance with an embodiment of the invention showing the collapse of a vapor bubble.
Figure 6:
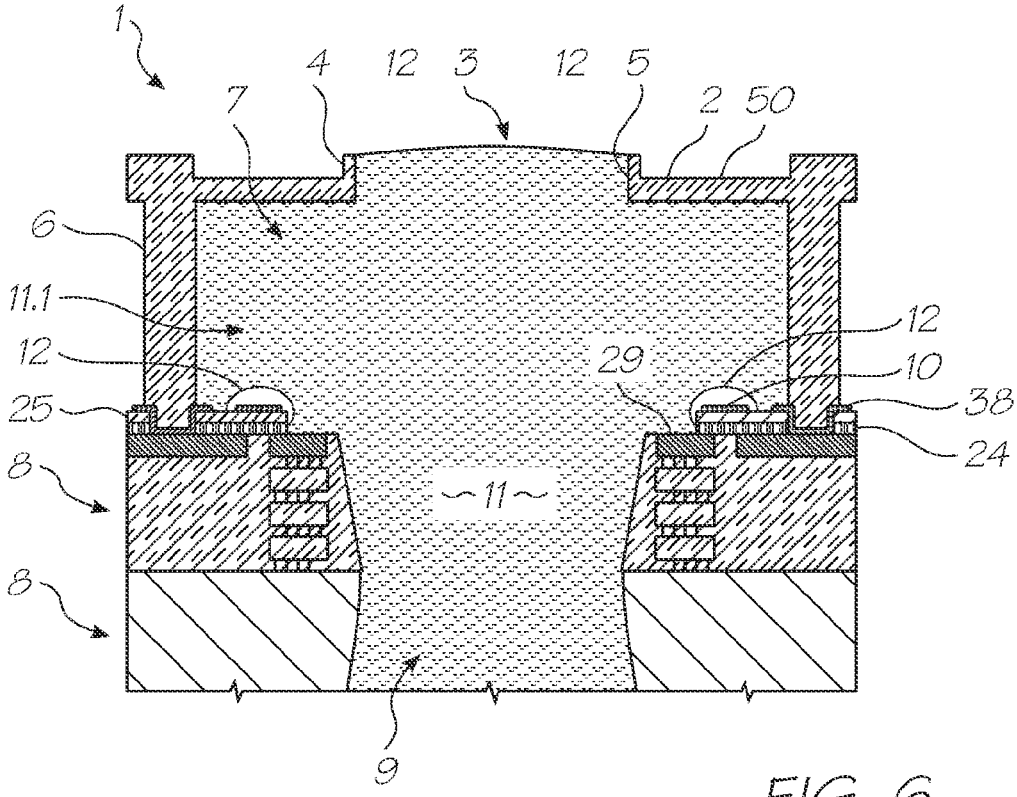
FIG. 6 is a schematic cross-sectional view through an ink chamber of a unit cell of a printhead with a floor bonded heater element, at a particular stage during its operative cycle.
Figure 7:
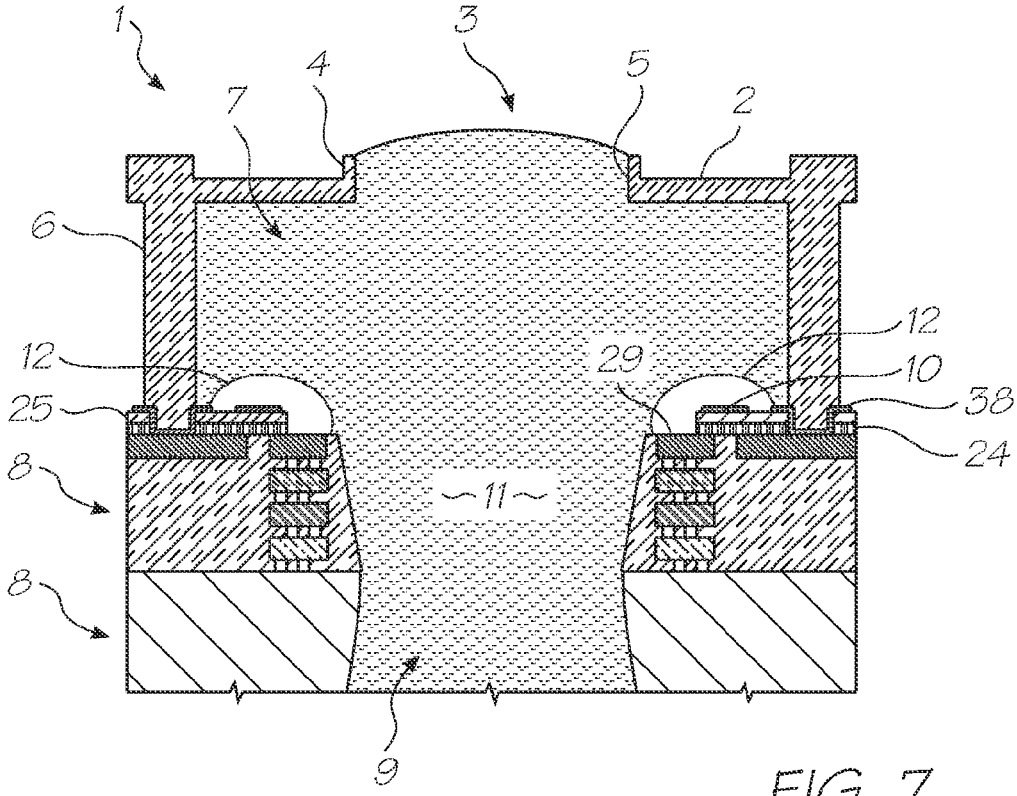
FIG. 7 is a schematic cross-sectional view through the ink chamber of FIG. 6, at another stage of operation.
Figure 8:
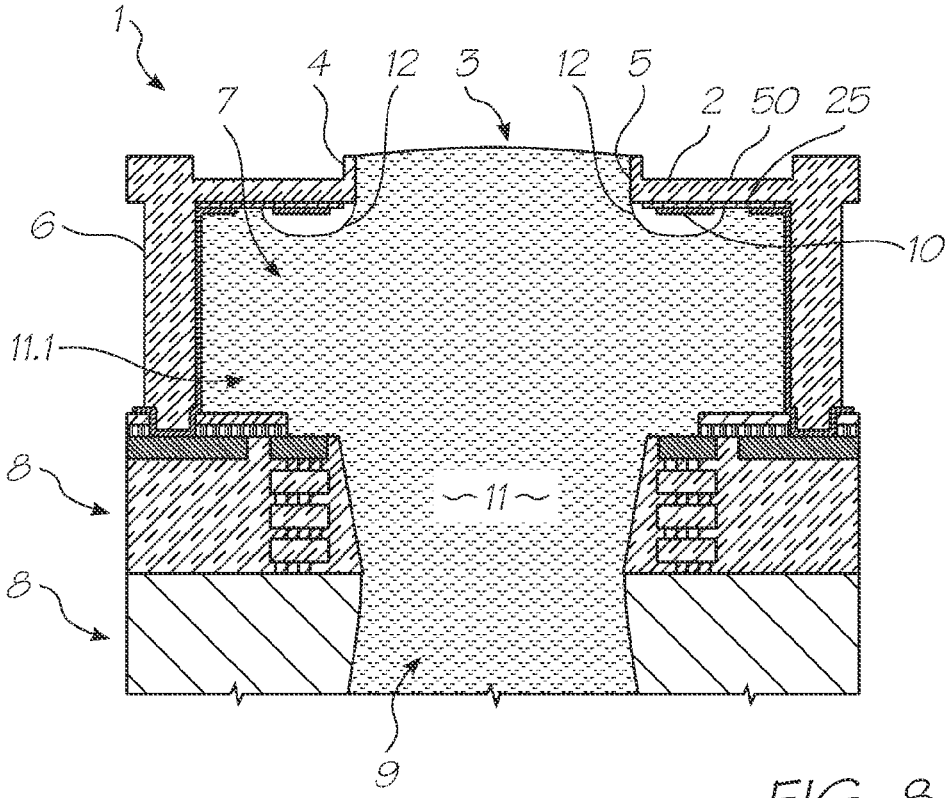
FIG. 8 is a schematic cross-sectional view through an ink chamber of a unit cell of a printhead with a roof bonded heater element, at a particular stage during its operative cycle.
Figure 9:
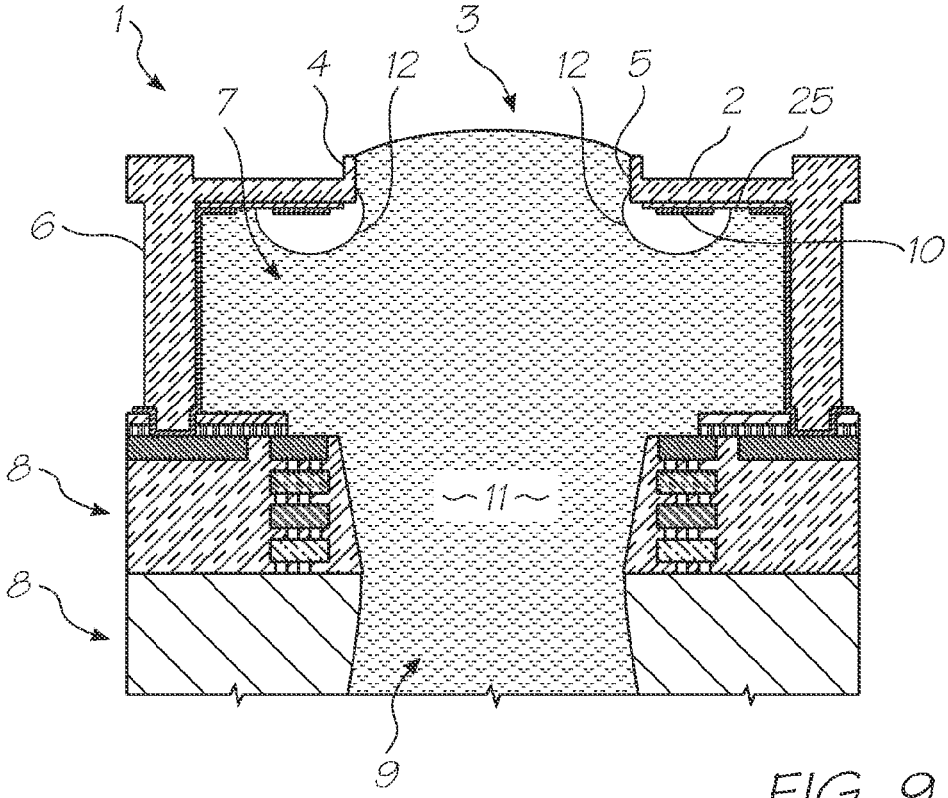
FIG. 9 is a schematic cross-sectional view through the ink chamber of FIG. 8, at another stage of operation.

FIGS. 6 to 9 schematically show two bonded heater embodiments; in FIGS. 6 and 7 the heater 10 is bonded to the floor of the chamber 7, and FIGS. 8 and 9 bonded the heater to the roof of the chamber. These figures generally correspond with FIGS. 1 and 2 in that they show bubble 12 nucleation and the early stages of growth. In the interests of brevity, figures corresponding to FIGS. 3 to 5 showing continued growth and drop ejection have been omitted.

Referring firstly to FIGS. 6 and 7, the heater element 10 is bonded to the floor of the ink chamber 7. In this case the heater layer 38 is deposited on the passivation layer 24 after the etching the passivation recesses 29 (best shown in FIG. 10), before etching of the ink inlet holes 30 and 31 and deposition of the sacrificial layer 35 (shown in FIGS. 14 and 15). This re-arrangement of the manufacturing sequence prevents the heater material 38 from being deposited in the holes 30 and 31. In this case the heater layer 38 lies underneath the sacrificial layer 35. This allows the roof layer 50 to be deposited on the sacrificial layer 35, instead of the heater layer 38 as is the case in the suspended heater embodiments. No other sacrificial layers are required if the heater element 10 is bonded to the chamber floor, whereas suspended heater embodiments need the deposition and subsequent etching of the second sacrificial layer 42 above described with reference to FIGS. 25 to 35. To maintain the efficiency of the printhead, a low thermal product layer 25 can be deposited on the passivation layer 24 so that it lies between the heater element 10 and the rest of the substrate 8. The thermal product of a material and its ability to thermally isolate the heater element 10 is discussed above and in greater detail below with reference to equation 3. However, in essence it reduces thermal loss into the passivation layer 24 during the heating pulse.

FIGS. 8 and 9 show the heater element 10 is bonded to the roof of the ink chamber 7. In terms of the suspended heater fabrication process described with reference to FIGS. 10 to 36, the heater layer 38 is deposited on top of the sacrificial layer 35, so the manufacturing sequence is unchanged until after the heater layer 38 is patterned and etched. At that point the roof layer 44 is then deposited on top of the etched heater layer 38, without an intervening sacrificial layer. A low thermal product layer 25 can be included in the roof layer 44 so that the heater layer 38 is in contact with the low thermal product layer, thereby reducing thermal loss into the roof 50 during the heating pulse.

Bonded Heater Element Manufacturing Process

The unit cells shown in FIGS. 6 to 9 are largely schematic and purposely correspond to the unit cells shown in FIGS. 1 to 4 where possible so as to highlight the differences between bonded and suspended heater elements. FIGS. 37 to 70 show the fabrication steps of a more detailed and complex bonded heater embodiment. In this embodiment, the unit cell 21 has four nozzles, four heater elements and one ink inlet. This design increases the nozzle packing density by supplying a plurality of nozzle chambers from a single ink inlet, using elliptical nozzle openings, thinner heater elements and staggering the rows of nozzles. The greater nozzle density affords greater print resolution.

Figure 37:
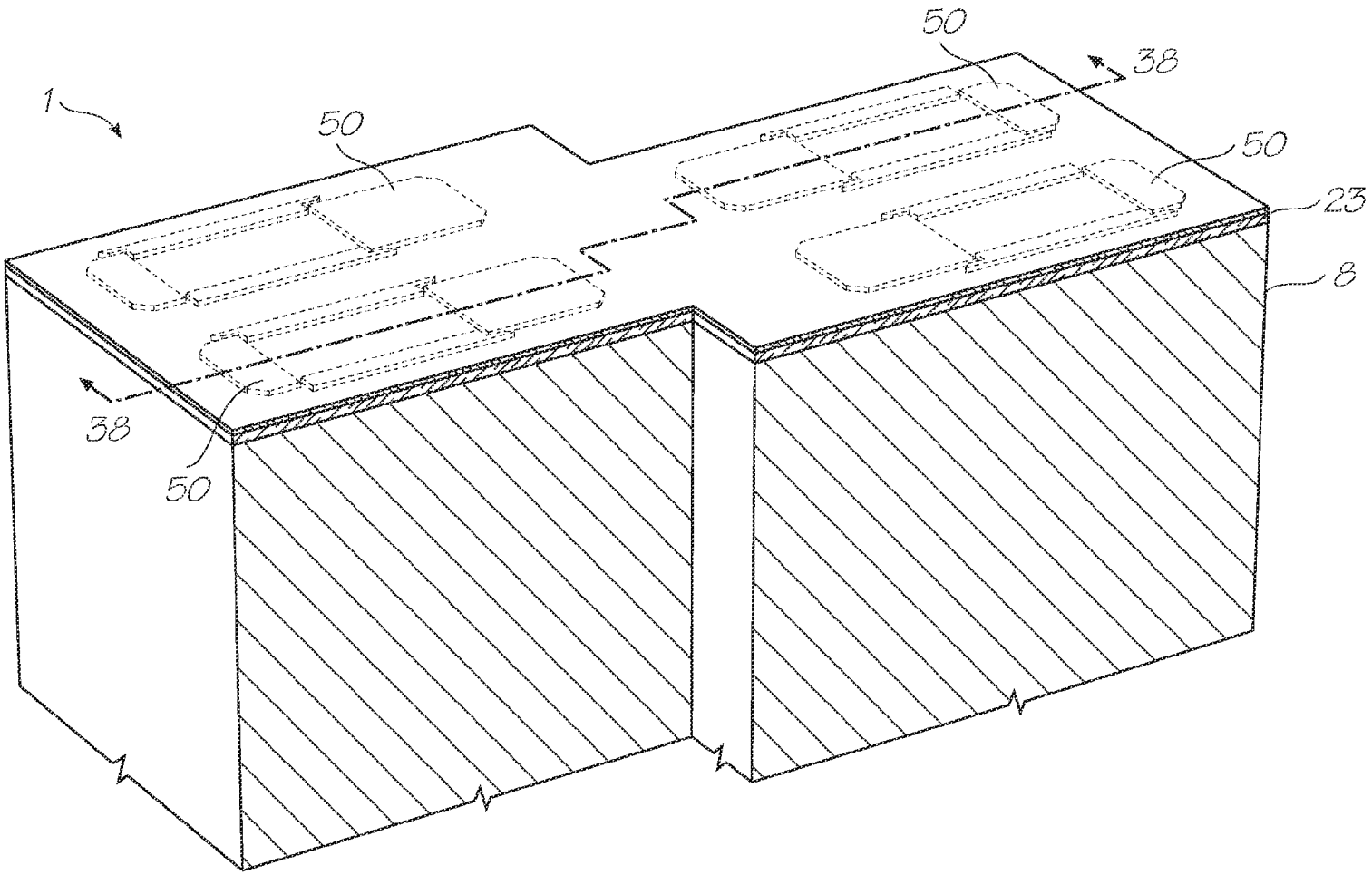
FIGS. 37 and 38 are a schematic section view and perspective view respectively of a partially complete second embodiment of the invention, wherein the passivation layer has been deposited on the CMOS.
Figure 38:
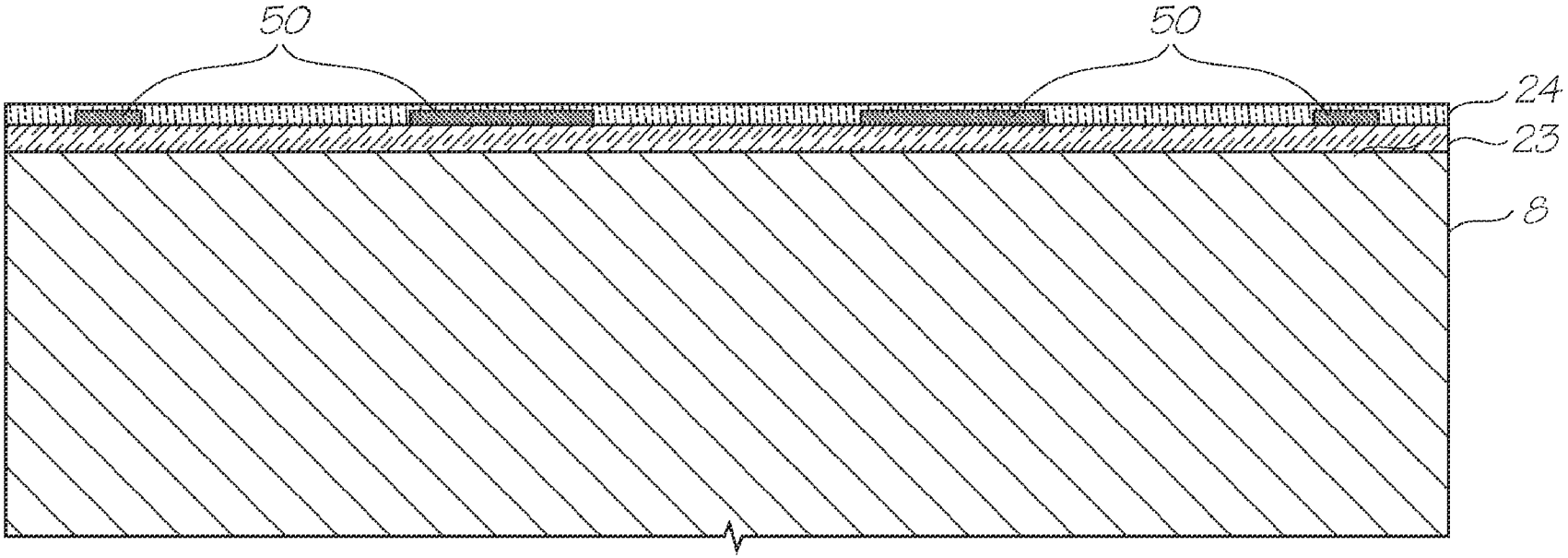

FIGS. 37 and 38 show the partially complete unit cell 1. In the interests of brevity, this description begins at the completion of the standard CMOS fabrication on the wafer 8. The CMOS interconnect layers 23 are four metal layers with interlayer dielectric in between. The topmost metal layer, M4 layer 50 (shown in dotted line) has been patterned to form heater electrode contacts covered by the passivation layer 24. M4 layer is in fact made up of three layers; a layer if TiN, a layer of Al/Cu (>98% Al) and another layer of TiN which acts as an anti-reflective coating (ARC). The ARC stops light from scattering during subsequent exposure steps. A TiN ARC has a resistivity suitable for the heater materials (discussed below).

The passivation layer may be a single silicon dioxide layer is deposited over the interconnect layers 23. Optionally, the passivation layer 24 can be a silicon nitride layer between two silicon dioxide layers (referred to as an "ONO" stack). The passivation layer 24 is planarised such that its thickness on the M4 layers 50 is preferably 0.5 microns. The passivation layer separates the CMOS layers from the MEMS structures and is also used as a hard mask for the ink inlet etch described below.

Figure 39:
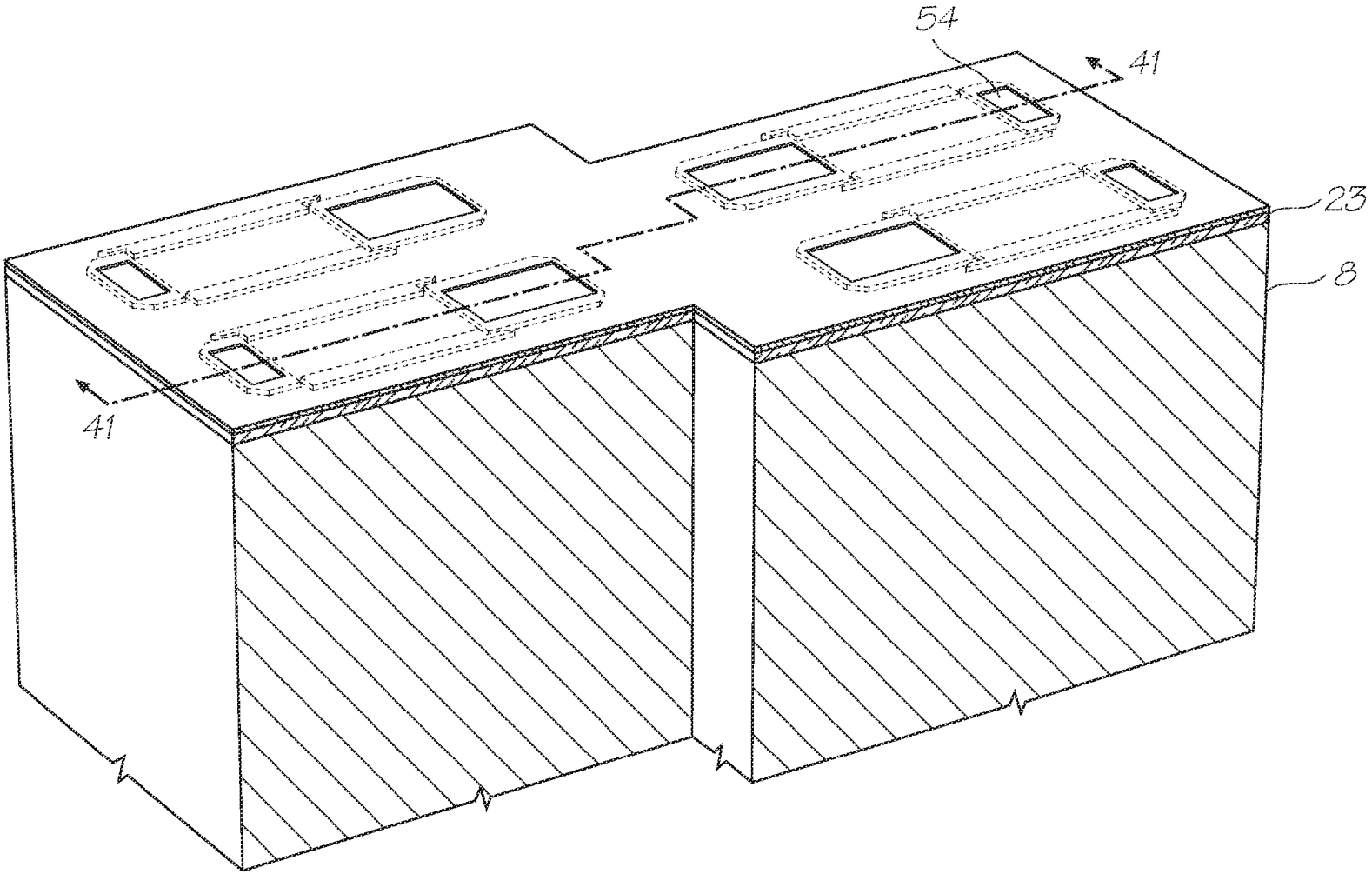
FIGS. 39, 40 and 41 are a perspective, mask and section view respectively showing the etch through the passivation layer to the top layer of the CMOS of the second embodiment.
Figure 40:
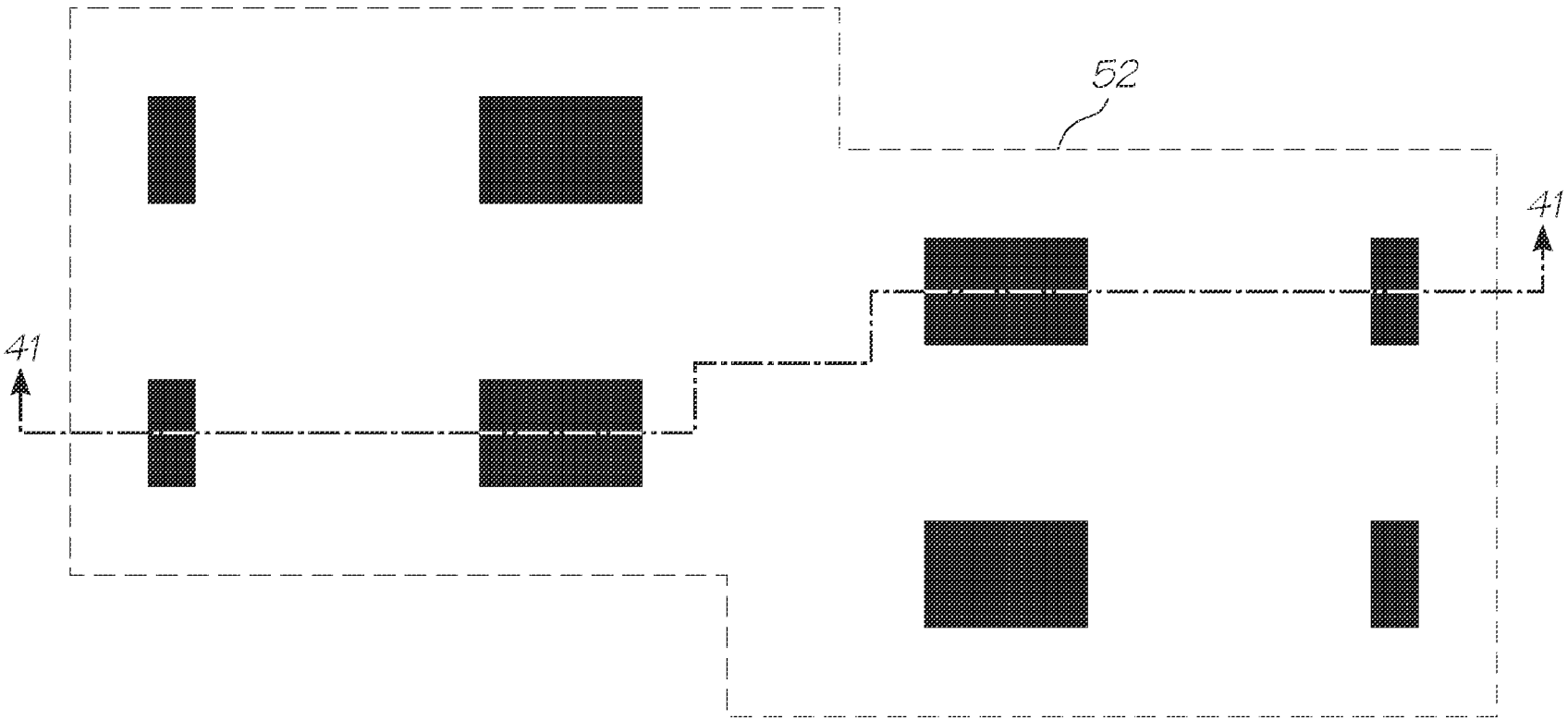
Figure 41:
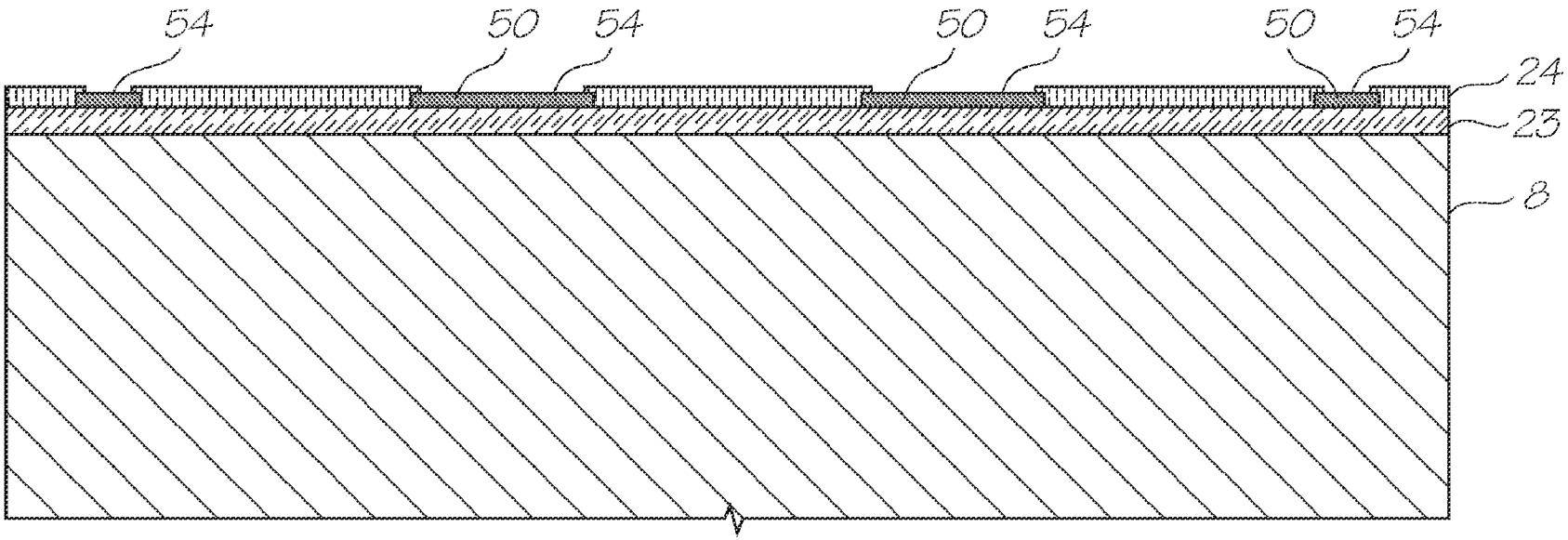

FIGS. 39 and 41 show the windows 54 etched into the passivation layer 24 using the mask 52 shown in FIG. 40. As usual, a photoresist layer (not shown) is spun onto passivation layer 24. The clear tone mask 52—the dark areas indicate where UV light passes through the mask—is exposed and the resist developed in a positive developing solution to remove the exposed photoresist. The passivation layer 24 is then etched through using an oxide etcher (for example, a Centura DPS (Decoupled Plasma Source) Etcher by Applied Materials). The etch needs to stop on the top, or partly into the TiN ARC layer but not the underlying Al/Cu layer. Then the photoresist layer (not shown) is stripped with $O_2$ plasma in a standard CMOS asher.

Figure 42:
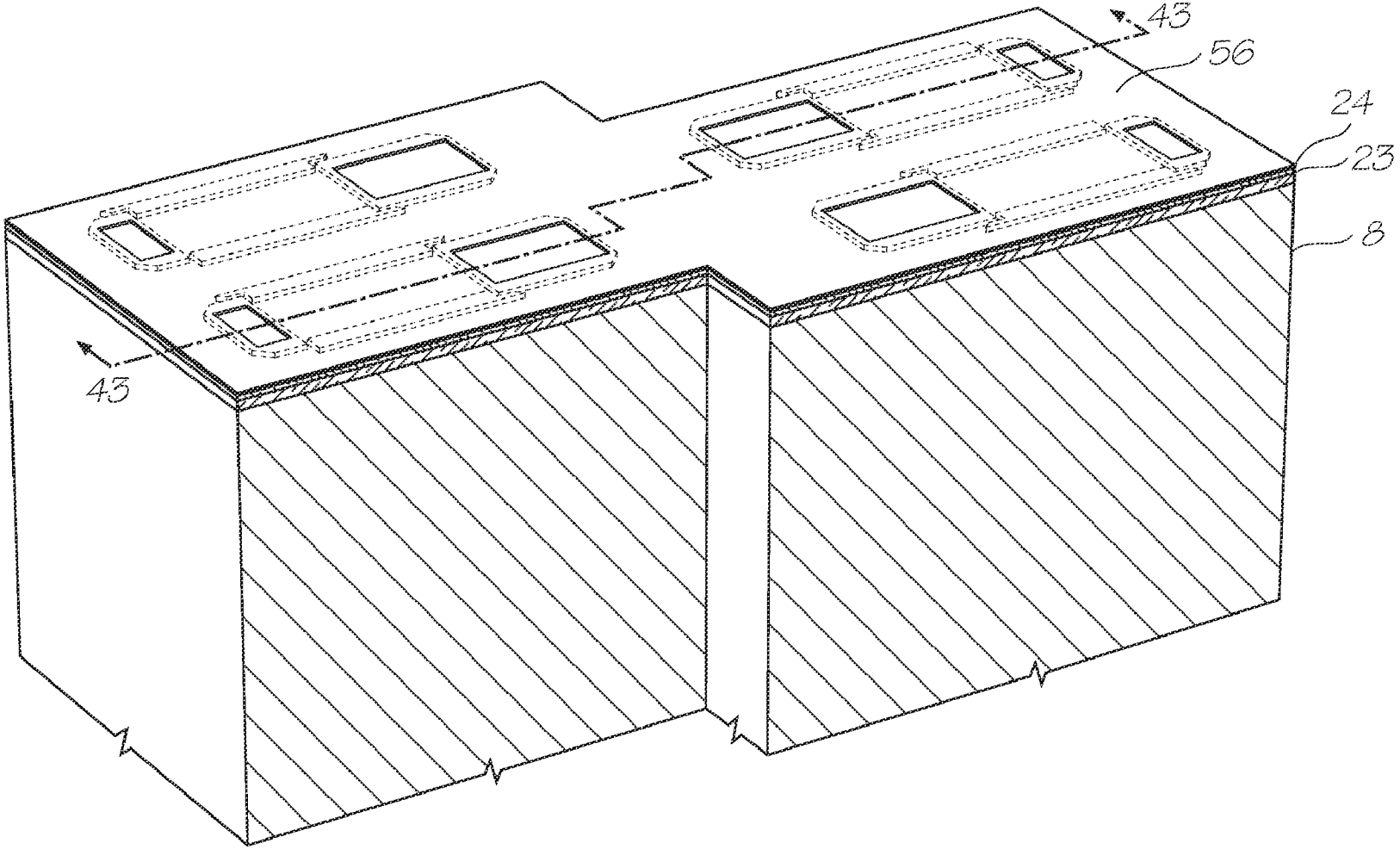
FIGS. 42 and 43 are a perspective and section views respectively showing the deposition of the heater material of the second embodiment.
Figure 43:
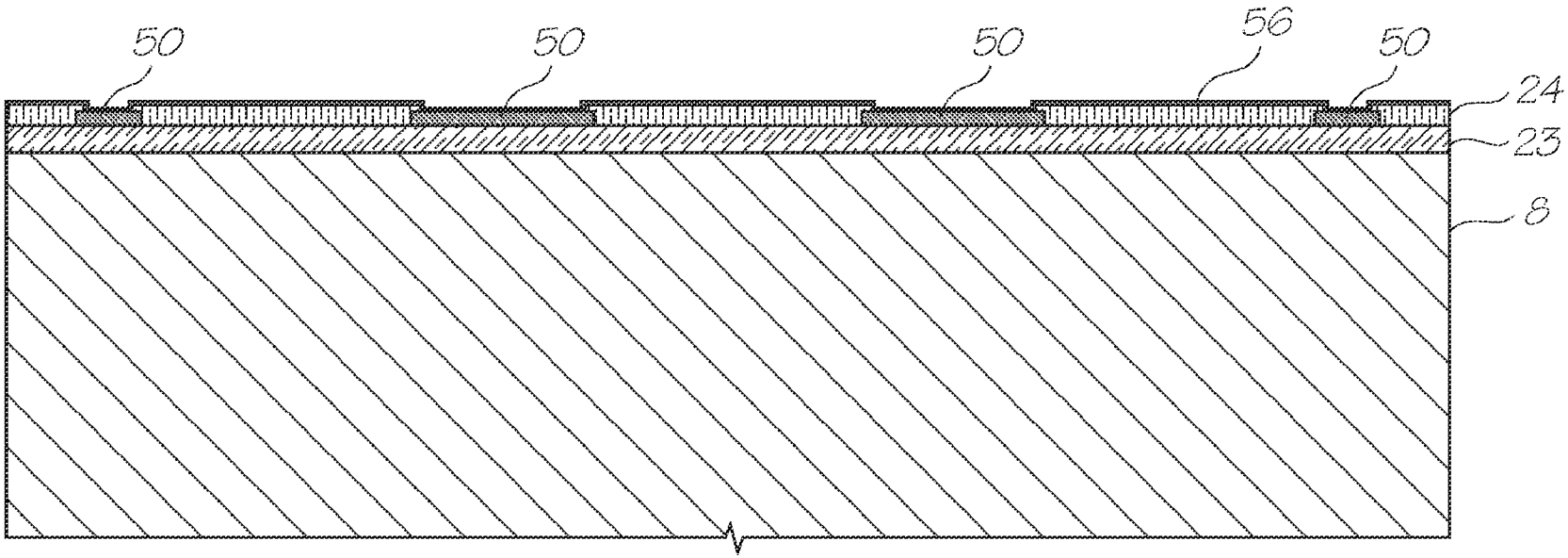
Figure 44:
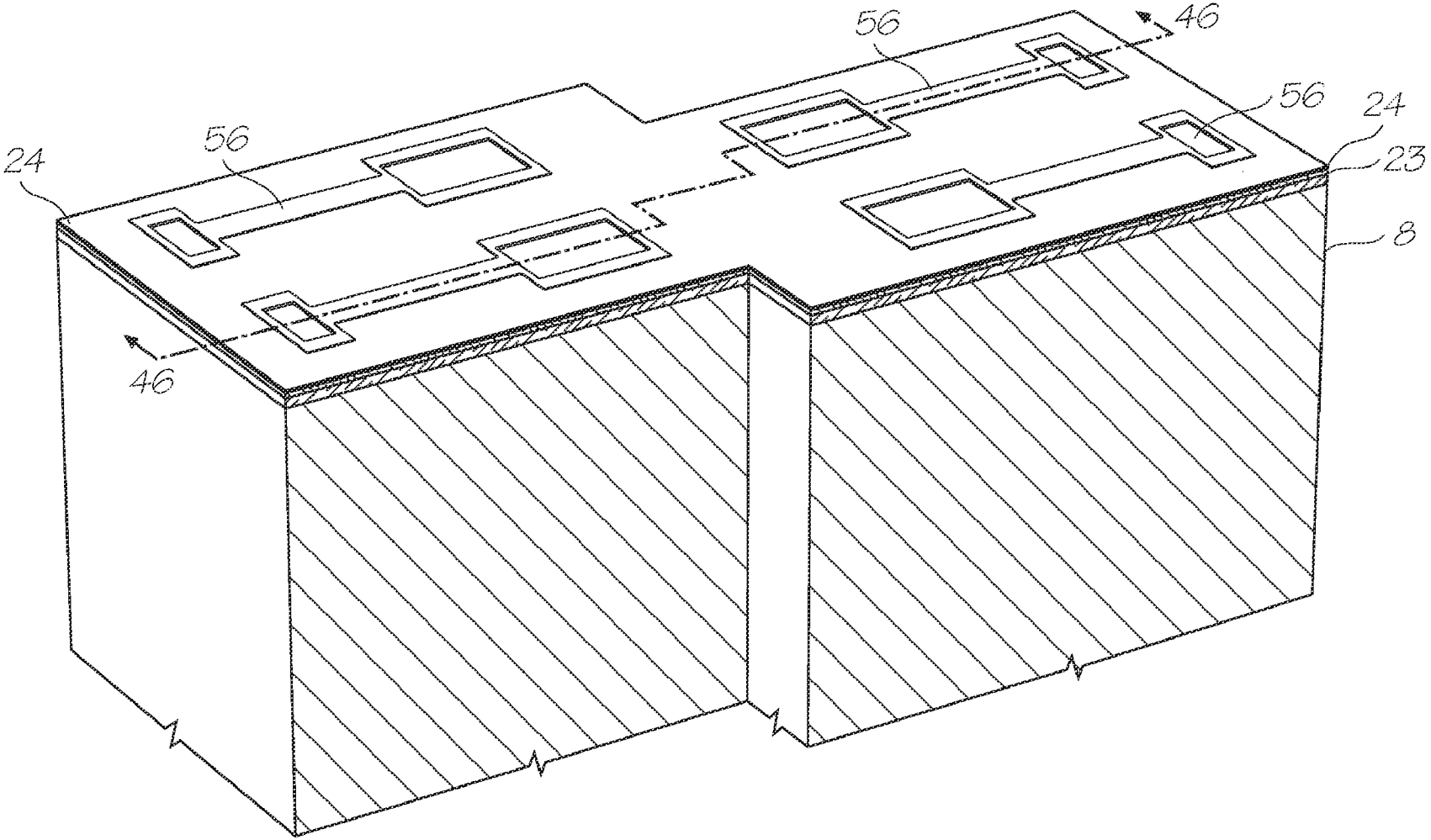
FIGS. 44, 45 and 46 are a perspective, mask and section view respectively showing the etch patterning the heater material of the second embodiment.
Figure 45:
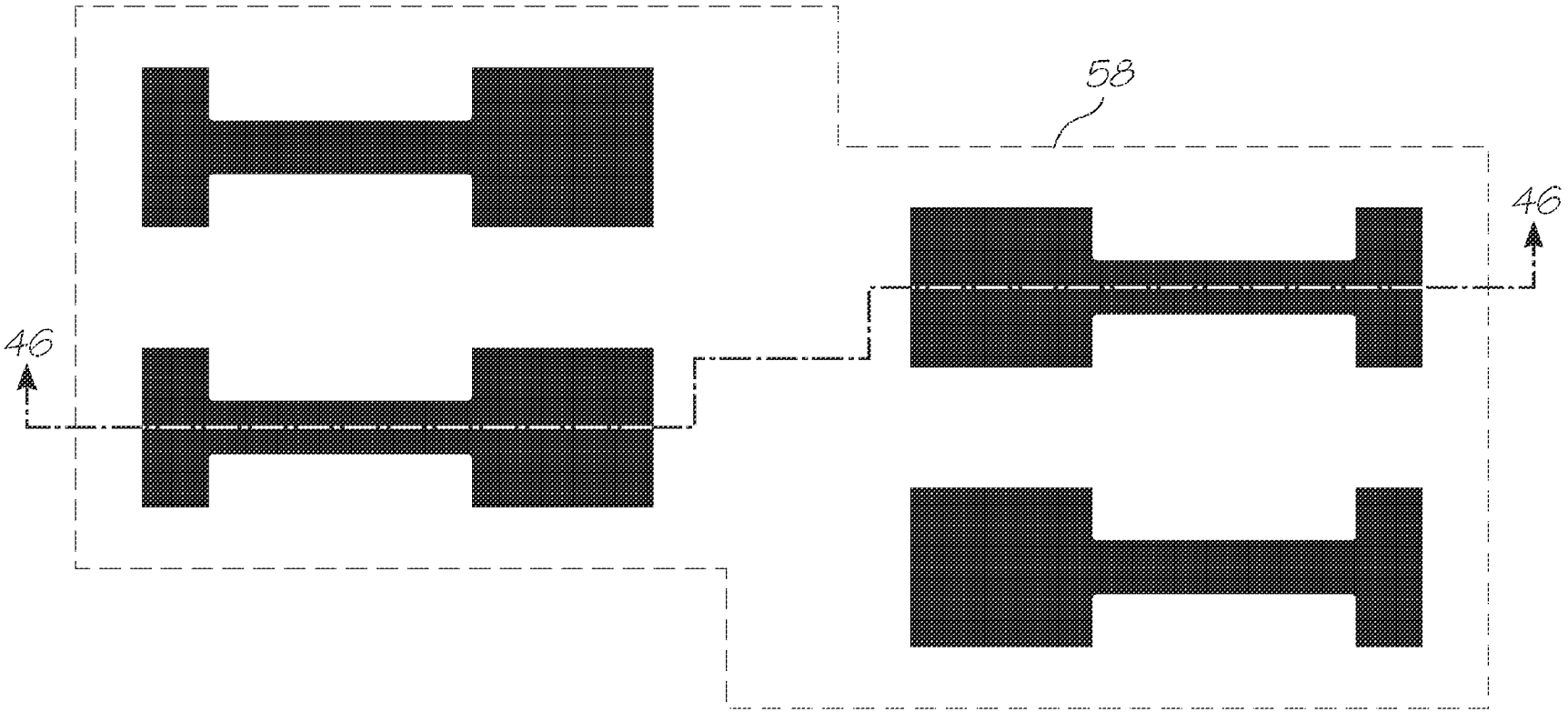
Figure 46:
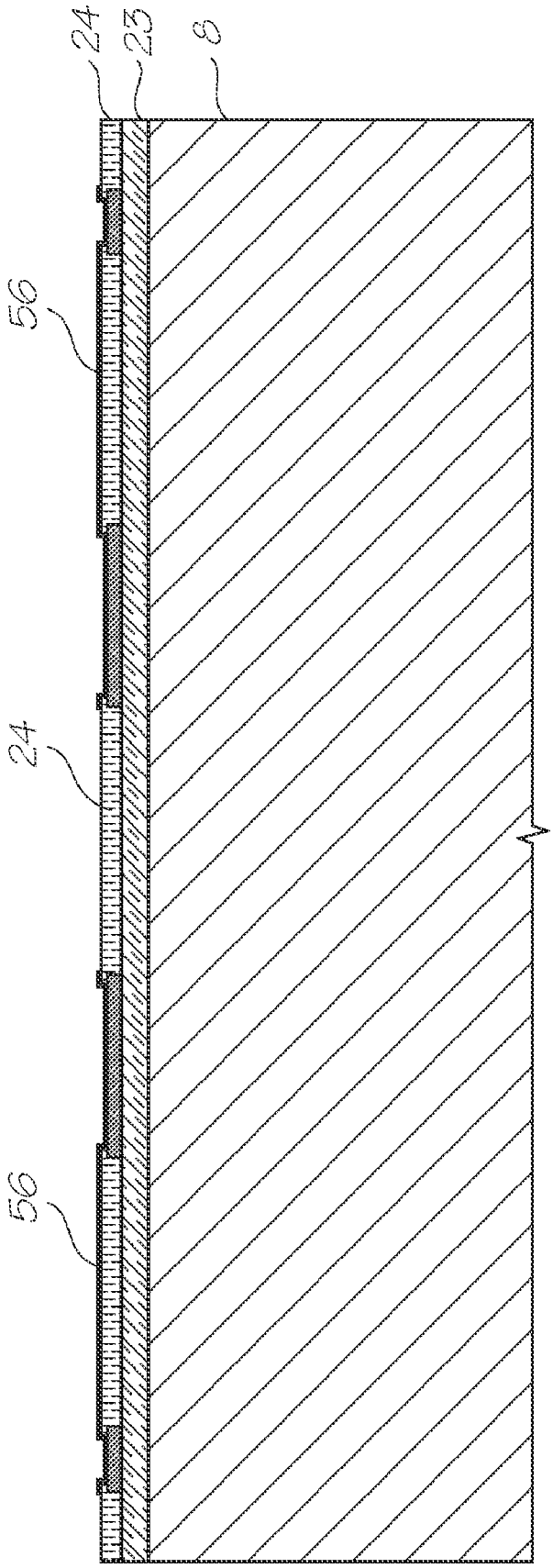

FIGS. 42 and 43 show the deposition of a 0.2 micron layer of heater material 56. Suitable heater materials, such as TiAl, TiAlN and Inconel™ 718, are discussed elsewhere in the specification. As shown in FIGS. 44 and 46, the heater material layer 56 is patterned using the mask 58 shown in FIG. 45. As with the previous step, a photoresist layer (not shown) is exposed through the mask 58 and developed. It will be appreciated that mask 58 is a clear tone mask, in that the clear areas indicate where the underlying material is exposed to UV light and removed with developing solution. Then the unnecessary heater material layer 56 is etched away leaving only the heaters. Again, the remaining photoresist is ashed with $O_2$ plasma.

Figure 47:
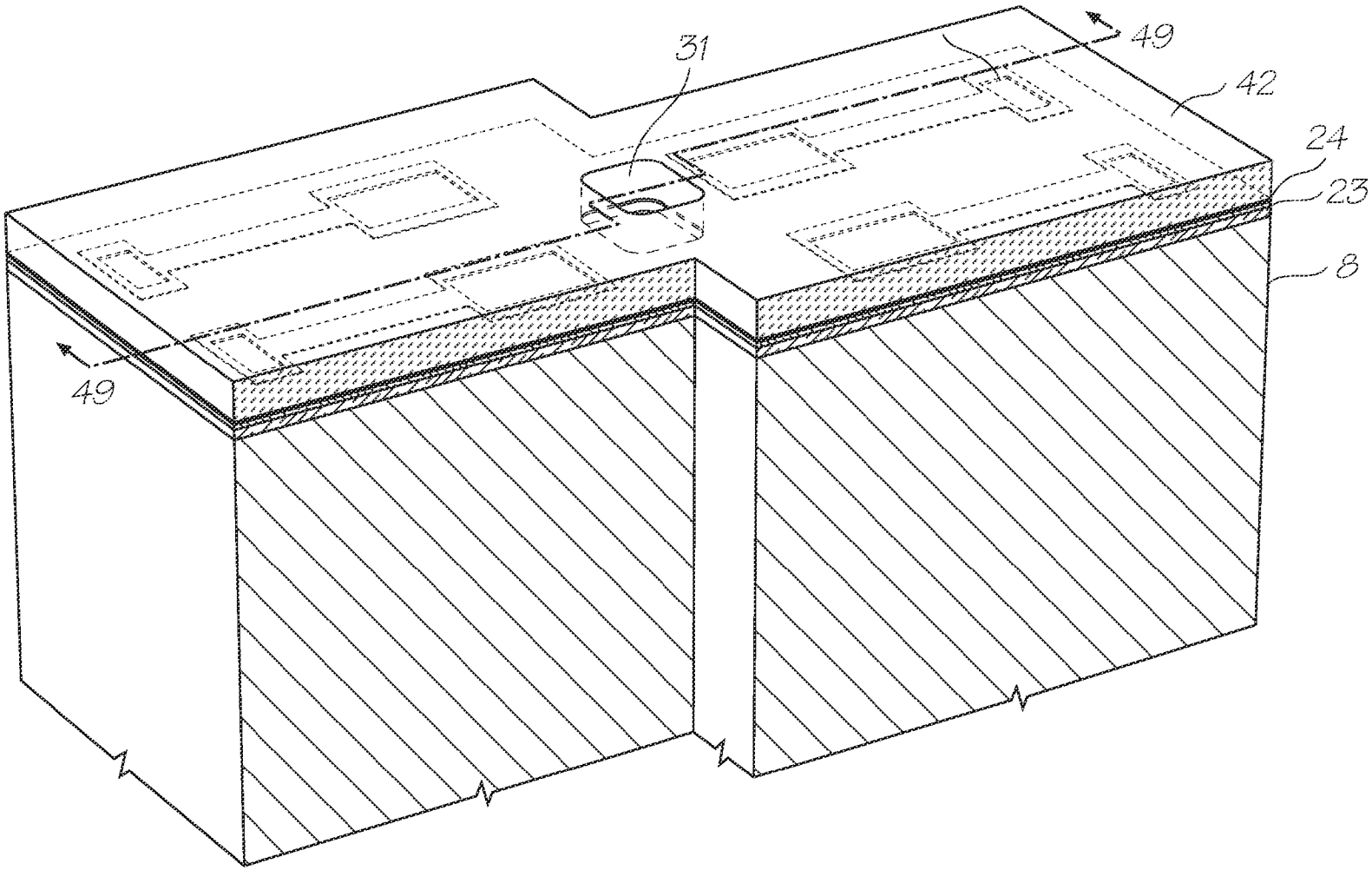
FIGS. 47, 48 and 49 are a perspective, mask and section view respectively showing the deposition of a photoresist layer and subsequent etch for the dielectric etch of the front ink hole.
Figure 48:
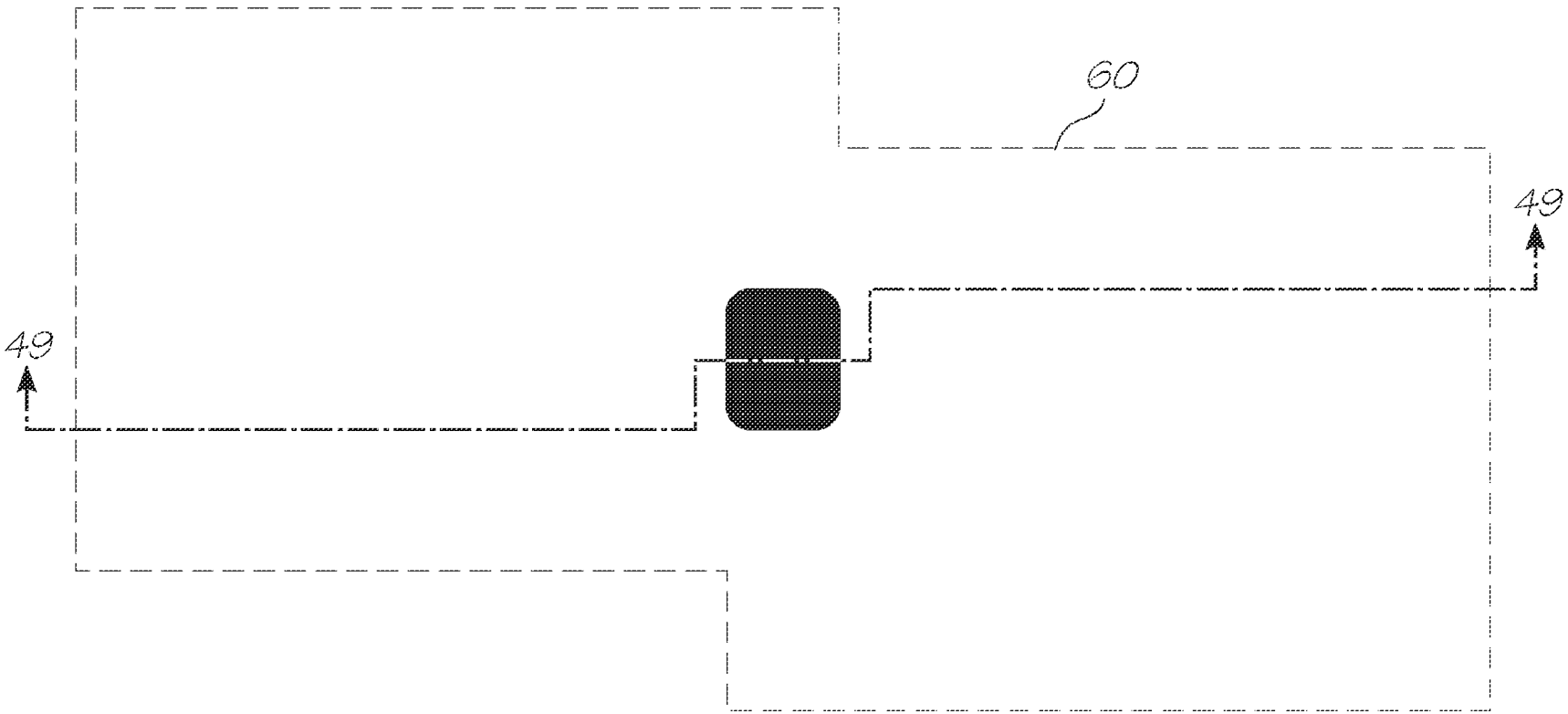
Figure 49:
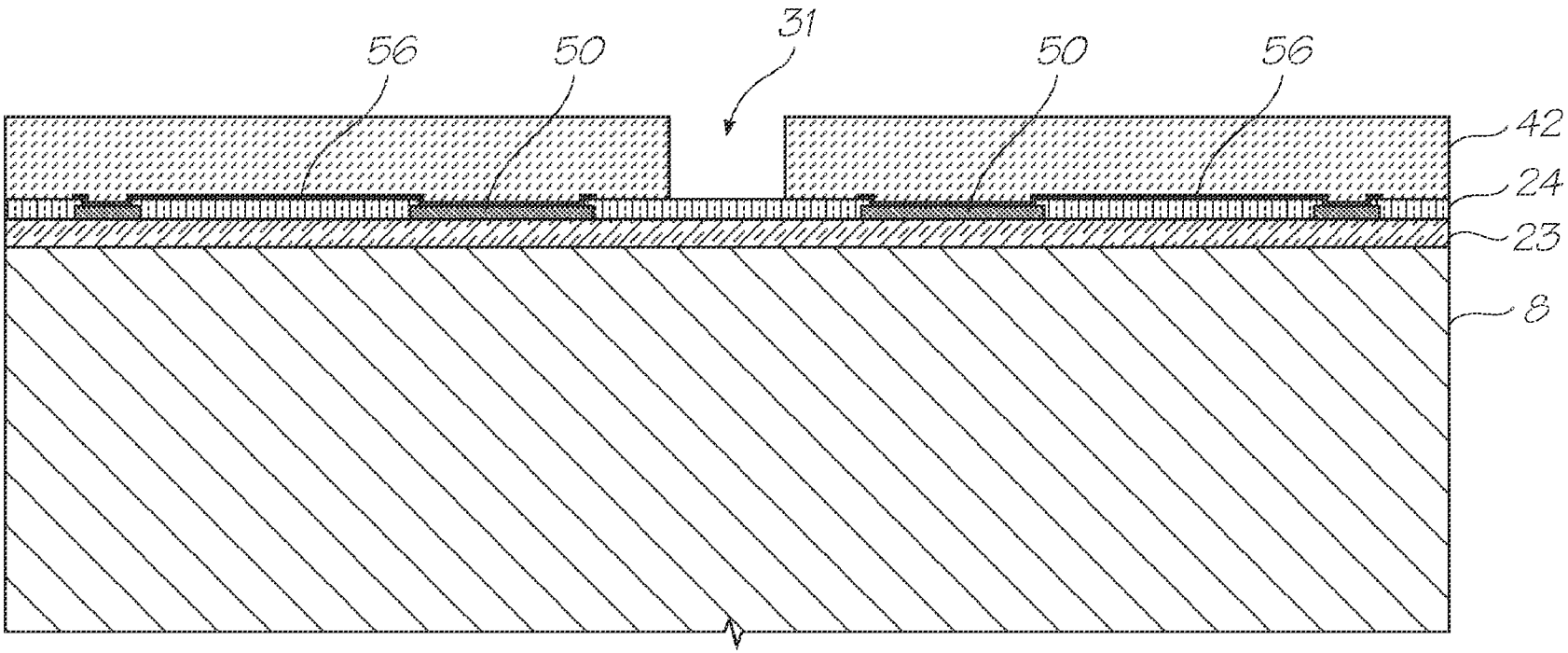

After this, a layer photoresist 42 is again spun onto the wafer 8 as shown in FIG. 47. The dark tone mask 60 (dark areas block the UV light) shown in FIG. 48, exposes the resist which is then developed and removed to define the position of the ink inlet 31 on the passivation layer 24. As shown in FIG. 49, the removal of the resist 42 at the site of the ink inlet 31 exposes the passivation layer 24 in preparation for the dielectric etch.

Figure 50:
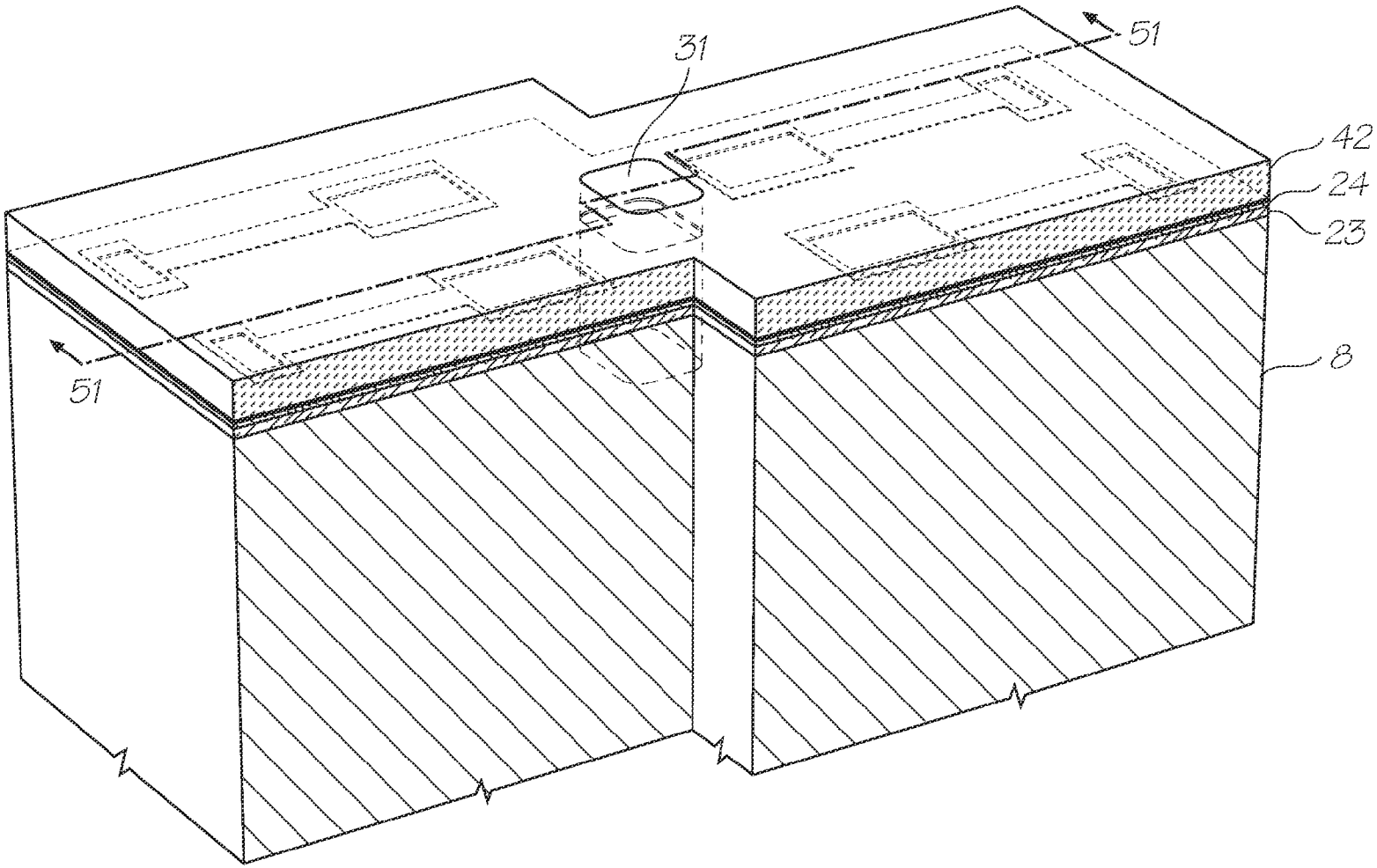
FIGS. 50 and 51 are a perspective and section view respectively showing the dielectric etch into the wafer for the front ink hole.
Figure 51:
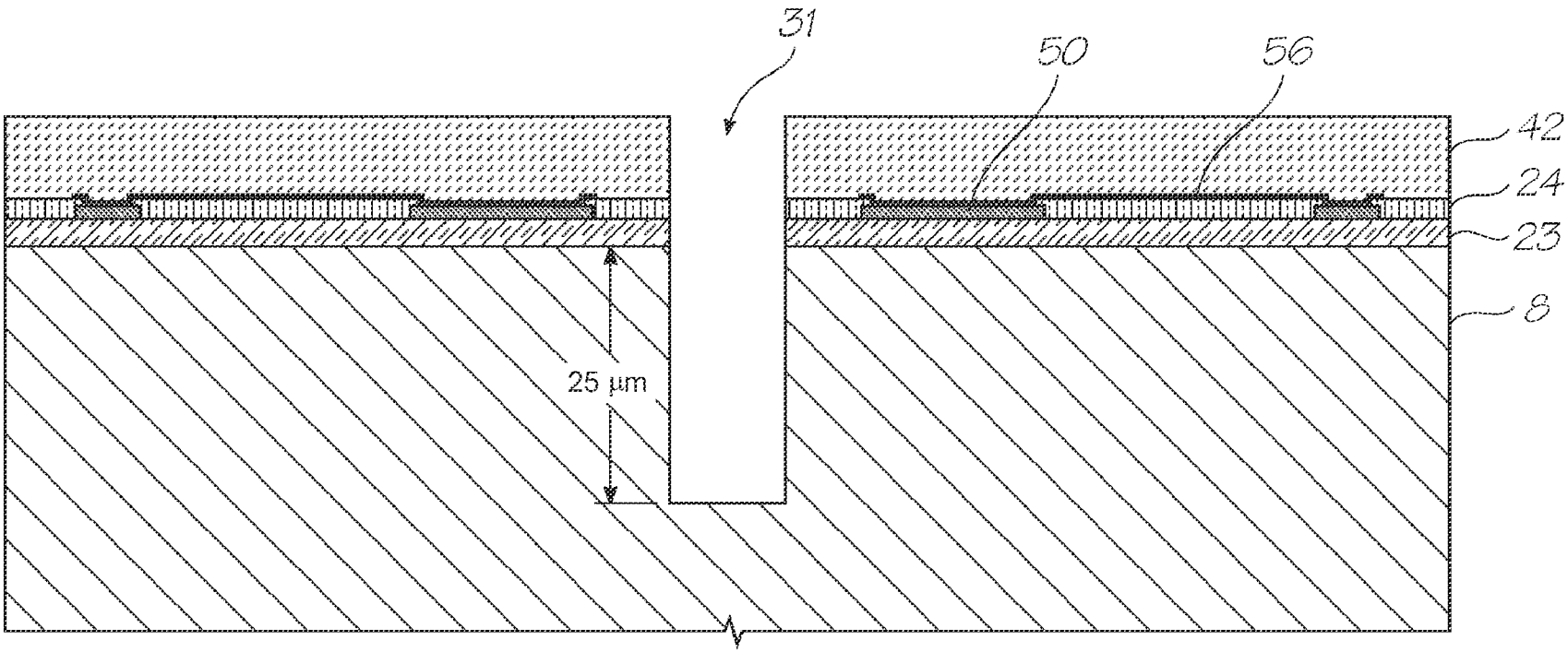

FIGS. 50 and 51 shows the dielectric etch through the passivation layer 24, the CMOS interconnect layers 23 and into the underlying wafer 8. This is a deep reactive ion etch (DRIE) using any standard CMOS etcher (e.g. Applied Materials Centura DPS (Decoupled Plasma Source) Etcher), and extends about 20 microns to 30 microns into the wafer 8. In the embodiment shown, the front side ink inlet etch is about 25 microns deep. The accuracy of the front side etch is important as the backside etch (described below) must be deep enough to reach it in order to establish an ink flow path to the nozzle chamber. After the front side etch of the ink inlet 31, the photoresist 42 is ashed away with $O_2$ plasma (not shown).

Figure 52:
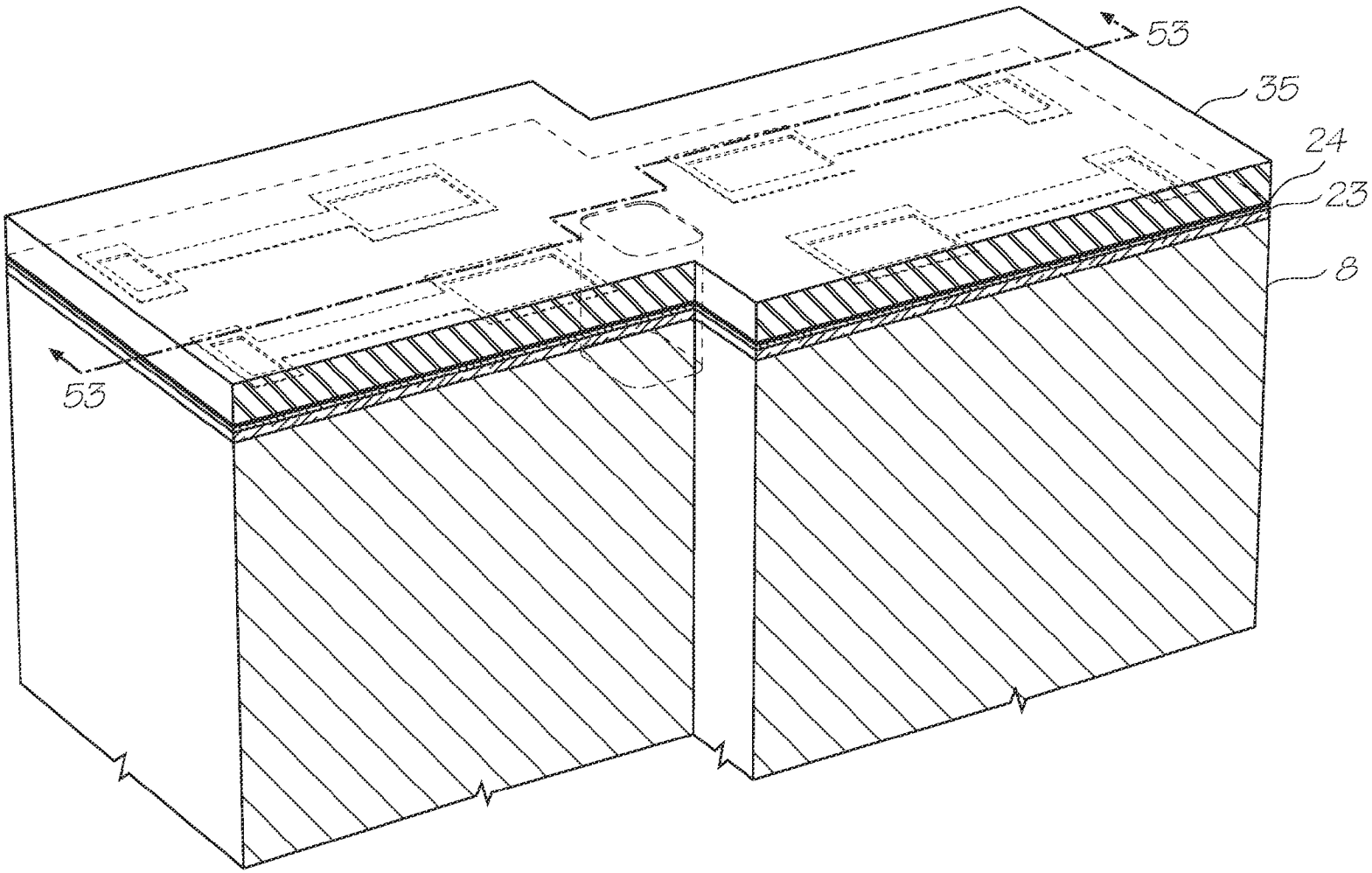
FIGS. 52 and 53 are a perspective and section view respectively showing the deposition of a new photoresist layer.
Figure 53:
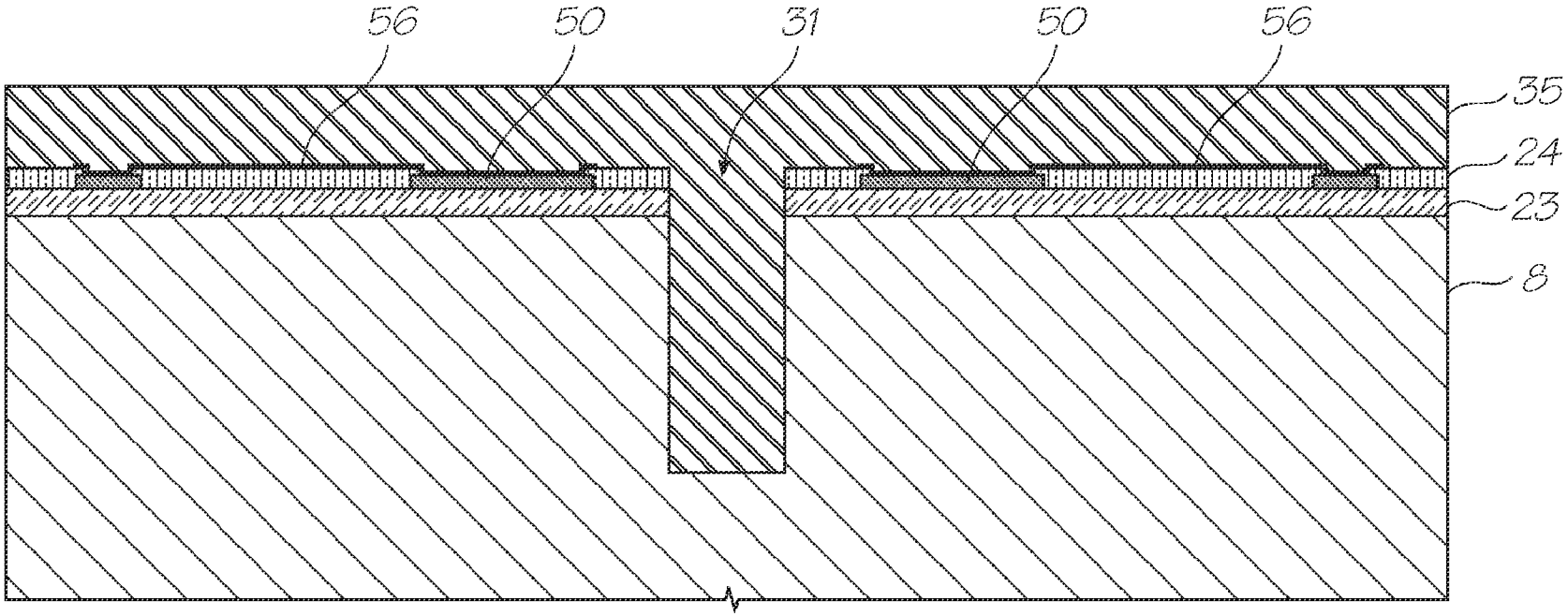
Figure 54:
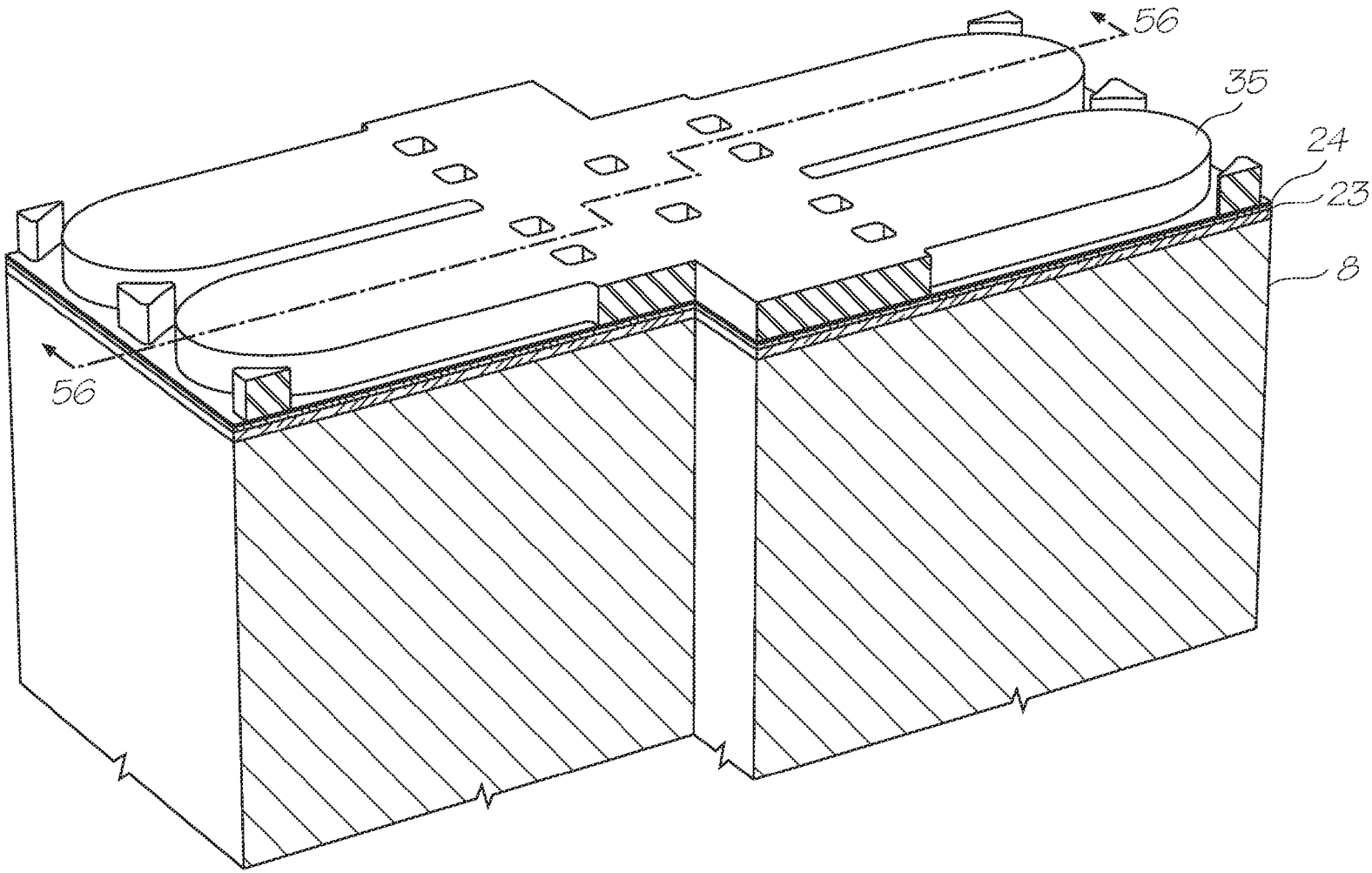
FIGS. 54, 55 and 56 are a perspective, mask and section view respectively showing the patterning of the photoresist layer.
Figure 55:
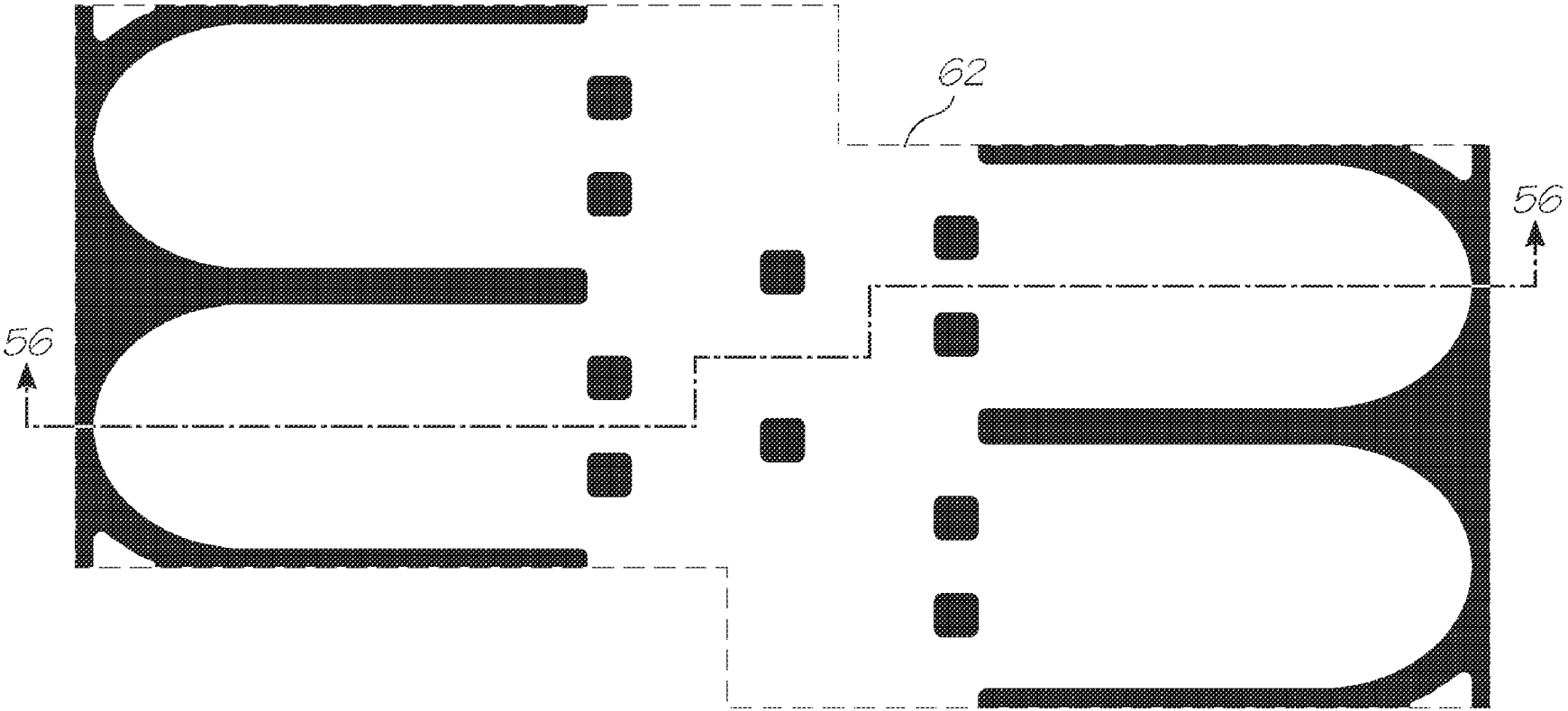
Figure 56:
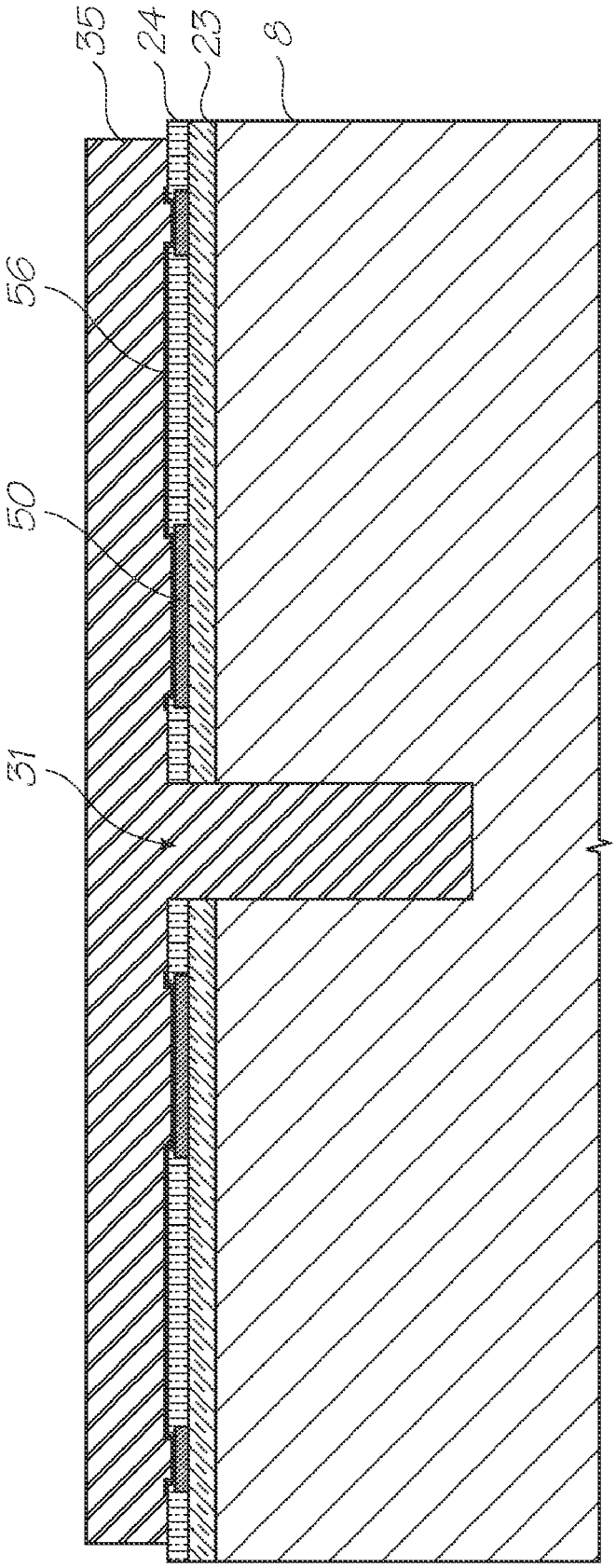
Figure 57:
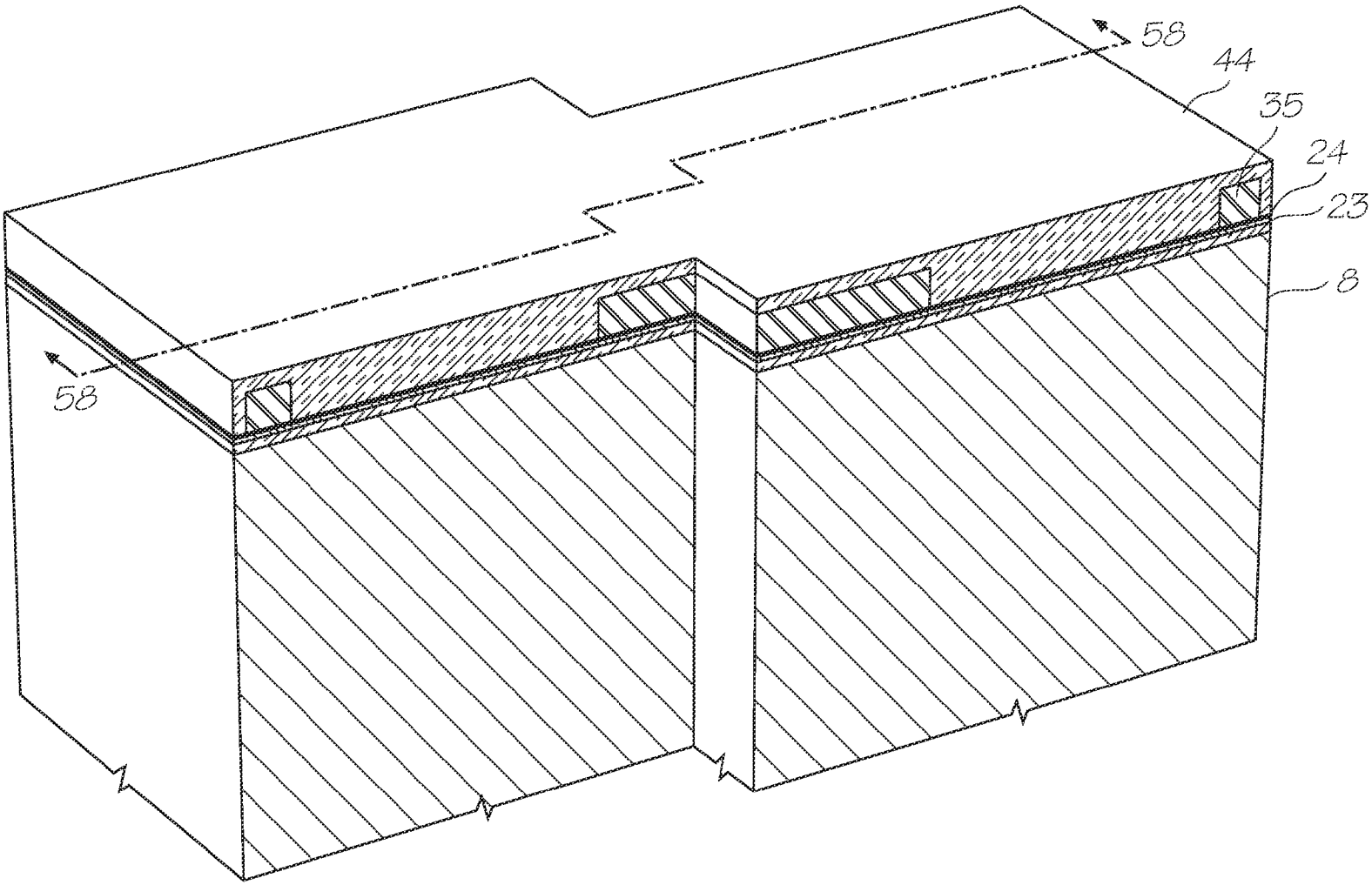
FIGS. 57 and 58 are a perspective and section view respectively showing the deposition of the roof layer.
Figure 58:
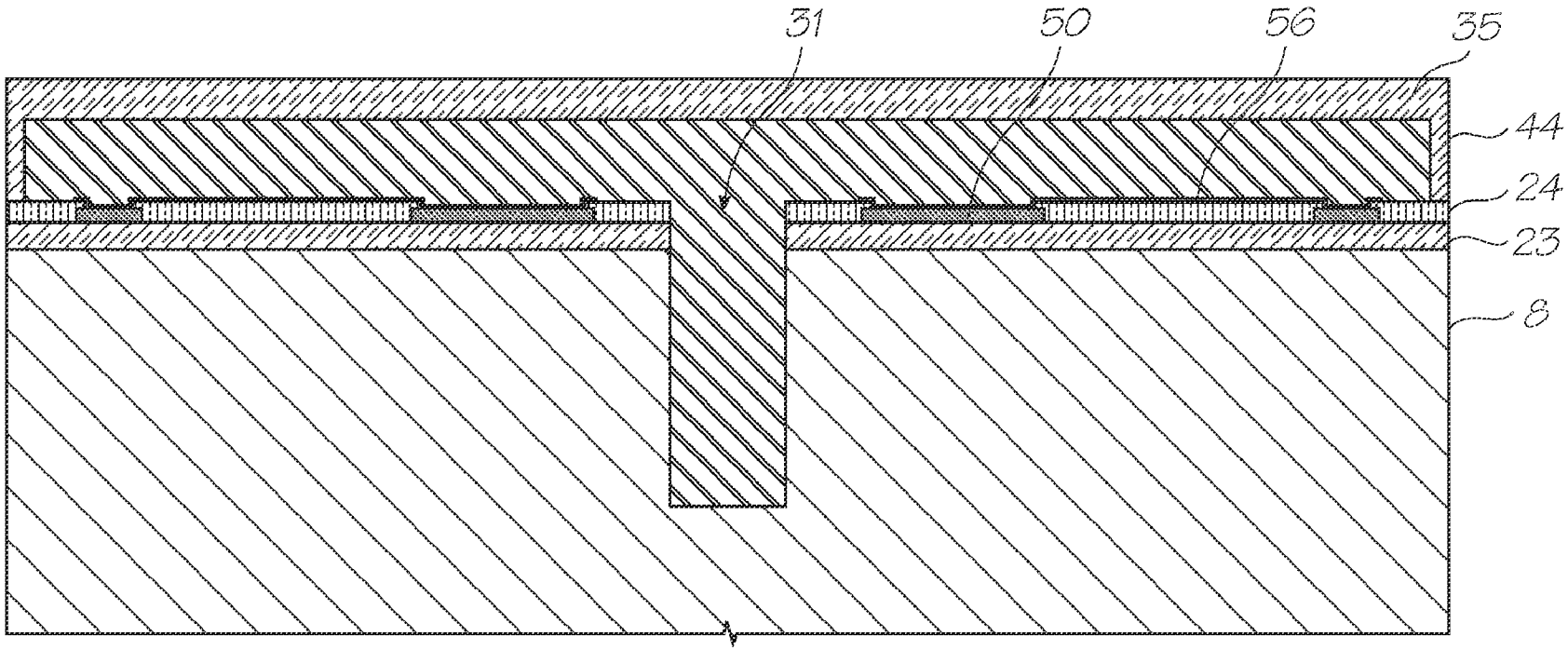

Once the photoresist layer 42 is removed, another layer of photoresist 35 is spun onto the wafer as shown in FIGS. 52 and 53. The thickness of this layer is carefully controlled as it forms a scaffold for the subsequent deposition of the chamber roof material (described below). In the present embodiment, the photoresist layer 35 is 8 microns thick (except where it plugs the ink inlet 31 as best shown in FIG. 53). Next the photoresist layer 35 is patterned according to the mask 62 shown in FIG. 55. The mask is a clear tone mask in that the dark areas indicate the areas of exposure to UV light. The exposed photoresist is developed and removed so that the layer 35 is patterned in accordance with FIG. 54. FIG. 56 is a section view of the patterned photoresist layer 35.

With the photoresist 35 defining the chamber roof and support walls, a layer of roof material, such as silicon nitride, is deposited onto the sacrificial scaffolding. In the embodiment shown in FIGS. 57 and 58, the layer of roof material 44 is 3 microns thick (except at the walls or column features).

Figure 59:
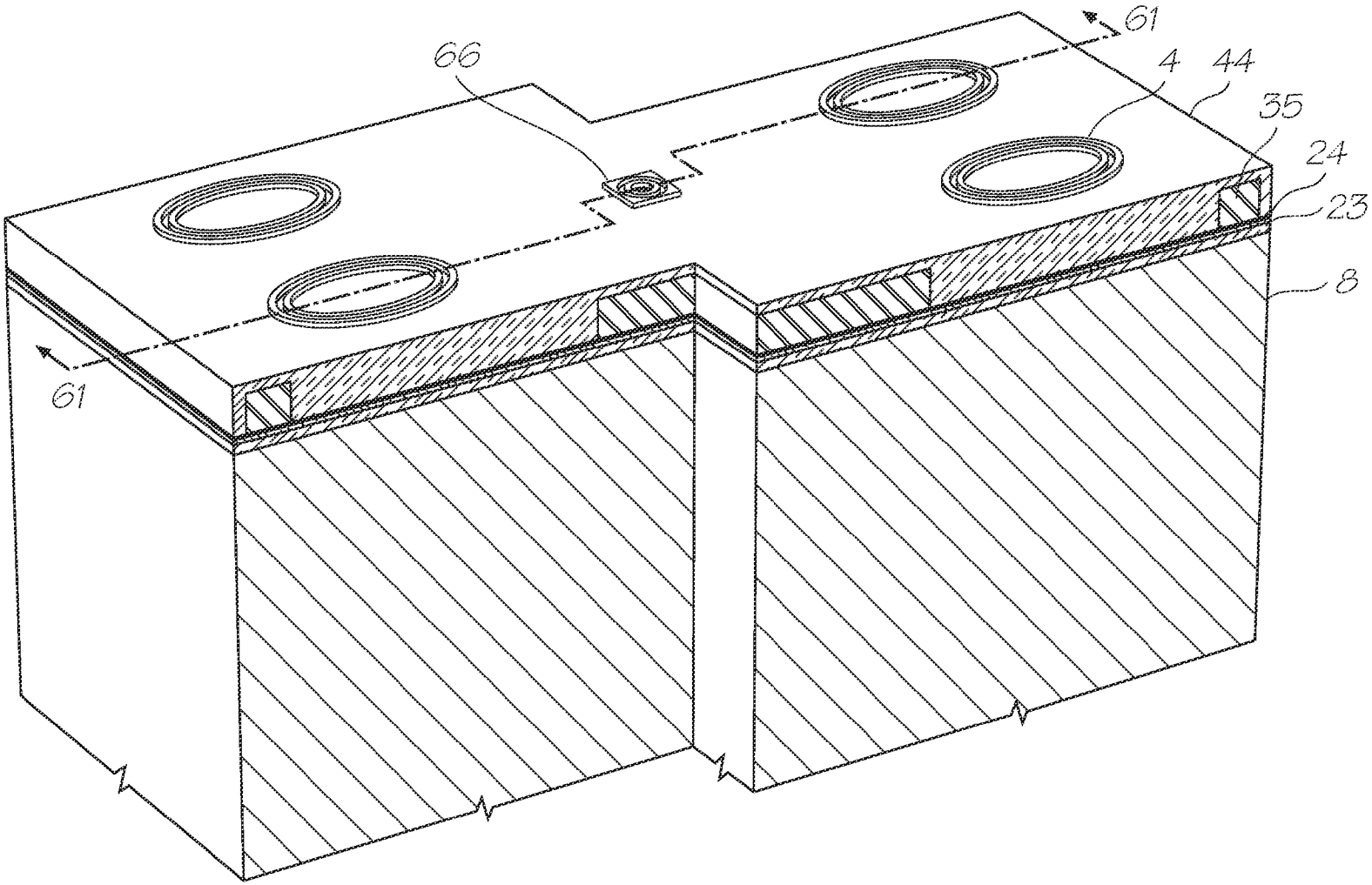
FIGS. 59, 60 and 61 are a perspective, mask and section view respectively showing the etch of the nozzle rims into the roof layer.
Figure 60:
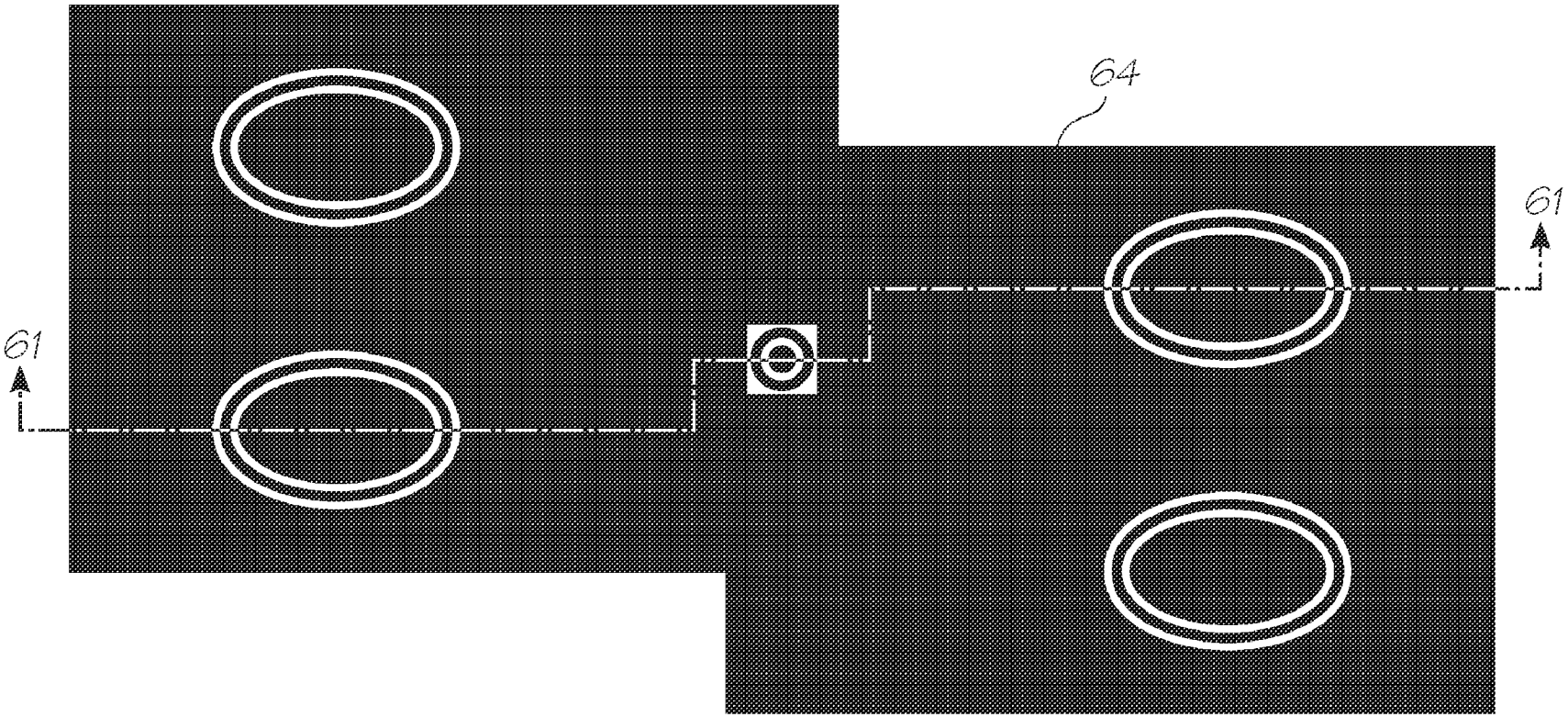
Figure 61:
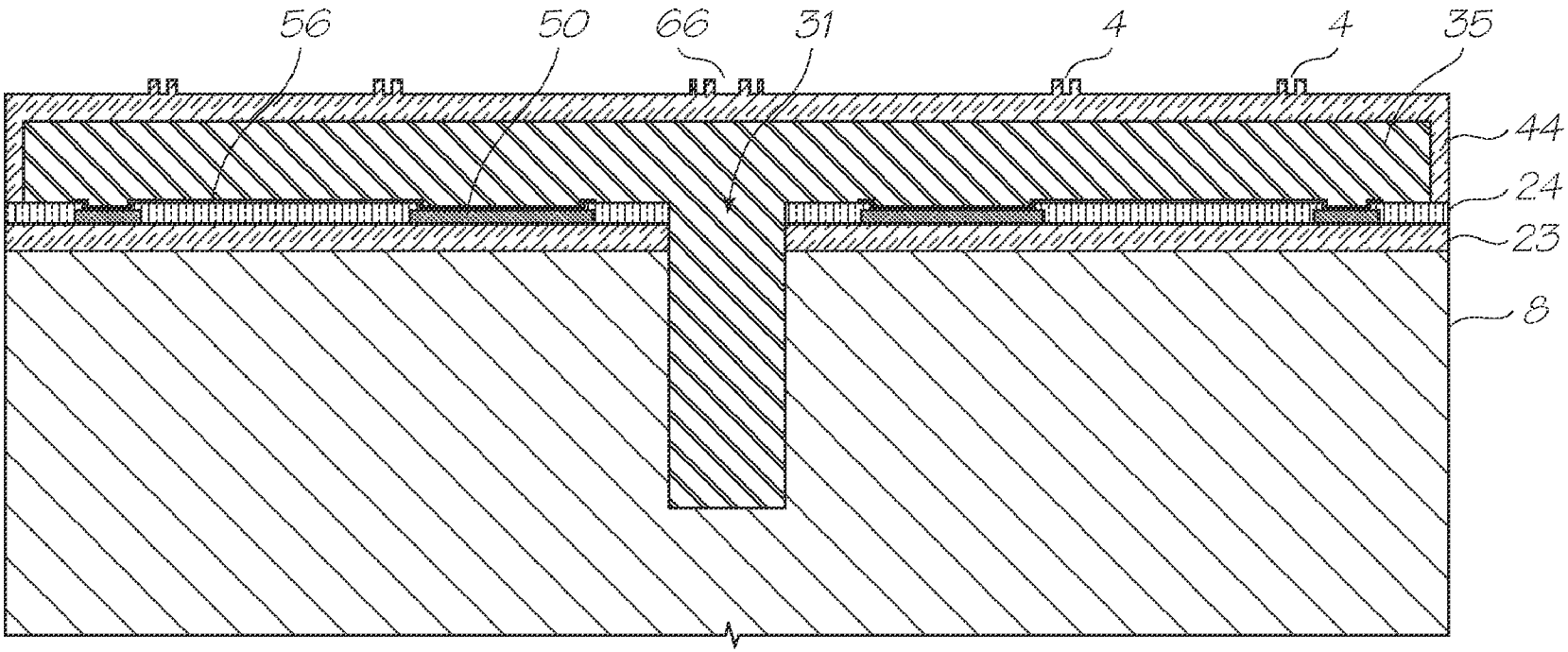

FIGS. 59, 60 and 61 show the etching of the nozzle rims 4. A layer of photoresist (not shown) spun onto the roof layer 44 and expose under the clear tone mask 64 (the dark areas are exposed to UV). The roof layer 44 is then etched to a depth of 2 microns leaving the raised nozzle rims 4 and the bubble vent feature 66. The remaining photoresist is then ashed away.

Figure 62:
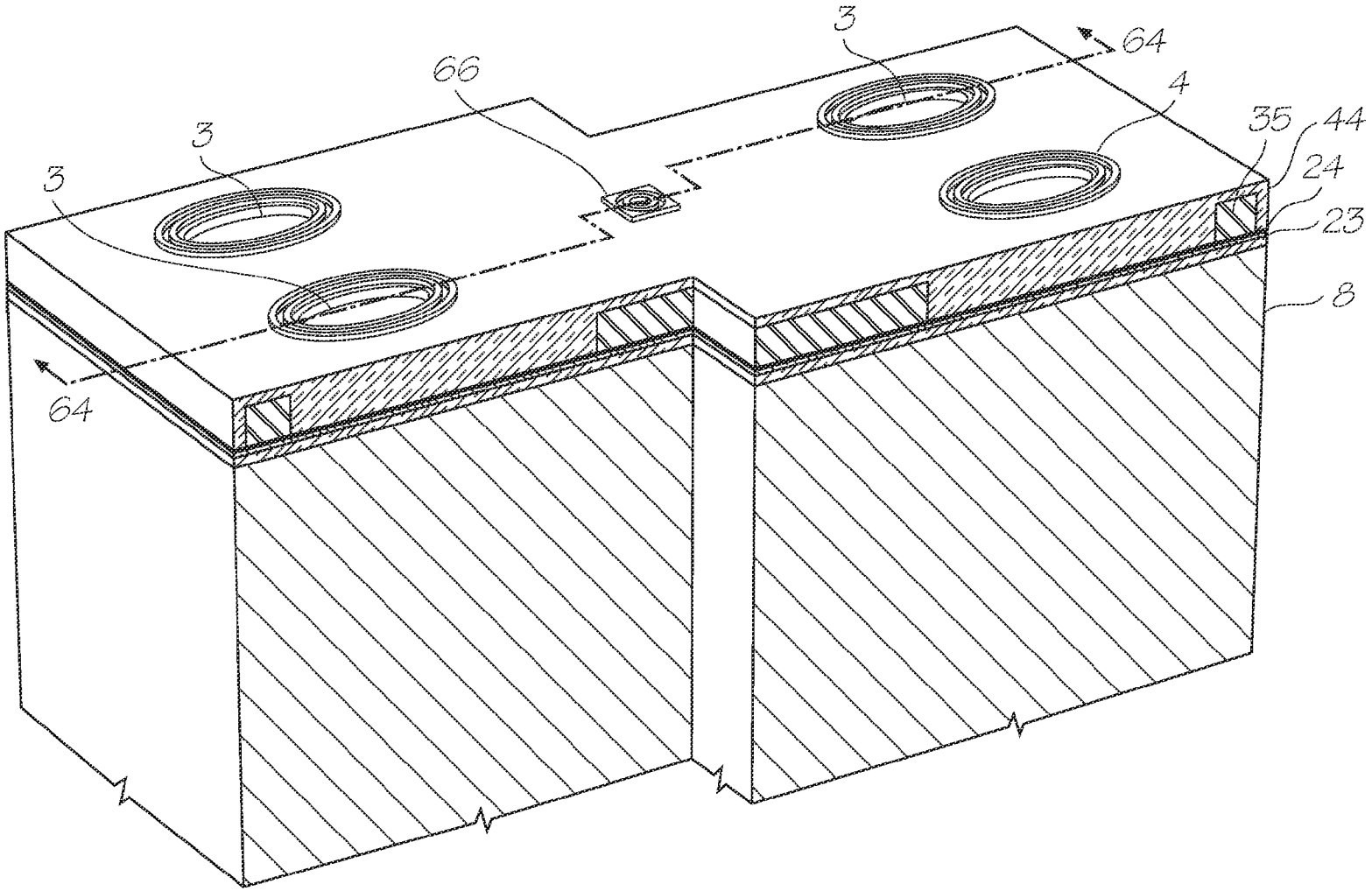
FIGS. 62, 63 and 64 are a perspective, mask and section view respectively showing the etch of the nozzle openings.
Figure 63:
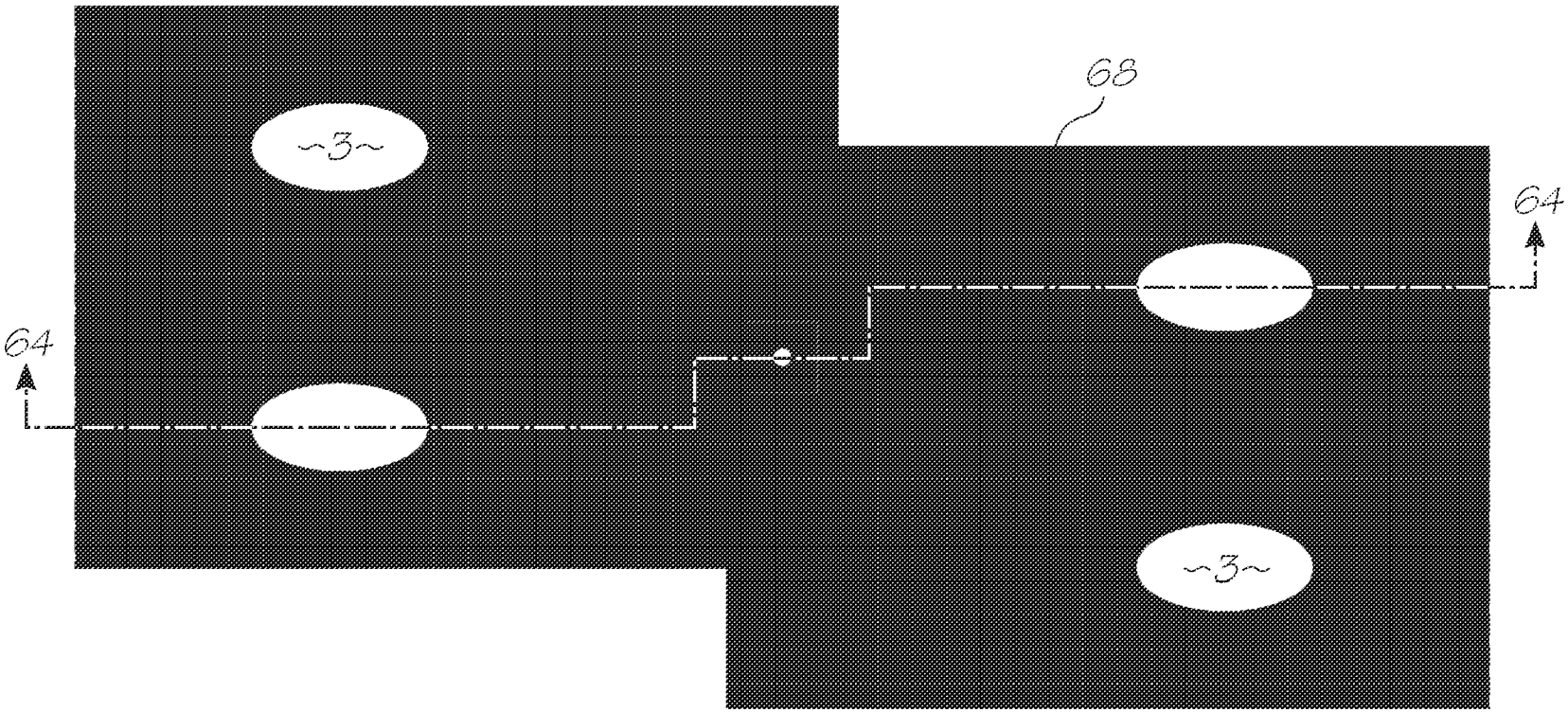
Figure 64:
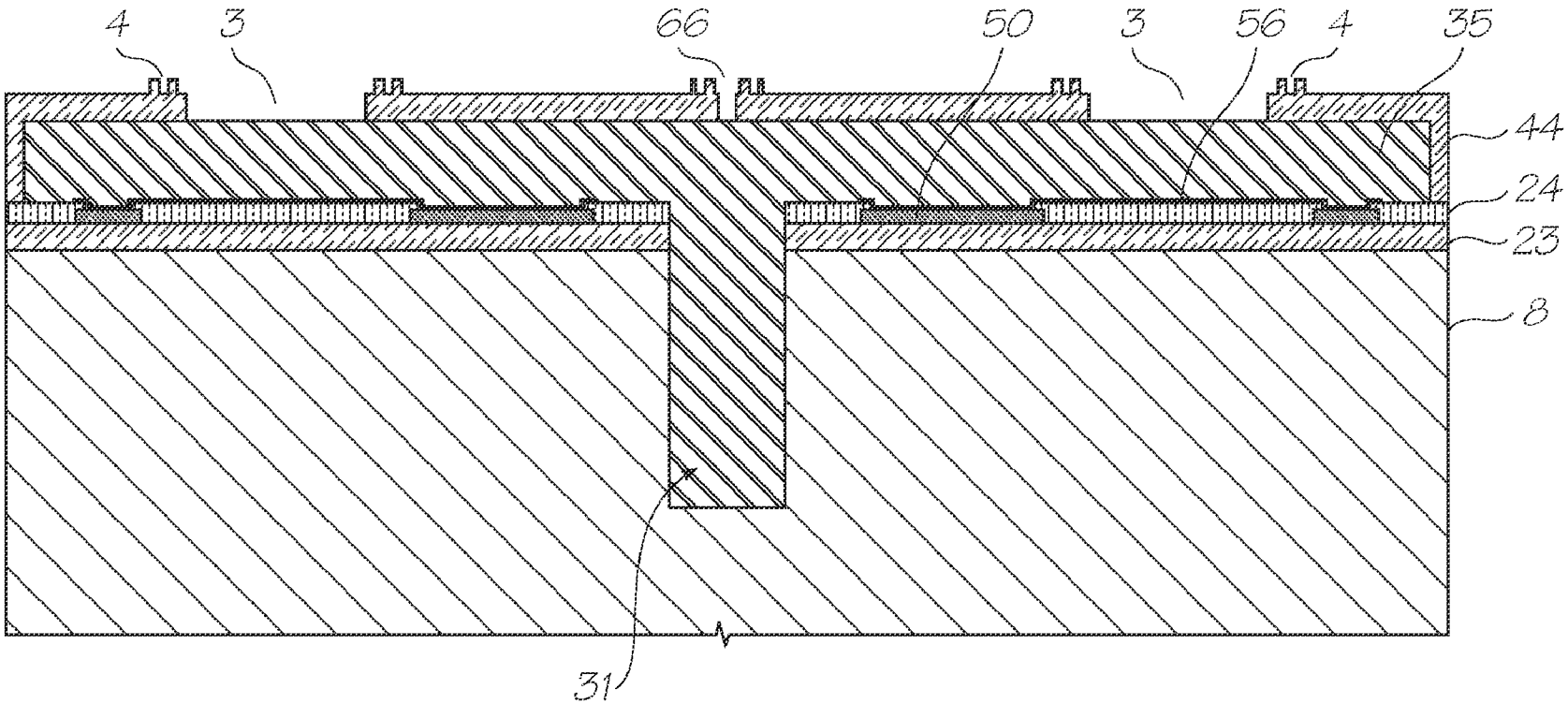

FIGS. 62, 63 and 64 show the nozzle aperture etch through the roof layer 44. Again, a layer of photoresist (not shown) is spun onto the roof layer 44. It the then patterned with the dark tone mask 68 (clear areas exposed) and then developed to remove the exposed resist. The underlying SiN layer is then etched with a standard CMOS etcher down to the underlying layer of photoresist 35. This forms the nozzle apertures 3. The bubble vent hole 66 is also etched during this step. Again the remaining photoresist is removed with $O_2$ plasma.

Figure 65:
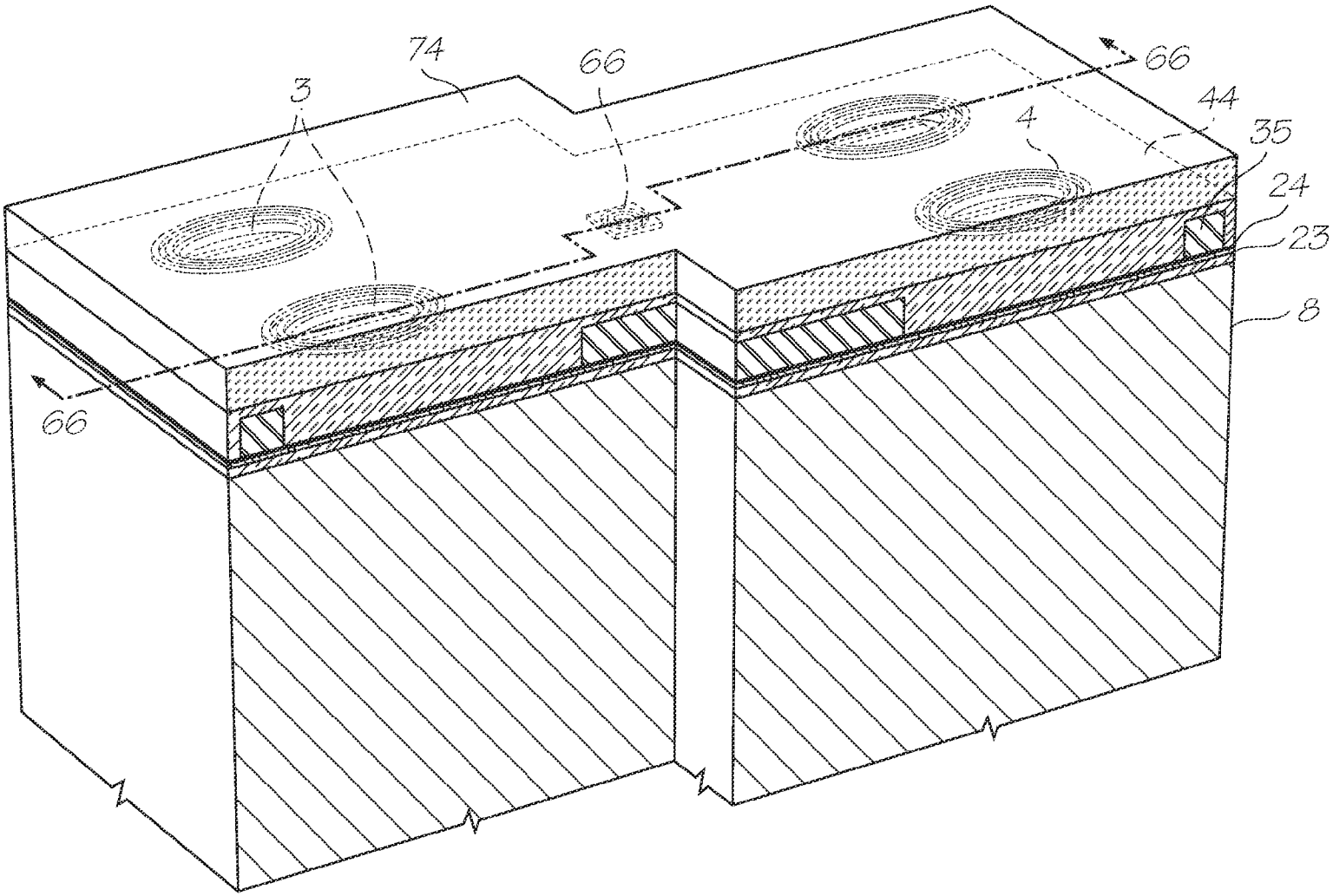
FIGS. 65 and 66 are a perspective and section view respectively showing the deposition of the protective photoresist overcoat.
Figure 66:
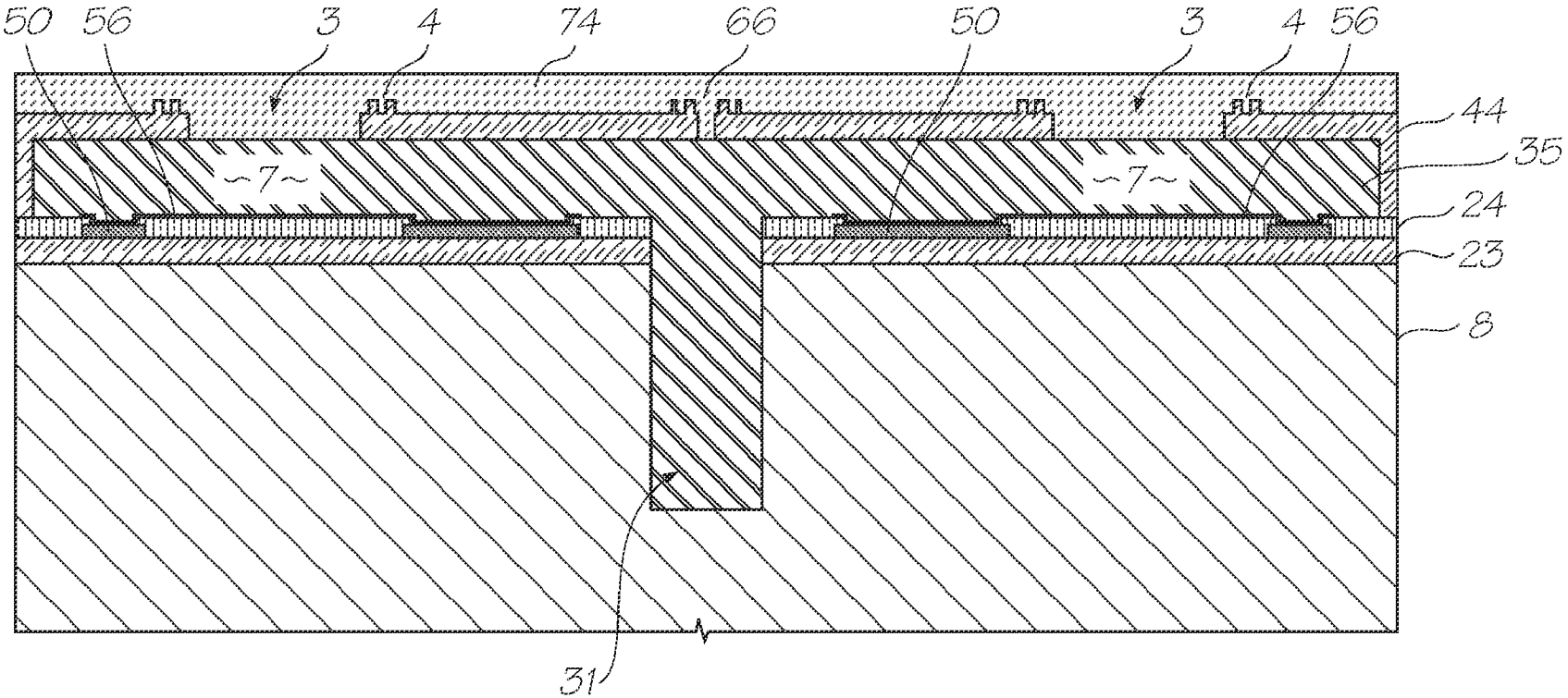
Figure 67:
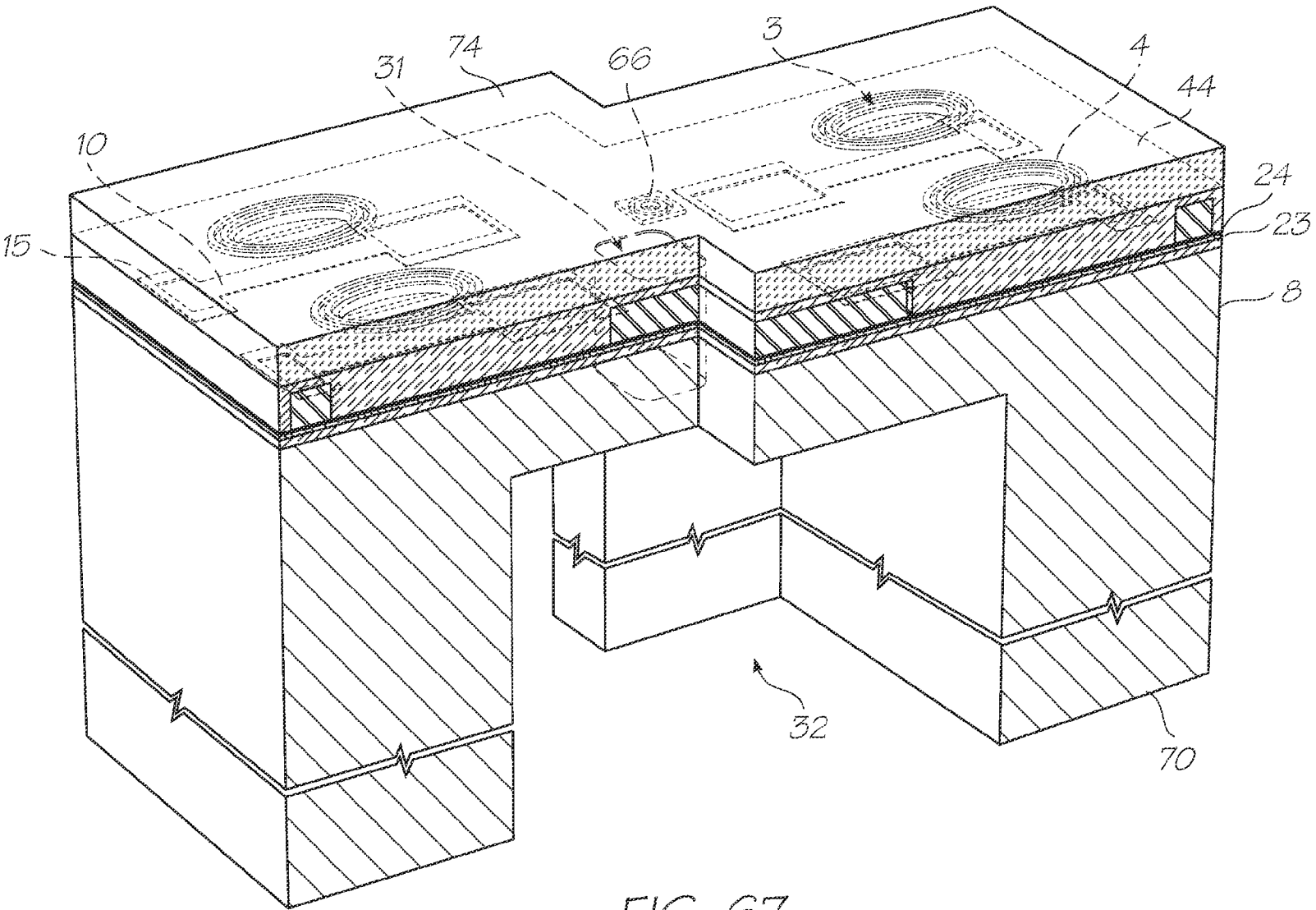
FIGS. 67 and 68 are a perspective and section view respectively showing the back etch of the wafer.
Figure 68:
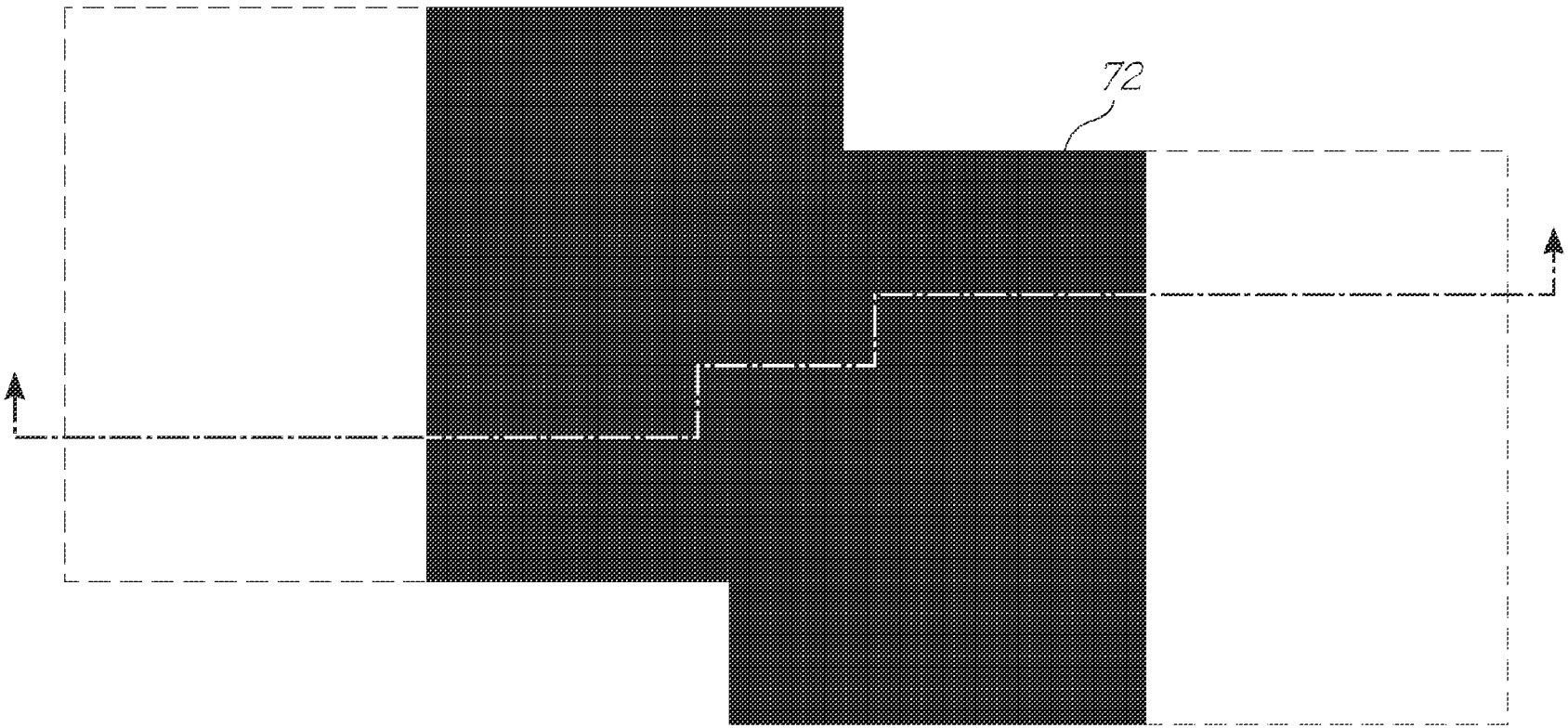

FIGS. 65 and 66 show the application of a protective photoresist overcoat 74. This prevents the delicate MEMS structures from being damaged during further handling. Likewise, the scaffold photoresist 35 is still in place to provide the roof layer 44 with support.

Figure 69:
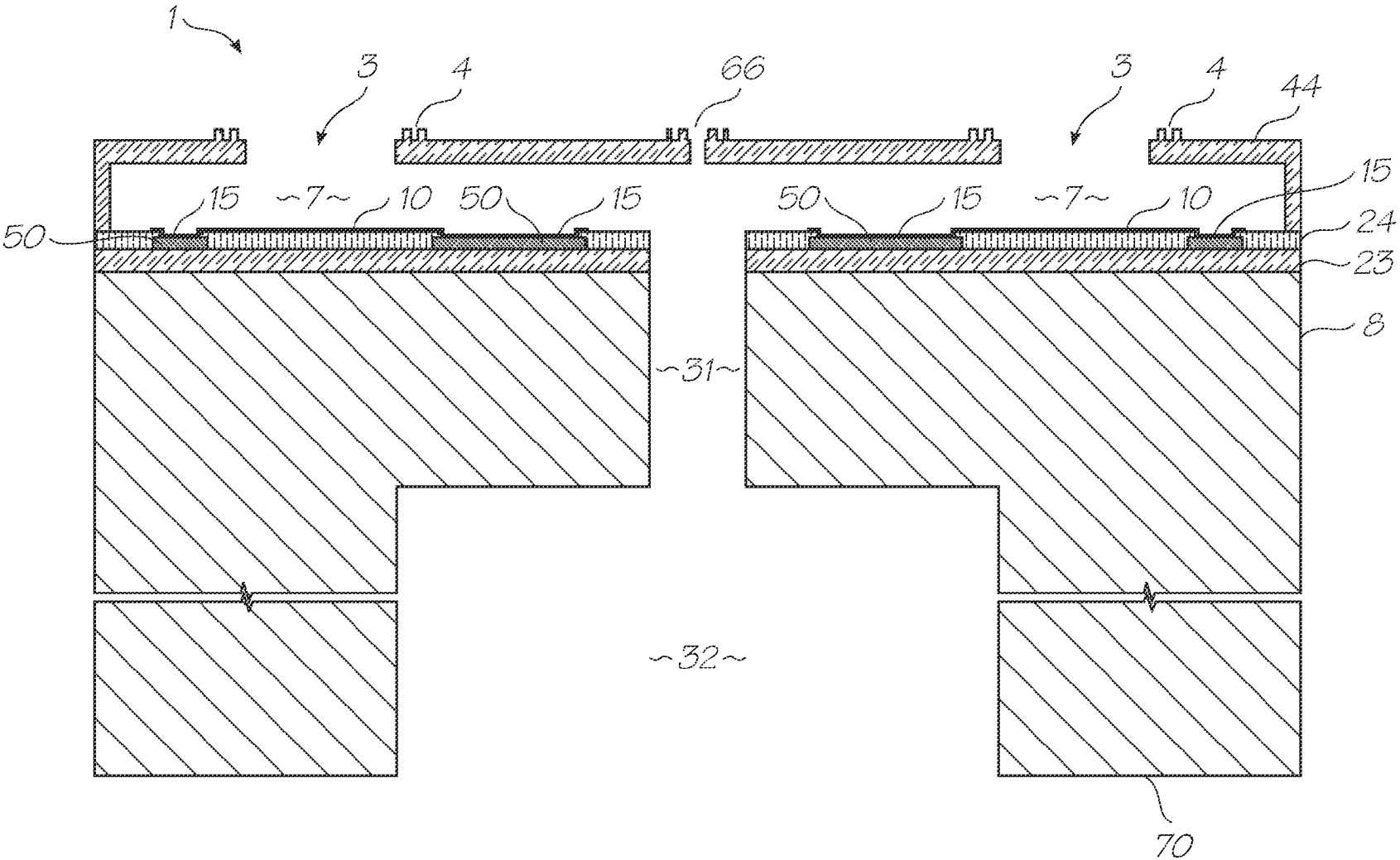
FIG. 69 is a section view showing the release etch removing the remaining photoresist.
Figure 70:
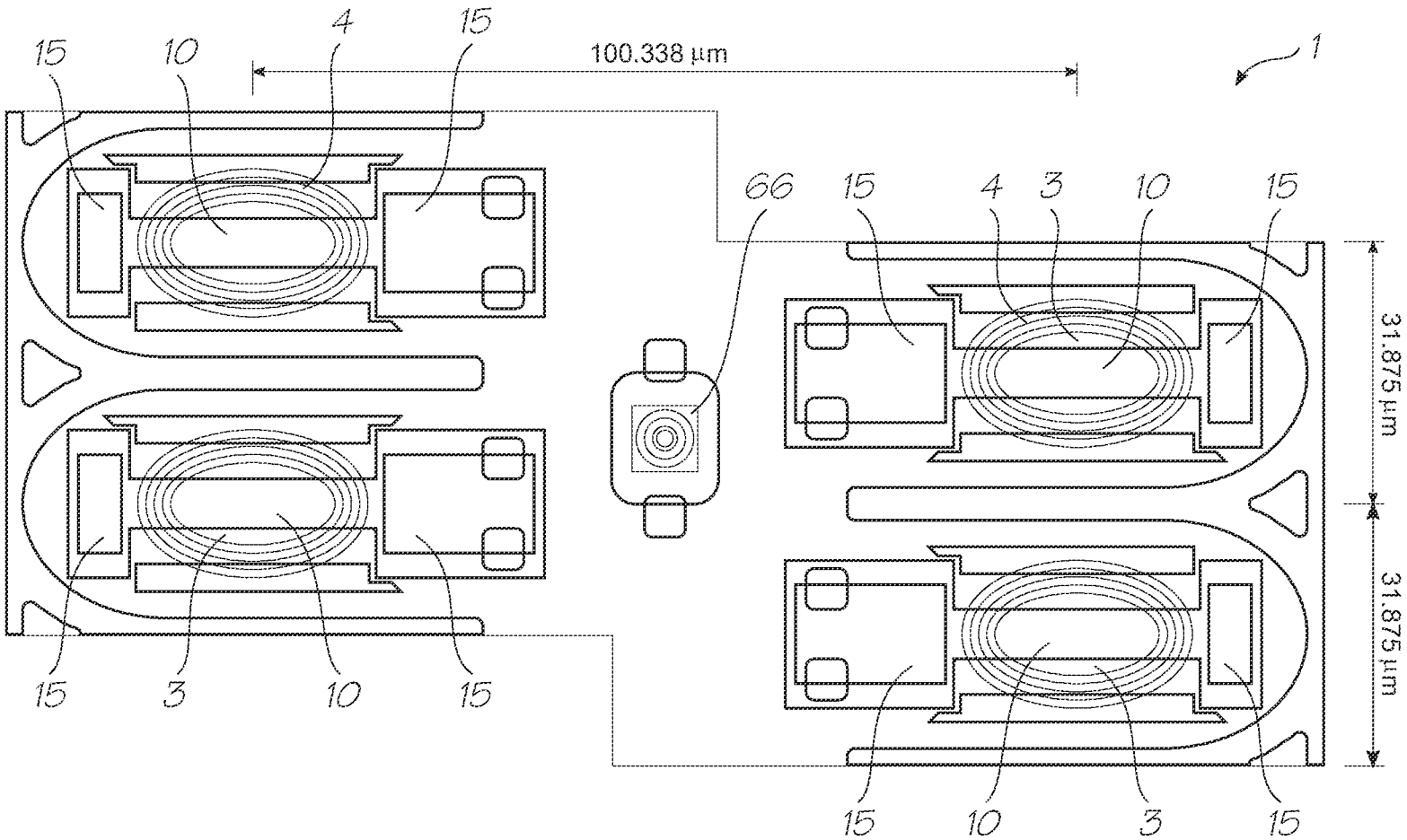
FIG. 70 is plan view of the completed unit cell of the second embodiment; and, FIG. 71 is a Weibull chart showing the reliability of a Inconel™ 718 heater element with a nanocrystalline microstructure compared to a TiAlN heater.

The wafer 8 is then turned over so that the 'backside' 70 (see FIG. 67) can be etched. Then the front side of the wafer 8 (or more specifically, the photoresist overcoat 74) is stuck to a glass handle wafer with thermal tape or similar. It will be appreciated that wafers are initially about 750 microns thick. To reduce the thickness, and therefore the depth of etch needed to establish fluid communication between the front and the back of the wafer, the reverse side 70 of the wafer is ground down until the wafer is about 160 microns thick and then DRIE etched to remove any pitting in the ground surface. The backside is then coated with a photoresist layer (not shown) in preparation for the channel 32 etching. The clear tone mask 72 (shown in FIG. 68) is positioned on the back side 70 for exposure and development. The resist then defines the width of the channel 32 (about 80 microns in the embodiment shown). The channels 32 are then etched with a DRIE (Deep Reactive Ion Etch) down to and marginally beyond the plugged front side ink inlets 31. The photoresist on the backside 72 is then ashed away with $O_2$ plasma, and the wafer 8 is again turned over for the front side ashing of the protective overcoat 74 and the scaffold photoresist 35. FIGS. 69 and 70 show the completed unit cell 1. While FIG. 70 is a plan view, the features obscured by the roof have been shown in full line for the purposes of illustration.

In use, ink is fed from the backside 70 into the channel 32 and into the front side inlet 31. Gas bubbles are prone to form in the ink supply lines to the printhead. This is due to outgassing where dissolved gasses come out of solution and collect as bubbles. If the bubbles are fed into the chambers 7 with the ink, they can prevent ink ejection from the nozzles. The compressible bubbles absorb the pressure generated by the nucleating bubbles on the heater elements 10 and so the pressure pulse is insufficient to eject ink from the aperture 3. As the ink primes the chambers 7, any entrained bubbles will tend to follow the columnar features on either side of the ink inlet 31 and be pushed toward the bubble vent 66. Bubble vent 66 is sized such that the surface tension of the ink will prevent ink leakage, but trapped gas bubbles can vent. Each heater element 10 is enclosed on three sides by chamber walls and by additional columnar features on the fourth side. These columnar features diffuse the radiating pressure pulse to lower cross-talk between chambers 7.

Superalloy Heaters

Superalloys are a class of materials developed for use at elevated temperatures. They are usually based on elements from Group VIIA of the Periodic Table and predominantly used in applications requiring high temperature material stability such as jet engines, power station turbines and the like. Their suitability in the thermal inkjet realm has until now gone unrecognized. Superalloys can offer high temperature strength, corrosion and oxidation resistance far exceeding that of conventional thin film heaters (such as tantalum aluminium, tantalum nitride or hafnium diboride) used in known thermal inkjet printheads. The primary advantage of superalloys is that they can have sufficient strength, oxidation and corrosion resistance to allow heater operation without protective coatings, so that the energy wasted in heating the coatings is removed from the design—as discussed in the parent specification U.S. Ser. No. 11/097,308.

Figure 71:
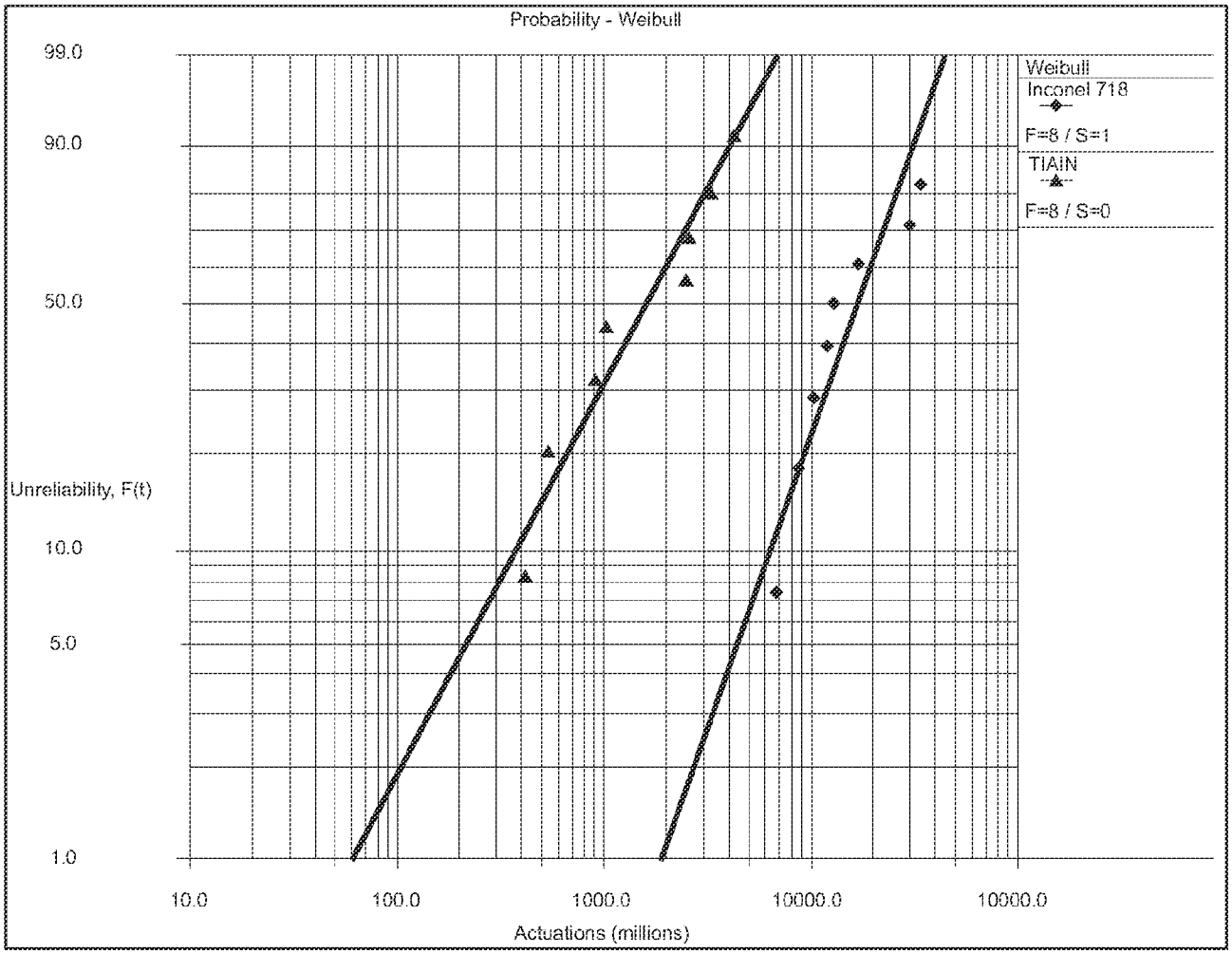

Testing has indicated that superalloys can in some cases have far superior lifetimes compared to conventional thin film materials when tested without protective layers. FIG. 71 is a Weibull Plot of heater reliability for two different heater materials tested in open pool boiling (the heaters are simply actuated in an open pool of water i.e. not within a nozzle). Skilled artisans will appreciate that Weibull charts are a well recognized measure of heater reliability. The chart plots the probability of failure, or unreliability, against a log scale of the number of actuations. It should be noted that the Key shown in FIG. 71 also indicates the number of failed and suspended data points for each alloy. For example, F=8 below Inconel 718 in the key indicates that eight of the heaters used in the test were tested to the point of open circuit failure, while S=1 indicates that one of the test heaters was suspended or in other words, still operating when the test was suspended. The known heater material, TiAlN is compared with the superalloy Inconel 718. The registered trademark Inconel is owned by Huntington Alloys Canada Ltd 2060 Flavelle Boulevard, Mississauga, Ontario L5K 1Z9 Canada.

The applicant's prior work indicates that oxidation resistance is strongly correlated with heater lifetime. Adding Al to TiN to produce TiAlN greatly increased the heater's oxidation resistance (measured by Auger depth profiling of oxygen content after furnace treatment) and also greatly increased heater lifetime. The Al diffused to the surface of the heater and formed a thin oxide scale with a very low diffusivity for further penetration of oxygen. It is this oxide scale which passivates the heater, protecting it from further attack by an oxidative or corrosive environment, permitting operation without protective layers. Sputtered Inconel 718 also exhibits this form of protection and also contains Al, but has two other advantageous properties that further enhance oxidation resistance; the presence of Cr, and a nanocrystalline structure.

Chromium behaves in a similar fashion to aluminium as an additive, in that it provides self passivating properties by forming a protective scale of chromium oxide. The combination of Cr and Al in a material is thought to be better than either in isolation because the alumina scale grows more slowly than the chromia scale, but ultimately provides better protection The Cr addition is beneficial because the chromia scale provides short term protection while the alumina scale is growing, allowing the concentration of Al in the material required for short term protection to be reduced. Reducing the Al concentration is beneficial because high Al concentrations intended for enhanced oxidation protection can jeopardize the phase stability of the material.

X-ray diffraction and electron microscope studies of the sputtered Inconel 718 showed a crystalline microstructure, with a grain size less than 100 nm (a "nanocrystalline" microstructure). The nanocrystalline microstructure of Inconel 718 is beneficial in that it provides good material strength yet has a high density of grain boundaries. Compared to a material with much larger crystals and a lower density of grain boundaries, the nanocrystalline structure provides higher diffusivity for the protective scale forming elements Cr and Al (more rapid formation of the scale) and a more even growth of the scale over the heater surface, so the protection is provided more rapidly and more effectively. The protective scales adhere better to the nanocrystalline structure, which results in reduced spalling. Further improvement in the mechanical stability and adherence of the scale is possible using additives of reactive metal from the group consisting of yttrium, lanthanum and other rare earth elements.

It should be noted that superalloys are typically cast or wrought and this does not yield a nanocrystalline microstructure: the benefits provided by the nanocrystalline structure are specific to the sputtering technique used in the MEMS heater fabrication of this application. It should also be noted that the benefits of superalloys as heater materials are not solely related to oxidation resistance: their microstructure is carefully engineered with additives to encourage the formation of phases that impart high temperature strength and fatigue resistance. Potential additions comprise the addition of aluminium, titanium, niobium, tantalum, hafnium or vandium to form the gamma prime phase of Ni based superalloys; the addition of iron, cobalt, chrome, tungsten, molybdenum, rhenium or ruthenium to form the gamma phase or the addition of C, Cr, Mo, W, Nb, Ta, Ti to form carbides at the grain boundaries. Zr and B may also be added to strengthen grain boundaries. Controlling these additives, and the material fabrication process, can also act to suppress undesirable age-induced Topologically Close Packed (TCP) phases, such as sigma, eta, mu phases which can cause embrittlement, reducing the mechanical stability and ductility of the material. Such phases are avoided as they may also act to consume elements that would otherwise be available for the favoured gamma and gamma prime phase formation. Thus, while the presence of Cr and Al to provide oxidation protection is preferred for the heater materials, superalloys in general can be considered a superior class of materials from which selection of heater material candidates may be made, since considerably more effort has been put into designing them for high temperature strength, oxidation and corrosion resistance than has been put into improving the conventional thin film heater materials used in MEMS.

The Applicant's results indicate that superalloys:

- a Cr content between 2% by weight and 35% by weight;
- a Al content of between 0.1% by weight and 8% by weight;
- a Mo content of between 1% by weight and 17% by weight;
- a Nb+Ta content of between 0.25% by weight and 8.0% by weight;
- a Ti content of between 0.1% by weight and 5.0% by weight;
- a Fe content of up to 60% by weight;
- a Ni content of between 26% by weight and 70% by weight; and or,
- a Co content of between 35% by weight and 65% by weight;
- are likely to be suitable for use as a thin film heater element within a MEMS bubble generator and warrant further testing for efficacy within the specific device design (e.g. suspended heater element, bonded heater element and so on).

Superalloy's having the generic formula MCrAlX where:

- M is one or more of Ni, Co, Fe with M contributing at least 50% by weight;
- Cr contributing between 8% and 35% by weight;
- Al contributing more than zero but less than 8% by weight; and,
- X contributing less than 25% by weight, with X consisting of zero or more of Mo, Re, Ru, Ti, Ta, V, W, Nb, Zr, B, C, Si, Y, Hf
- provide good results in open pool testing (described above).

In particular, superalloys with Ni, Fe, Cr and Al together with additives comprising zero or more of Mo, Re, Ru, Ti, Ta, V, W, Nb, Zr, B, C, Si, Y, or Hf, show superior results.

Using these criteria, suitable superalloy material for thermal inkjet printhead heaters may be selected from:

INCONEL™ Alloy 600, Alloy 601, Alloy 617, Alloy 625, Alloy 625LCF, Alloy 690, Alloy 693, Alloy 718, Alloy X-750, Alloy 725, Alloy 751, Alloy MA754, Alloy MA758, Alloy 783, Alloy 925, or Alloy HX;

INCOLOY™ Alloy 330, Alloy 800, Alloy 800H, Alloy 800HT, Alloy MA956, Alloy A-286, or Alloy DS;

NIMONIC™ Alloy 75, Alloy 80A, or Alloy 90;

BRIGHTRAY® Alloy B, Alloy C, Alloy F, Alloy S, or Alloy 35; or,

FERRY® Alloy or Thermo-Span® Alloy

Brightray, Ferry and Nimonic are the registered trademarks of Special Metals Wiggin Ltd Holmer Road HEREFORD HR4 9FL UNITED KINGDOM.

Thermo-Span is a registered trademark of CRS holdings Inc., a subsidiary of Carpenter Technology Corporation.

Titanium Aluminium Alloy Heaters

Titanium aluminium (TiAl) alloys exhibit superior strength, low creep and light weight; properties which have seen these alloys widely used in the aeronautical and automotive industries. It's resistance to oxidation at extremely high temperatures makes it a suitable refractory coating for furnaces, kilns and the like (see "Oxidation Resistance of Refractory γ-TiAlW Coatings", L. Kaczmarck et al. Surface & Coatings Technology 201 (2007) 6167-6170).

The Applicant's work has revealed that TiAl is also well suited to use as heater material in inkjet printheads. The alloy can provide surface oxide that is a uniform, thin and dense coating of predominantly $Al_2O_3$ and very little $TiO_2$. $Al_2O_3$ has low oxygen diffusivity while $TiO_2$ has a much higher diffusivity. Accordingly, the native (i.e. naturally forming) oxide layer passivates the heater to guard against oxidative failure while remaining thin enough not thermally insulate the heater from the ink. This preserves the low energy ejection of drops that is necessary for large (pagewidth), high density nozzle arrays, without compromising the operational life of the heater. Tests using a 0.2 micron thick TiAl heater have achieved 180 millions ejections with good print quality.

Other elements can be added to the alloy to further suppress the formation of $TiO_2$ and/or increase Al diffusivity to the heater surface (and therefore preferential formation of $Al_2O_3$). Ag, Cr, Mo, Nb, Si, Ta and W, individually or in combination, enhance $Al_2O_3$ and suppress the less protective $TiO_2$. The additives should not exceed 5% by weight of the TiAl alloy in total. Of these, W provides the alloy with an oxide scale having the best oxidative resistance. Adding W in the range 1.7 wt. % to 4.5 wt. % provides superior results.

Another advantage of adding W is that it is already used during integrated circuit fabrication. The vias through the inter-layer dielectric material (between the metal layers) of the CMOS are typically W. Using W in the ejection heaters is less likely to cause detrimental contamination of other components in the integrated circuit or MEMS.

The microstructure of the TiAl is another important aspect. Gamma phase TiAl provides a lattice substrate that is complementary to alpha phase $Al_2O_3$ (known as corundum). Hence the adherence of the oxide layer to the underlying metal is strong. Also the grain size of the microstructure should be nanocrystalline range. The nanocrystalline structure gives a high density of grain boundaries which promotes diffusivity of Al to the surface. This further promotes a dense and mechanically stable oxide scale. It will be appreciated that a nanocrystalline structure is easily achieved by magnetron sputtering the heater material such that grain sizes are below 100 nano-meters.

The thin, dense $Al_2O_3$ layer gives the heater an operational life comparable to that of existing inkjet printheads. While the oxygen diffusivity through the oxide is low, some oxygen will continue to reach. However, the operational life can be extended, albeit with some compromise on ejection efficiency, by adding a thin protective coating on the TiAl heater. A very thin protective coating (less than 0.5 microns thick) in conjunction with the protection of the native oxide scale will greatly enhance the operation life without substantially reducing the energy efficiency of droplet ejection. The protective coating can be a single layer or a laminate of different materials. Silicon oxides, silicon nitrides and silicon carbides form suitable protective coatings for inkjet heater elements.

The present invention has been described herein by way of example only. Ordinary workers in this field will readily recognize many variations and modifications which do not depart from the spirit and scope of the broad inventive concept.

The invention claimed is:

1. An inkjet printhead for ejecting drops of liquid on to a media substrate, the inkjet printhead comprising:

a chamber for holding liquid;

a nozzle in fluid communication with the chamber;

a heater positioned in the chamber for thermal contact with the liquid such that resistive heating of the heater generates a vapour bubble that ejects a drop of the liquid through the nozzle; wherein, the heater is formed from a TiAlX alloy where Ti contributes more than 40% by weight, Al contributes more than 40% by weight and X contributes less than 5% by weight and comprises zero or more of Ag, Cr, Mo, Nb, Si, Ta and W, wherein the heater has a microstructure with a grain size less than 100 nanometers, and the heater further comprises a protective coating, the protective coating having a total thickness less than 0.5 microns.

2. An inkjet printhead according to claim 1 wherein X is W.

3. A MEMS vapor bubble generator according to claim 1 wherein X includes W which contributes between 1.7% and 4.5% by weight.

4. An inkjet printhead according to claim 1 wherein Ti contributes more than 48% by weight, Al contributes more than 48% by weight and X is 0% by weight.

5. An inkjet printhead according to claim 1 wherein the TiAl component of the heater has a gamma phase structure.

6. An inkjet printhead according to claim 1 wherein during use, the TiAlX alloy forms an $Al_2O_3$ surface oxide which directly contacts the liquid.

7. An inkjet printhead according to claim 1 wherein the TiAlX alloy is deposited as a layer less than 2 microns thick.

8. An inkjet printhead according to claim 7 wherein the layer is less than 0.5 microns thick.

9. An inkjet printhead according to claim 1 wherein the protective coating is a single layer of material.

10. An inkjet printhead according to claim 1 wherein the protective coating is at least partially formed from a silicon oxide, nitride or carbide.

* * * * *